US009831606B2

(12) United States Patent
Riley et al.

(10) Patent No.: US 9,831,606 B2
(45) Date of Patent: Nov. 28, 2017

(54) COMMUNICATION CONNECTOR

(71) Applicant: Leviton Manufacturing Co., Inc., Melville, NY (US)

(72) Inventors: Jon Clark Riley, Redmond, WA (US); Bret Taylor, Seattle, WA (US); Charles R. Bragg, Bothell, WA (US); Darrell W. Zielke, Bothell, WA (US); Tom Sauter, Melville, NY (US); Hua Wang, Mill Creek, WA (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 15/341,933

(22) Filed: Nov. 2, 2016

(65) Prior Publication Data

US 2017/0110834 A1 Apr. 20, 2017

Related U.S. Application Data

(62) Division of application No. 14/883,415, filed on Oct. 14, 2015, now Pat. No. 9,608,379.

(51) Int. Cl.
*H01R 13/64* (2006.01)
*H01R 13/6469* (2011.01)
(Continued)

(52) U.S. Cl.
CPC ..... *H01R 13/6469* (2013.01); *H01R 24/64* (2013.01); *H01R 43/16* (2013.01); *H01R 13/6658* (2013.01); *H01R 2107/00* (2013.01)

(58) Field of Classification Search
CPC ..... H01R 13/6466; H01R 13/6658; H01R 13/6464; H01R 13/6467; H01R 13/6461; H01R 13/6625
See application file for complete search history.

(56) References Cited

U.S. PATENT DOCUMENTS 3,636,500 A 1/1972 Sedlacek
3,763,461 A 10/1973 Kotski
(Continued)

FOREIGN PATENT DOCUMENTS

CN 101142757 3/2008
EP 1 443 608 8/2004
(Continued)

OTHER PUBLICATIONS

PCT International Search Report and Written Opinion in International application No. PCT/US2016/056374, dated Jan. 24, 2017.
(Continued)

*Primary Examiner* — Ross Gushi
(74) *Attorney, Agent, or Firm* — Davis Wright Tremaine LLP; George C. Rondeau, Jr.; Heather M. Colburn

(57) ABSTRACT

A communication connector including elongated contacts, and an optional flexible compensation circuit. The elongated contacts include a plurality of contact pairs. Each pair includes first and second contacts configured to transmit a differential signal. The elongated contacts may each have first and second portions with first and second heights, respectively. The first height is greater than the second height. The first portion of the first contact is positioned alongside the first portion of the second contact to capacitively couple the first and second contacts together. The optional flexible compensation circuit includes compensation circuitry configured to at least partially reduce crosstalk between the elongated contacts.

59 Claims, 46 Drawing Sheets

(51) Int. Cl.

| | |
|---|---|
| ***H01R 24/64*** | (2011.01) |
| ***H01R 43/16*** | (2006.01) |
| *H01R 107/00* | (2006.01) |
| *H01R 13/66* | (2006.01) |

(56) References Cited

U.S. PATENT DOCUMENTS

| | | | | |
|---|---|---|---|---|
| 3,845,455 | A | 10/1974 | Shoemaker | |
| 3,975,076 | A | 8/1976 | Shida et al. | |
| 4,682,835 | A | 7/1987 | Aujla et al. | |
| 4,749,366 | A | 6/1988 | McCaffery | |
| 4,847,711 | A | 7/1989 | Inoue | |
| 4,870,227 | A | 9/1989 | Saen et al. | |
| 4,897,040 | A | 1/1990 | Gerke et al. | |
| 4,909,754 | A | 3/1990 | Paradis | |
| 4,973,258 | A | 11/1990 | Fusselman | |
| 4,973,261 | A | 11/1990 | Hatagishi | |
| 5,131,863 | A | 7/1992 | Gerke et al. | |
| 5,230,632 | A | 7/1993 | Baumberger et al. | |
| 5,281,176 | A | 1/1994 | Yahagi et al. | |
| 5,501,607 | A | 3/1996 | Yoshioka et al. | |
| 5,533,910 | A | 7/1996 | Korner et al. | |
| 5,547,405 | A | 8/1996 | Pinney | |
| 5,836,782 | A | 11/1998 | Odley et al. | |
| 5,848,911 | A | 12/1998 | Garcin | |
| 6,142,817 | A | 11/2000 | Lee | |
| 6,371,793 | B1 | 4/2002 | Doorhy et al. | |
| 6,379,157 | B1 | 4/2002 | Curry et al. | |
| 6,431,903 | B1 | 8/2002 | Dittmann et al. | |
| 6,595,696 | B1 | 7/2003 | Zellak | |
| 6,764,222 | B1 | 7/2004 | Szilagyi et al. | |
| 6,786,776 | B2 | 9/2004 | Itano et al. | |
| 6,796,806 | B2 | 9/2004 | Boutros et al. | |
| 6,957,970 | B2 | 10/2005 | Weigel et al. | |
| 7,077,670 | B2 | 7/2006 | Suwa et al. | |
| 7,086,909 | B2 * | 8/2006 | Colantuono | H01R 13/6464 439/676 |
| 7,220,149 | B2 | 5/2007 | Phamey | |
| 7,249,974 | B2 | 7/2007 | Gordon et al. | |
| D565,443 | S | 4/2008 | Frake | |
| 7,413,464 | B1 | 8/2008 | Chen | |
| D587,201 | S | 2/2009 | Allwood | |
| 7,597,568 | B1 | 10/2009 | Lu | |
| D603,341 | S | 11/2009 | Kawakami | |
| 7,686,642 | B2 | 3/2010 | Pearson et al. | |
| 7,704,093 | B2 | 4/2010 | Turkekole et al. | |
| 7,713,094 | B1 | 5/2010 | Sparrowhawk | |
| 7,736,173 | B2 | 6/2010 | Chen | |
| 7,736,195 | B1 | 6/2010 | Poulsen et al. | |
| RE41,699 | E | 9/2010 | Itano et al. | |
| 7,821,370 | B1 | 10/2010 | Shu et al. | |
| 7,824,231 | B2 | 11/2010 | Marti et al. | |
| 7,857,655 | B2 | 12/2010 | Gyagang et al. | |
| 7,909,656 | B1 | 3/2011 | Erickson et al. | |
| 7,967,645 | B2 | 6/2011 | Marti et al. | |
| 7,976,334 | B2 | 7/2011 | Bishop | |
| 8,038,482 | B2 | 10/2011 | Erickson et al. | |
| D649,971 | S | 12/2011 | Lyford | |
| 8,100,705 | B2 | 1/2012 | Chen et al. | |
| 8,128,436 | B2 * | 3/2012 | Bopp | H01R 13/6658 439/676 |
| 8,137,141 | B2 | 3/2012 | Straka | |
| 8,198,536 | B2 | 6/2012 | Clark | |
| D663,273 | S | 7/2012 | Lyford | |
| D668,226 | S | 10/2012 | Lyford | |
| 8,475,201 | B2 | 7/2013 | Pirlo | |
| 8,690,459 | B2 | 4/2014 | Lin et al. | |
| D714,293 | S | 9/2014 | Kelly | |
| D721,036 | S | 1/2015 | Kreitzer | |
| D729,806 | S | 5/2015 | Park | |
| D731,489 | S | 6/2015 | Langhammer | |
| D732,536 | S | 6/2015 | Kang | |
| D733,142 | S | 6/2015 | Solomon | |
| 9,147,977 | B2 | 9/2015 | Poulsen et al. | |
| D743,398 | S | 11/2015 | Smith | |
| D745,523 | S | 12/2015 | Magi | |
| D746,291 | S | 12/2015 | Solomon | |
| 9,251,930 | B1 | 2/2016 | McNutt | |
| 9,257,805 | B2 | 2/2016 | Wang | |
| D752,590 | S | 3/2016 | Bragg et al. | |
| 2001/0049214 | A1 | 12/2001 | Billman | |
| 2004/0142589 | A1 | 7/2004 | Caveney | |
| 2005/0245125 | A1 | 11/2005 | Colantuono | |
| 2005/0277340 | A1 | 12/2005 | Gordon et al. | |
| 2006/0030184 | A1 | 2/2006 | Sakaki | |
| 2006/0094273 | A1 | 5/2006 | Mine et al. | |
| 2007/0049079 | A1 | 3/2007 | Nalwad et al. | |
| 2008/0105449 | A1 | 5/2008 | Kenny et al. | |
| 2008/0311797 | A1 | 12/2008 | Aekins | |
| 2009/0017656 | A1 | 1/2009 | Lee | |
| 2009/0104821 | A1 | 4/2009 | Marti | |
| 2010/0009567 | A1 | 1/2010 | Gyagang et al. | |
| 2010/0029122 | A1 | 2/2010 | Ferrus et al. | |
| 2010/0035471 | A1 | 2/2010 | Gaidosch | |
| 2010/0041527 | A1 | 2/2010 | Miller | |
| 2010/0206609 | A1 | 8/2010 | Glew | |
| 2012/0015536 | A1 | 1/2012 | Huang et al. | |
| 2012/0094525 | A1 | 4/2012 | Maranto et al. | |
| 2012/0184118 | A1 | 7/2012 | Lee et al. | |
| 2012/0202389 | A1 | 8/2012 | Erickson | |
| 2013/0164967 | A1 | 6/2013 | Lu | |
| 2013/0248221 | A1 | 9/2013 | Booth et al. | |
| 2013/0260581 | A1 | 10/2013 | Kuo et al. | |
| 2014/0057485 | A1 | 2/2014 | Huang | |
| 2014/0273626 | A1 | 9/2014 | Sparrowhawk | |
| 2015/0229078 | A1 | 8/2015 | Caveney et al. | |
| 2015/0295350 | A1 | 10/2015 | Bragg | |
| 2016/0036179 | A1 | 2/2016 | Bragg et al. | |
| 2016/0172794 | A1 | 6/2016 | Sparrowhawk et al. | |
| 2016/0240986 | A1 | 8/2016 | Bragg | |

FOREIGN PATENT DOCUMENTS

| | | |
|---|---|---|
| EP | 1 753 093 | 2/2007 |
| FR | 2 982 431 | 5/2013 |
| GB | 2343558 | 5/2000 |
| JP | 2006-318801 | 11/2006 |
| WO | 0051206 | 8/2000 |
| WO | 2005025007 | 3/2005 |
| WO | 2011-087480 | 7/2011 |
| WO | 2013063233 | 5/2013 |
| WO | 2015056246 | 4/2015 |

OTHER PUBLICATIONS

PCT International Search Report and Written Opinion in International application No. PCT/US2016/056499, dated Jan. 29, 2017.
Notice of Allowance, dated Dec. 13, 2016, received in U.S. Appl. No. 15/135,870.
English Abstract of Japanese Patent Publication No. 2006-318801, published Nov. 24, 2006.
PCT International Search Report and Written Opinion in corresponding International application No. PCT/US2015/025621, dated Aug. 10, 2015.
Non-Final Office Action, dated Apr. 13, 2016, received in U.S. Appl. No. 14/883,267.
Non-Final Office Action, dated Apr. 13, 2016, received in U.S. Appl. No. 14/685,379.
Non-Final Office Action, dated Jul. 21, 2016, received in U.S. Appl. No. 14/883,415.
Information Disclosure Statement Transmittal filed herewith.
PCT International Search Report and Written Opinion in International application No. PCT/US2017/015709, dated May 17, 2017.
Notice of Allowance, dated Jun. 5, 2017, received in U.S. Appl. No. 15/052630.
Extended European Search Report, dated Aug. 28, 2017, received in European Application No. 15 780 127.

* cited by examiner

COMMUNICATION CONNECTOR

CROSS REFERENCE TO RELATED APPLICATION(S)

The present application is a divisional of U.S. application Ser. No. 14/883,415, filed Oct. 14, 2015, which is incorporated herein by reference in its entirety.

BACKGROUND OF THE INVENTION

Field of the Invention

The present invention is directed generally to communication outlets and methods for reducing crosstalk therein.

Description of the Related Art

FIGS. 1A-1C depict a conventional high-speed compensation circuit 12 formed on a flexible printed circuit board (PCB) 14 (see FIGS. 1A and 1C). The flexible PCB 14 has been omitted in FIG. 1B to provide a better view of the components of the compensation circuit 12. The compensation circuit 12 was developed for speeds above those specified for the Category 6a standard.

Referring to FIGS. 1A and 1C, the flexible PCB 14 has a first side 15 (see FIG. 1A) opposite a second side 16 (see FIG. 1C). Referring to FIGS. 1B and 1C, the compensation circuit 12 includes six electrically conductive pads P2-P7 configured to contact corresponding tines (or contacts) within a conventional communication outlet or jack constructed in accordance with the RJ-45 standard. The tines are conventionally numbered 1-8 and arranged in four pairs. The first pair includes tines 4 and 5, the second pair includes tines 1 and 2, the third pair includes tines 3 and 6, and the fourth pair includes tines 7 and 8. Each pair conveys a differential signal. The pads P2-P7 are typically soldered to the tines 2-7, respectively.

Referring to FIGS. 1A and 1B, the compensation circuit 12 includes capacitor plates CP3 and CP6 formed on the first side 15 of the flexible PCB 14. The capacitor plates CP3 and CP6 are electrically connected to the pads P3 and P6, respectively. Referring to FIGS. 1B and 1C, the compensation circuit 12 includes capacitor plates CP2, CP4, CP5, and CP7 formed on the second side 16 of the flexible PCB 14. The capacitor plates CP2, CP4, CP5, and CP7 are electrically connected to the pads P2, P4, P5, and P7, respectively.

Referring to FIG. 1B, the capacitor plate CP3 is juxtaposed across the flexible PCB 14 (see FIGS. 1A and 1C) with both the capacitor plates CP5 and CP7. The capacitor plate CP6 is juxtaposed across the flexible PCB 14 (see FIGS. 1A and 1C) with both the capacitor plates CP2 and CP4.

The differential signal carried by the third (split) pair of tines (i.e., the tines 3 and 6) can be thought of as a sine wave that travels along and between the tines. In reality, the signal is much more complex, but mathematically, the signal can be broken down into a superimposed set of sine waves. Thus, wherever the potential is high on one of the tines of the split pair, the potential is low at a corresponding point on the other tine, and vice versa.

As the tines 3 and 6 of the third (split) pair carry the signal down their lengths, they also radiate a signal to neighboring tines. The radiated signal is noise (referred to as crosstalk) that obscures the signals that are propagating along the first pair of tines (tines 4 and 5), the second pair of tines (tines 1 and 2), and the fourth pair of tines (tines 7 and 8).

The compensation circuit 12 counteracts crosstalk, especially the crosstalk radiating from the third split pair. The tine 6 radiates its signal particularly strongly to neighboring tines 5 and 7. Inside the compensation circuit 12, some of the signal received by the pad P3 (which was received from the tine 3 and is opposite the signal conducted by the tine 6) is conducted to the capacitor plate CP3 juxtaposed with the capacitor plates CP5 and CP7, which are connected to the pads P5 and P7 (and therefore, the tines 5 and 7), respectively. The electrical field of an electrical potential applied to the capacitor plate CP3 radiates across a gap between the capacitor plate CP3 and the capacitor plate CP5 and across a gap between the capacitor plate CP3 and the capacitor plate CP7. In this manner, cross talk from the tine 6 is counterbalanced or canceled by anti-crosstalk from the tine 3.

Similarly, the tine 3 radiates its signal particularly strongly to neighboring tines 2 and 4. Inside the compensation circuit 12, some of the signal received by the pad P6 (which was received from the tine 6 and is opposite the signal conducted by the tine 3) is conducted to the capacitor plate CP6 juxtaposed with the capacitor plates CP2 and CP4, which are connected to the pads P2 and P4 (and therefore, the tines 2 and 4), respectively. The electrical field of an electrical potential applied to the capacitor plate CP6 radiates across a gap between the capacitor plate CP6 and the capacitor plate CP2 and across a gap between the capacitor plate CP6 and the capacitor plate CP4. In this manner, cross talk from the tine 3 is counterbalanced or canceled by anti-crosstalk from the tine 6.

Unfortunately, a capacitive structure like that of the compensation circuit 12 may look or function like a low impedance circuit to a high frequency signal. The impedance drops as the size of the capacitive plates CP2-CP7 increase, which increases insertion loss. Therefore, a need exists for communication outlets configured to conduct high speed signals that provide adequate crosstalk compensation. Communication outlets with acceptable insertion loss are particularly desirable. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 2:
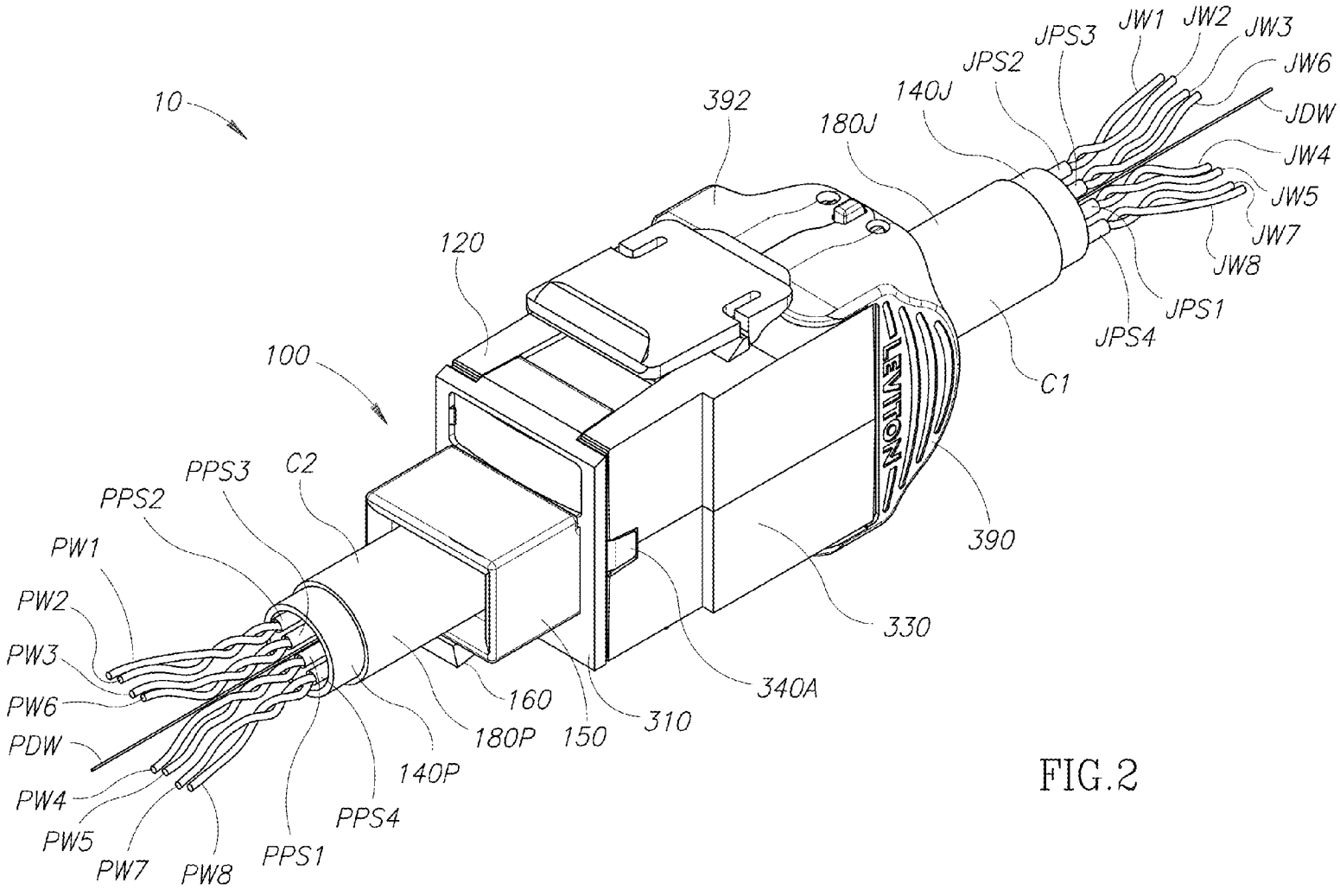
FIG. 2 is a perspective view of a connection that includes a communication outlet mated with a conventional RJ-45 type plug.

FIG. 2 is a perspective view of an assembly or connection 10 that includes a conventional RJ-45 type plug 100 mated with a communication outlet 120. For ease of illustration, the plug receiving side of the outlet 120 will be referred to as the front of the outlet 120. Similarly, the portion of the plug 100 inserted into the outlet 120 will be referred to as the front of the plug 100. The outlet 120 terminates a communication cable C1 and the plug 100 terminates a communication cable C2. Thus, the connection 10 connects the cables C1 and C2 together.

Cables

The cables C1 and C2 may be substantially identical to one another. For the sake of brevity, only the structure of the cable C1 will be described in detail. The cable C1 includes a drain wire JDW and a plurality of wires JW1-JW8. The wires JW1-JW8 are arranged in four twisted-wire pairs (also known as "twisted pairs"). The first twisted pair includes the wires JW4 and JW5. The second twisted pair includes the wires JW1 and JW2. The third twisted pair includes the wires JW3 and JW6. The fourth twisted pair includes the wires JW7 and JW8.

Optionally, each of the twisted pairs may be housed inside a pair shield. In the embodiment illustrated, the first twisted pair (wires JW4 and JW5) is housed inside a first pair shield JPS1, the second twisted pair (wires JW1 and JW2) is housed inside a second pair shield JPS2, the third twisted pair (wires JW3 and JW6) is housed inside a third pair shield JPS3, the fourth twisted pair (wires JW7 and JW8) is housed inside a fourth pair shield JPS4. For ease of illustration, the optional pair shields JPS1-JPS4 have been omitted from the other figures.

The drain wire JDW, the wires JW1-JW8, and the optional pair shields JPS1-JPS4 are housed inside a cable shield 140J. The drain wire JDW, the wires JW1-JW8, and the optional pair shields JPS1-JPS4 are each constructed from one or more electrically conductive materials.

The drain wire JDW, the wires JW1-JW8, the optional pair shields JPS1-JPS4, and the cable shield 140J are housed inside a protective outer cable sheath or jacket 180J typically constructed from an electrically insulating material.

Optionally, the cable C1 may lack a shield altogether or include additional conventional cable components (not shown) such as additional shielding, dividers, and the like.

Figure 3:
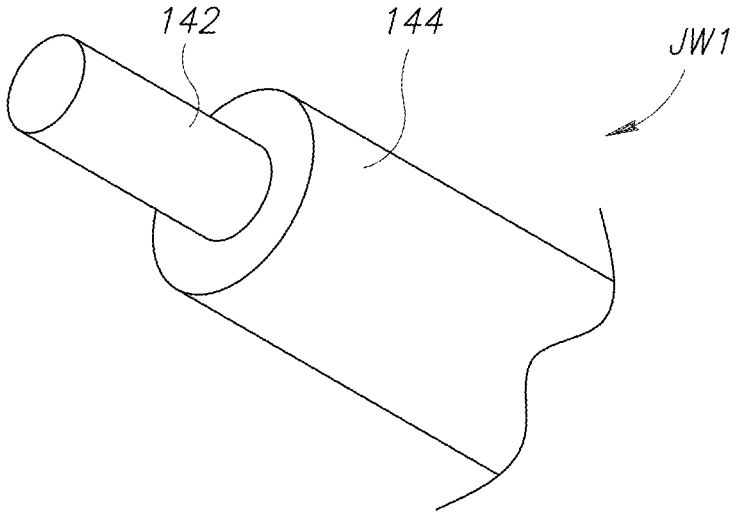
FIG. 3 is an enlarged perspective view of a wire of a cable connected to the outlet of FIG. 2.

Turning to FIG. 3, each of the wires JW1-JW8 (see FIG. 2) is substantially identical to one another. For the sake of brevity, only the structure of the wire JW1 will be described. As is appreciated by those of ordinary skill in the art, the wire JW1 as well as the wires JW2-JW8 each includes an electrical conductor 142 (e.g., a conventional copper wire) surrounded by an outer layer of insulation 144 (e.g., a conventional insulating flexible plastic jacket).

Returning to FIG. 2, each of the twisted pairs serves as a conductor of a differential signaling pair wherein signals are transmitted thereupon and expressed as voltage and/or current differences between the wires of the twisted pair. A twisted pair can be susceptible to electromagnetic sources including another nearby cable of similar construction. Signals received by the twisted pair from such electromagnetic sources external to the cable's jacket (e.g., the jacket 180J) are referred to as alien crosstalk. The twisted pair can also receive signals from one or more wires of the three other twisted pairs within the cable's jacket, which is referred to as "local crosstalk" or "internal crosstalk."

As mentioned above, the cables C1 and C2 may be substantially identical to one another. In the embodiment illustrated, the cable C2 includes a drain wire PDW, wires PW1-PW8, optional pair shields PPS1-PPS4, a cable shield 140P, and a cable jacket 180P that are substantially identical to the drain wire JDW, the wires JW1-JW8, the optional pair shields JPS1-JPS4, the cable shield 140J, and the cable jacket 180J, respectively, of the cable C1.

Plug

Figure 4:
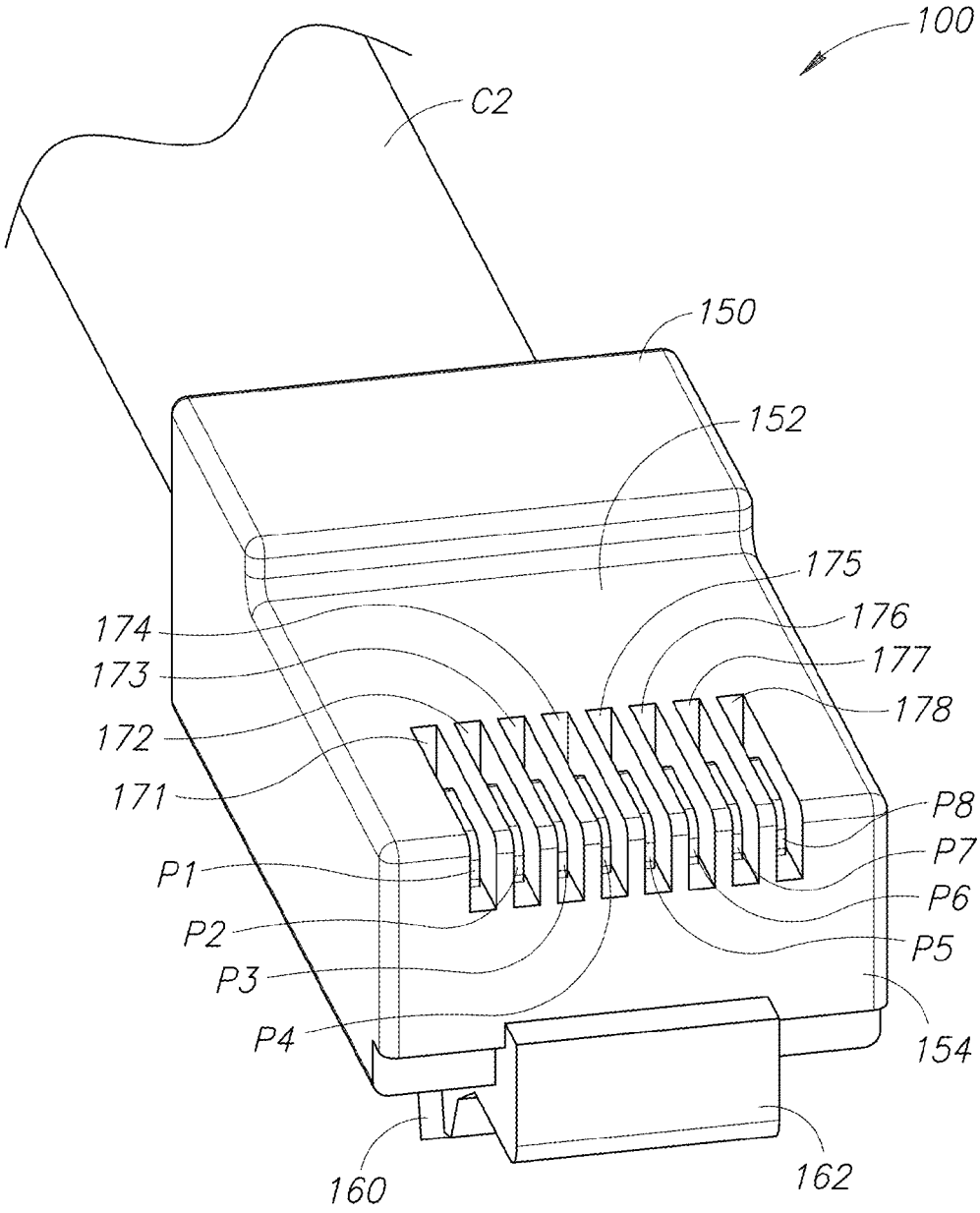
FIG. 4 is a perspective view of the front of the conventional RJ-45 type plug of FIG. 2.

FIG. 4 is a perspective view of the plug 100 separated from the outlet 120 (see FIG. 2). The plug 100 may be inserted into the outlet 120 to form the connection 10 depicted in FIG. 2.

As mentioned above, the plug 100 is a conventional RJ-45 type plug. Thus, referring to FIG. 4, the plug 100 includes a plug housing 150. The housing 150 may be constructed of a conductive material (e.g., metal). In such embodiments, referring to FIG. 2, the drain wire PDW, the cable shield 140P, and/or optional pair shields PPS1-PPS4 may contact the housing 150 and form an electrical connection therewith.

Referring to FIG. 4, the plug housing 150 is configured to house plug contacts P1-P8. Each of the plug contacts P1-P8 is constructed from an electrically conductive material. Referring to FIG. 2, inside the plug 100, the plug contacts P1-P8 (see FIG. 4) are electrically connected to the wires PW1-PW8, respectively, of the cable C2.

Referring to FIG. 4, the housing 150 has a forward portion 152 configured to be received by the outlet 120 (see FIG. 2), and the forward portion 152 has a forward facing portion 154. Openings 171-178 are formed in the forward portion 152 of the plug housing 150. The plug contacts P1-P8 are positioned adjacent the openings 171-178, respectively. Referring to FIG. 2, when the plug 100 is received by the outlet 120 to form the connection 10, outlet contacts J1-J8 (see FIG. 6) in the outlet 120 extend into the openings 171-178 (see FIG. 4), respectively, and contact the plug contacts P1-P8 (see FIG. 4), respectively. In the connection 10, the contacts P1-P8 (see FIG. 4) form physical and electrical connections with the outlet contacts J1-J8 (see FIG. 6), respectively, of the outlet 120.

Figure 7:
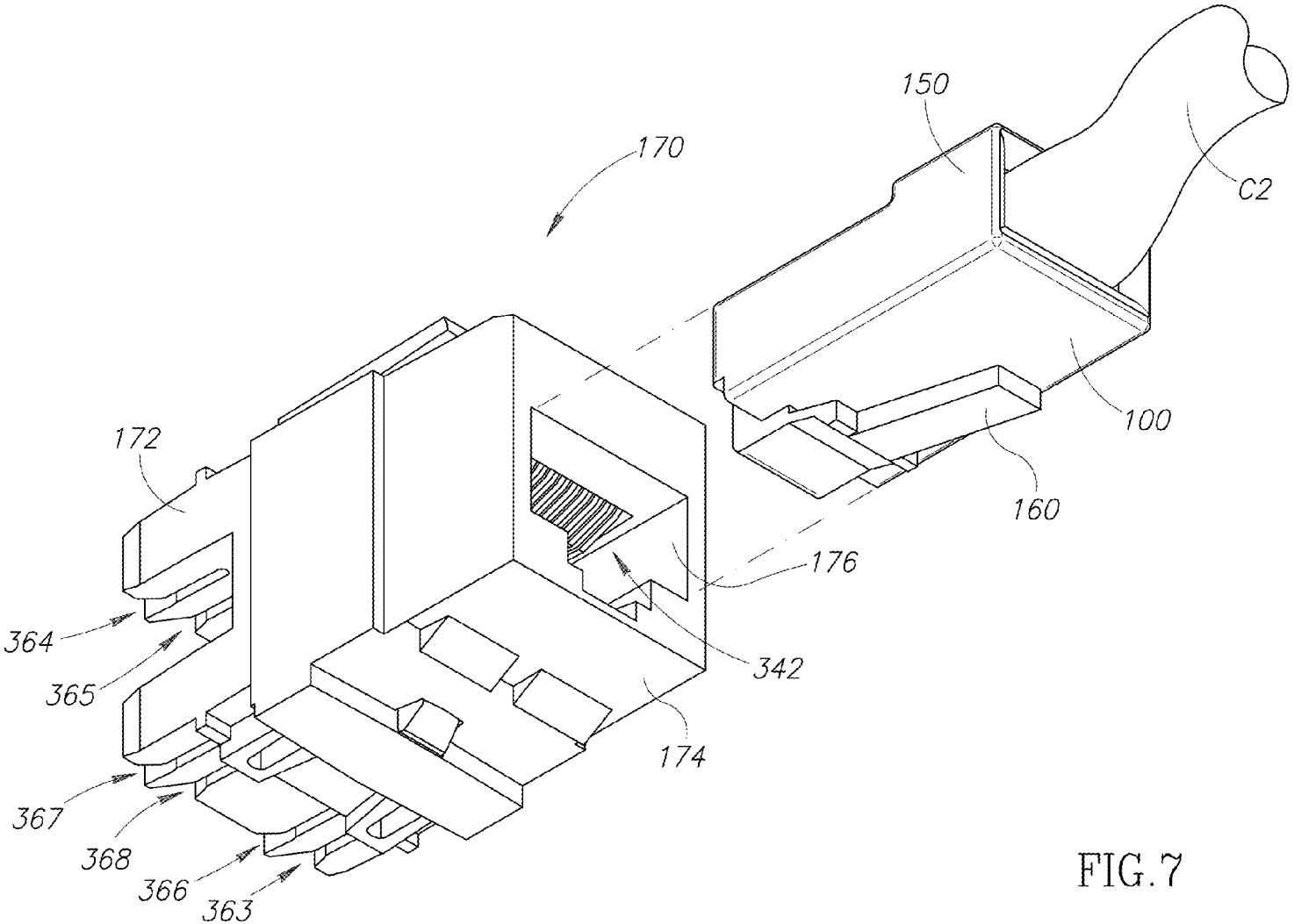
FIG. 7 is a perspective view of an alternate embodiment of a communication outlet mated with the conventional RJ-45 type plug of FIG. 4.

Referring to FIGS. 2, 4, and 7, a conventional latch arm 160 is attached to the housing 150. Referring to FIG. 4, a portion 162 of the latch arm 160 extends onto the forward facing portion 154. The portion 162 extends forwardly from the forward facing portion 154 away from the housing 150.

Outlet

Referring to FIG. 2, in the embodiment illustrated, the outlet 120 is constructed to comply with the RJ-45 standard. The structures of the outlet 120 are described in detail in U.S. patent application Ser. No. 14/685,379, filed on Apr. 13, 2015, which is incorporated here by reference in its entirety.

Figure 5:
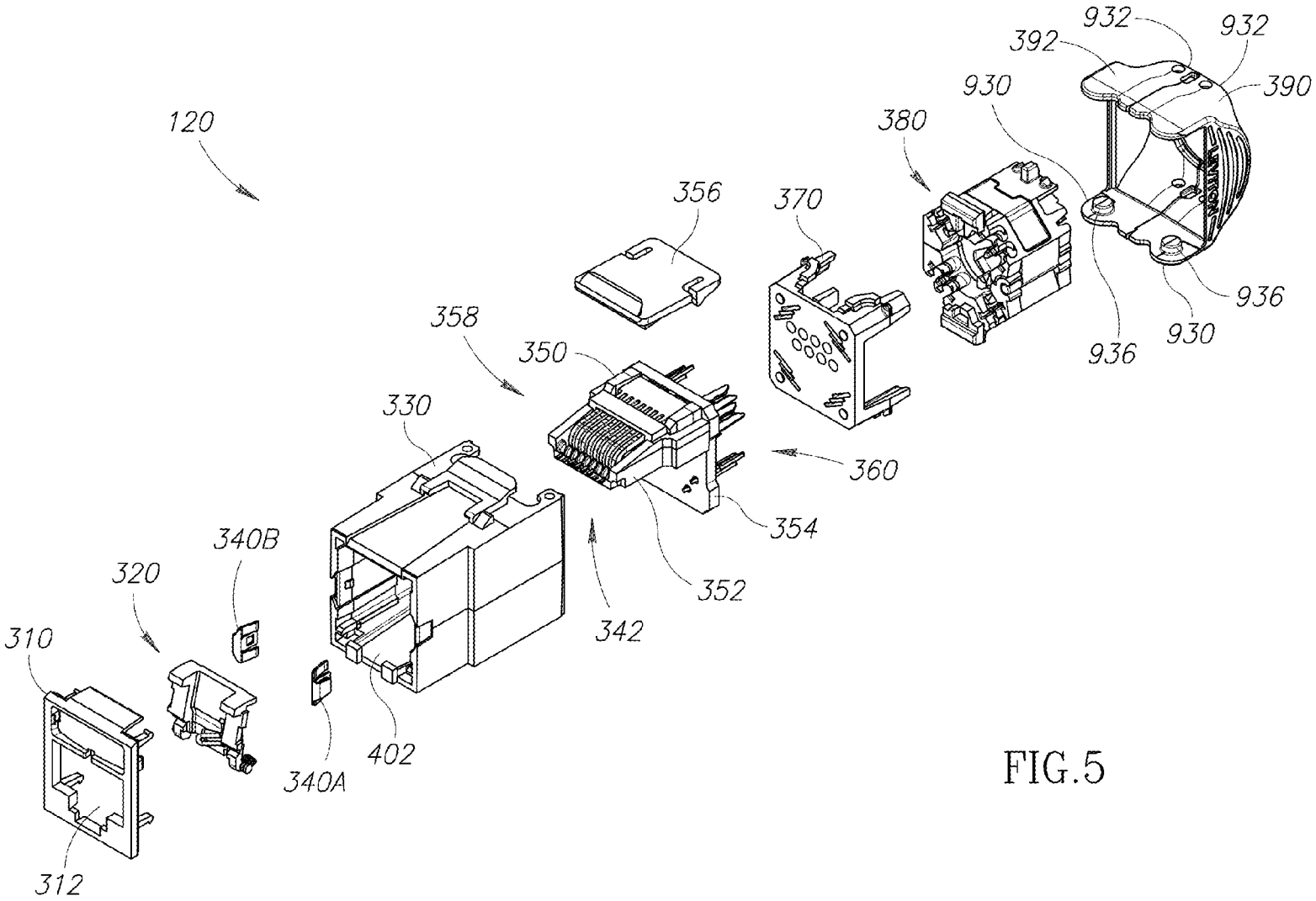
FIG. 5 is a partially exploded perspective view of the outlet of FIG. 2.
Figure 8:
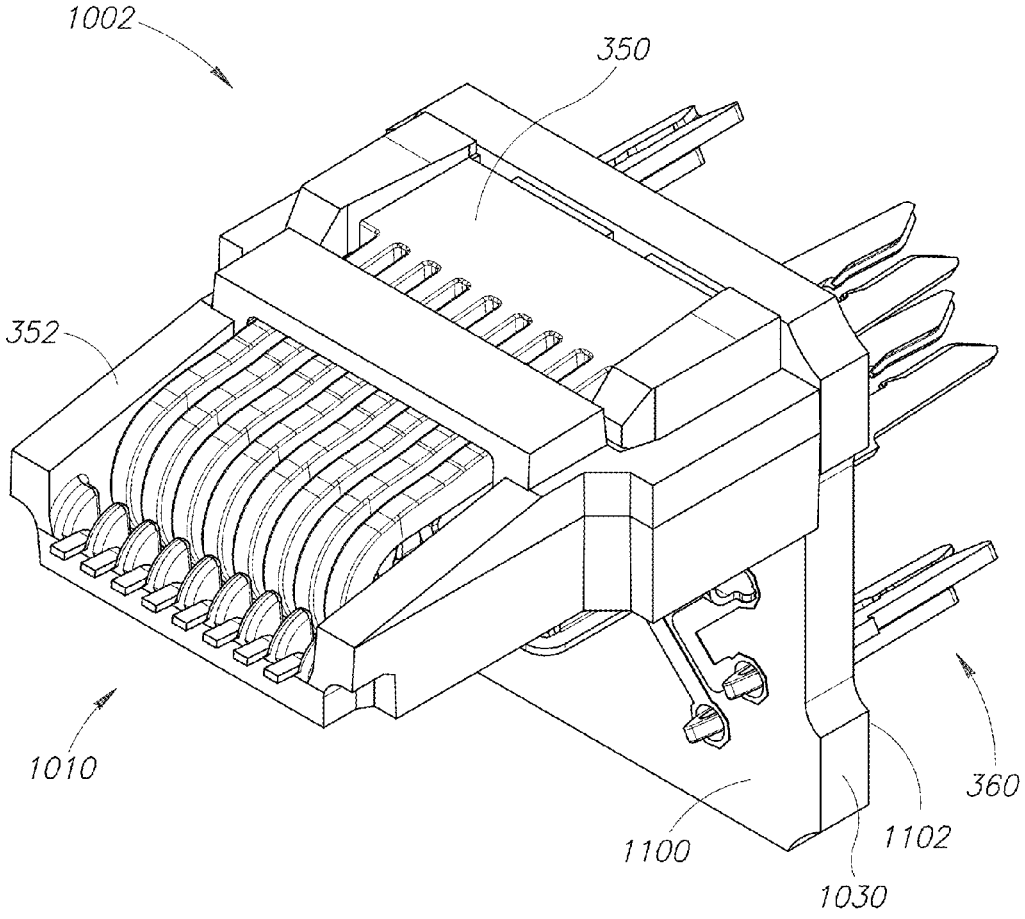
FIG. 8 is a first perspective view of a second embodiment of a subassembly for use with an outlet.

FIG. 5 is exploded perspective view of the outlet 120 and is identical to FIG. 8 of U.S. patent application Ser. No. 14/685,379. Referring to FIG. 5, the outlet 120 includes a face plate 310, a locking shutter subassembly 320, a housing 330, one or more ground springs 340A and 340B, a plurality of resilient tines or outlet contacts 342 (e.g., the outlet contacts J1-J8 depicted in FIG. 6), an optional spring assembly 350, a contact positioning member 352, a substrate 354 (depicted as a printed circuit board), an optional clip or latch member 356, a plurality of wire contacts 360 (e.g., wire contacts 361-368 illustrated in FIG. 6), a guide sleeve 370, a wire manager 380, and housing doors 390 and 392. Together the outlet contacts 342, the optional spring assembly 350, the contact positioning member 352, the substrate 354, and the wire contacts 360, may be characterizing as forming a first embodiment of a subassembly 358 configured for use with the other components of the outlet 120.

Figure 6:
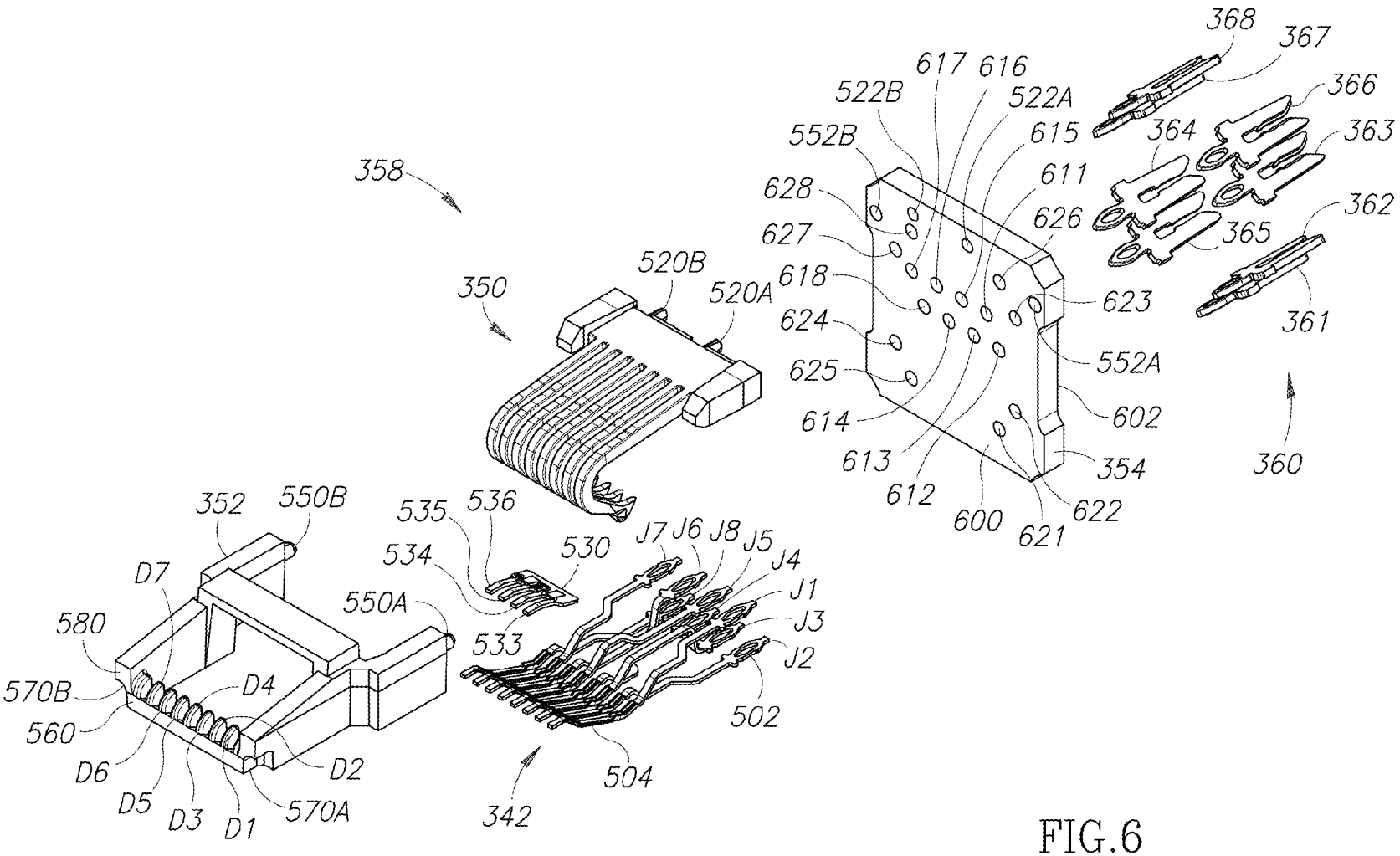
FIG. 6 is an exploded perspective view of a first embodiment of a subassembly of the outlet of FIG. 2.

Referring to FIG. 6, depending upon the implementation details, the subassembly 358 may include an optional flexible printed circuit board ("PCB") 530 having crosstalk attenuating or cancelling circuits formed thereon configured to provide crosstalk compensation. The flexible PCB 530 may include contacts 533, 534, 535, and 536 configured to be connected (e.g., soldered) to the centermost outlet contacts J3, J4, J5, and J6, respectively.

While illustrated for use with the outlet 120, the subassembly 358 may be used with other outlets constructed to comply with the RJ-45 standard. For example, referring to FIG. 7, the subassembly 358 may be incorporated into a conventional RJ-45 type outlet 170 that includes a carrier or terminal block 172 connected to a conventional outlet housing 174. Like the outlet 120, the outlet 170 may be used to terminate the communication cable C1 (see FIG. 2) and form a communication connection (like the connection 10 depicted in FIG. 2) with the plug 100. As shown in FIG. 7, the outlet contacts 342 are positioned inside and accessible through an opening 176 in the outlet housing 174, and the wire contacts 360 are positioned inside and accessible through the terminal block 172. As is apparent to those of ordinary skill in the art, the optional spring assembly 350 (see FIGS. 5 and 6) and the contact positioning member 352 (see FIGS. 5 and 6) are positioned inside the outlet housing 174 and the substrate 354 (see FIGS. 5 and 6) is positioned at or near the location where the terminal block 172 is connected to the outlet housing 174.

The outlet 120 and the outlet 170 may each be implemented as a Category 8, RJ-45 style outlet, jack, or port. Further, the outlet 120 and the outlet 170 may each be implemented as a lower category outlet, such as a Category 6a outlet, a Category 6 outlet, a Category 5e outlet, and the like.

Alternate Embodiment

Figure 9:
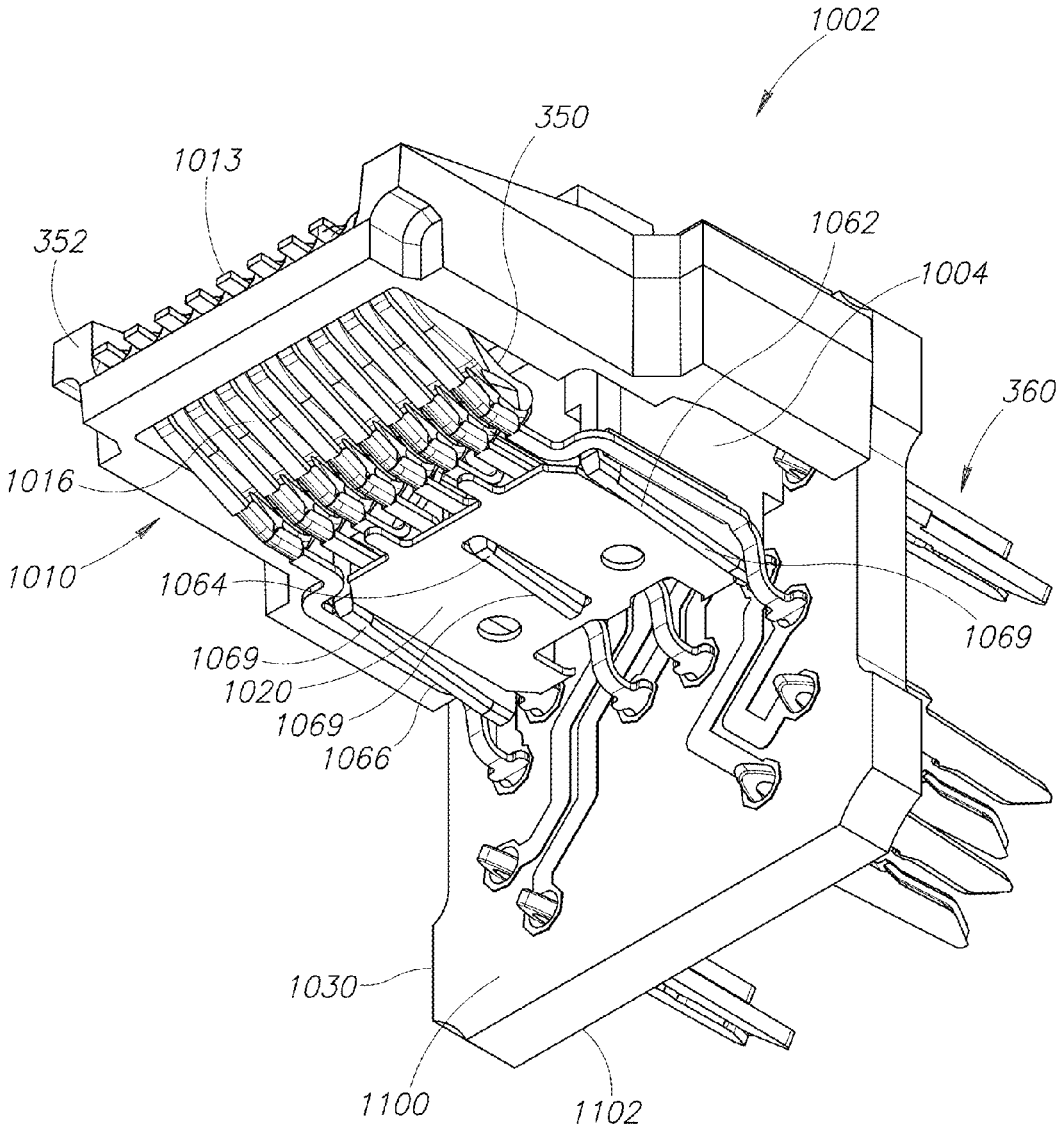
FIG. 9 is a second perspective view of the second embodiment of the subassembly.
Figure 10:
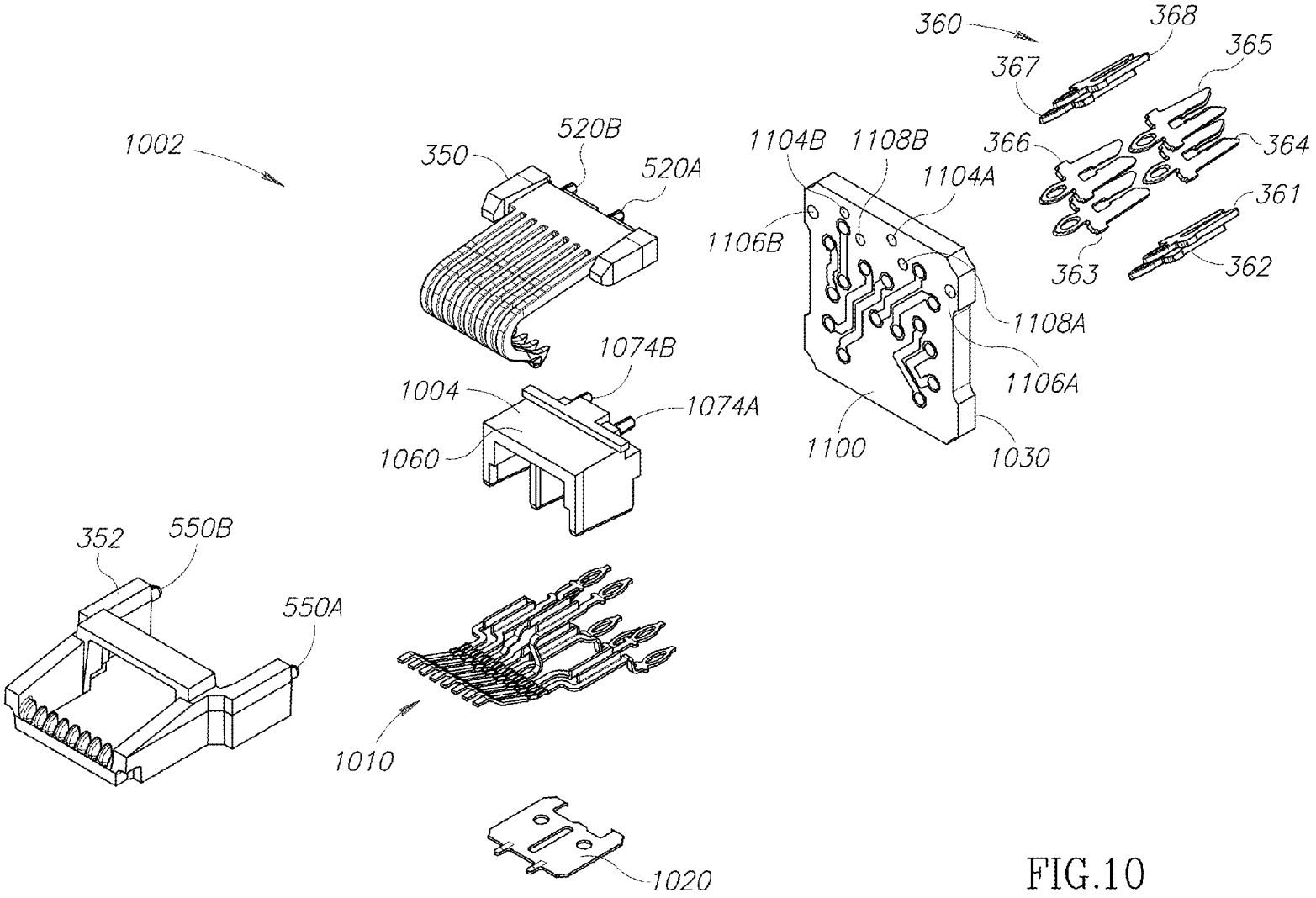
FIG. 10 is a first exploded perspective view of the second embodiment of the subassembly.
Figure 11:
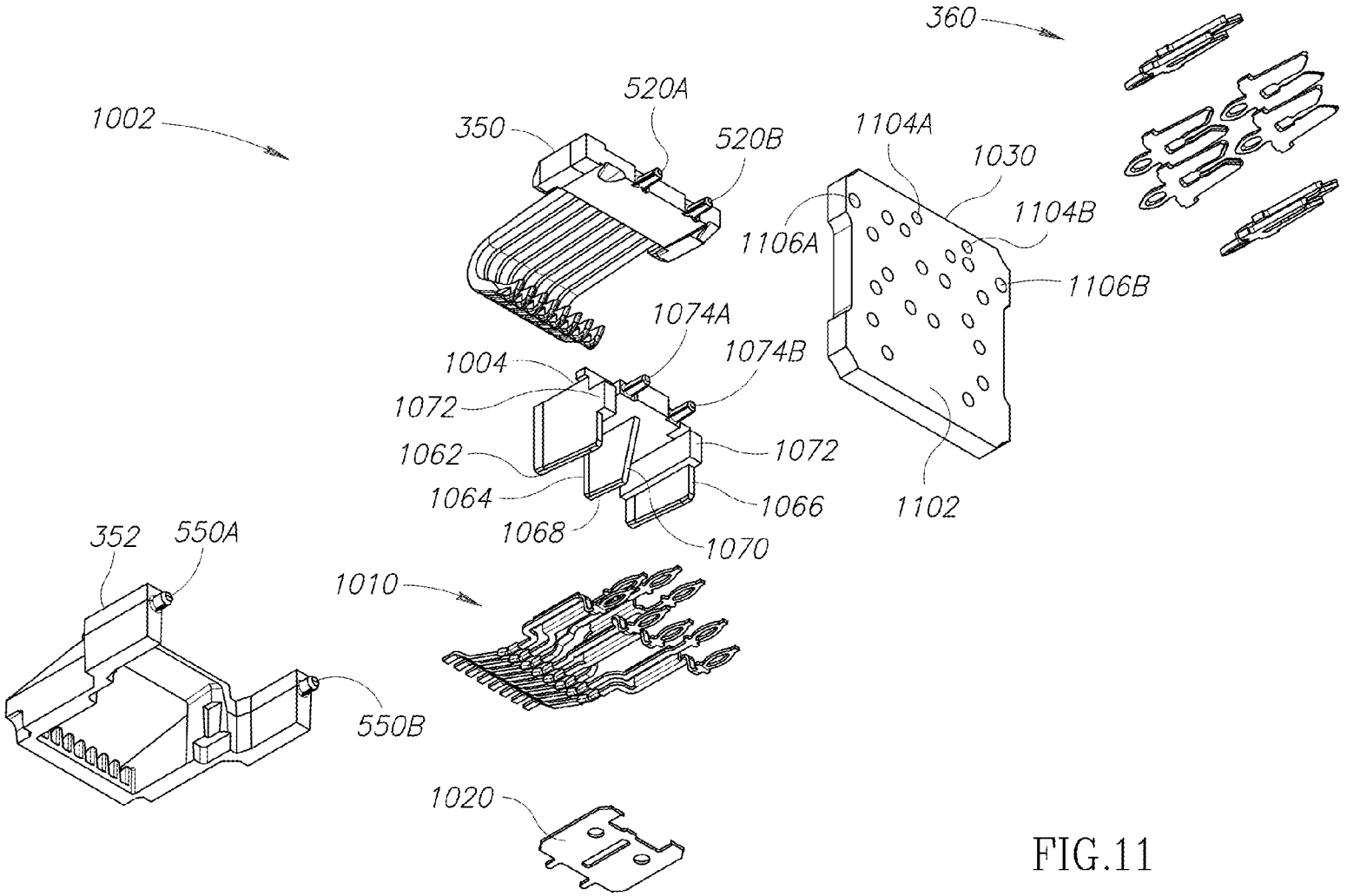
FIG. 11 is a second exploded perspective view of the second embodiment of the subassembly.

Referring to FIGS. 8-11, a subassembly 1002 may be used instead of and in place of the subassembly 358 to construct the outlet 120 (see FIGS. 2 and 5), the outlet 170, and/or other outlets that comply with the RJ-45 standard. Referring to FIGS. 10 and 11, the subassembly 1002 includes a dielectric comb 1004, a plurality of outlet contacts 1010, a compensation circuit 1020, the optional spring assembly 350, the contact positioning member 352, a substrate 1030, and the wire contacts 360.

Outlet Contacts

Figure 12:
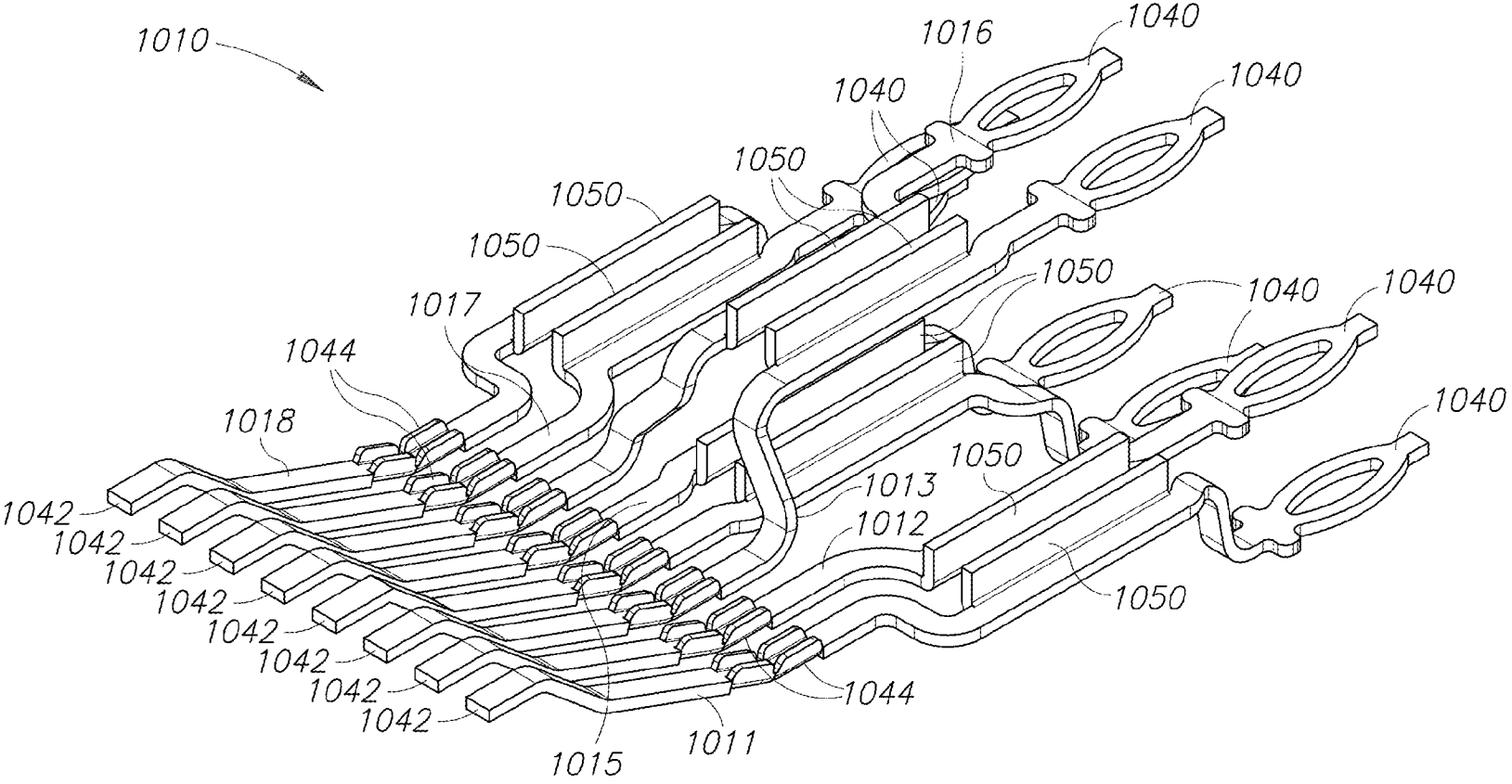
FIG. 12 is a perspective view of a plurality of outlet contacts of the second embodiment of the subassembly.

Referring to FIG. 12, in the embodiment illustrated, the outlet contacts 1010 include the eight individual outlet contacts 1011-1018 that correspond to the eight plug contacts P1-P8 (see FIG. 4), respectively. However, through application of ordinary skill in the art to the present teachings, embodiments including different numbers of outlet contacts (e.g., 4, 6, 10, 12, 16, etc.) may be constructed for use with plugs having different numbers of plug contacts.

Figure 13:
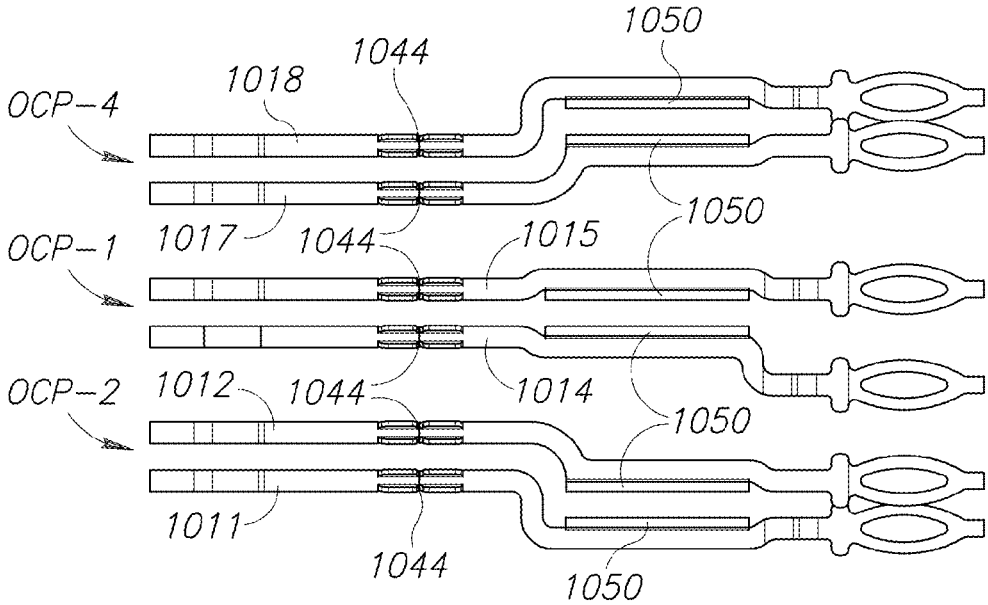
FIG. 13 is a top view of a first portion of the outlet contacts of FIG. 12.
Figure 14:
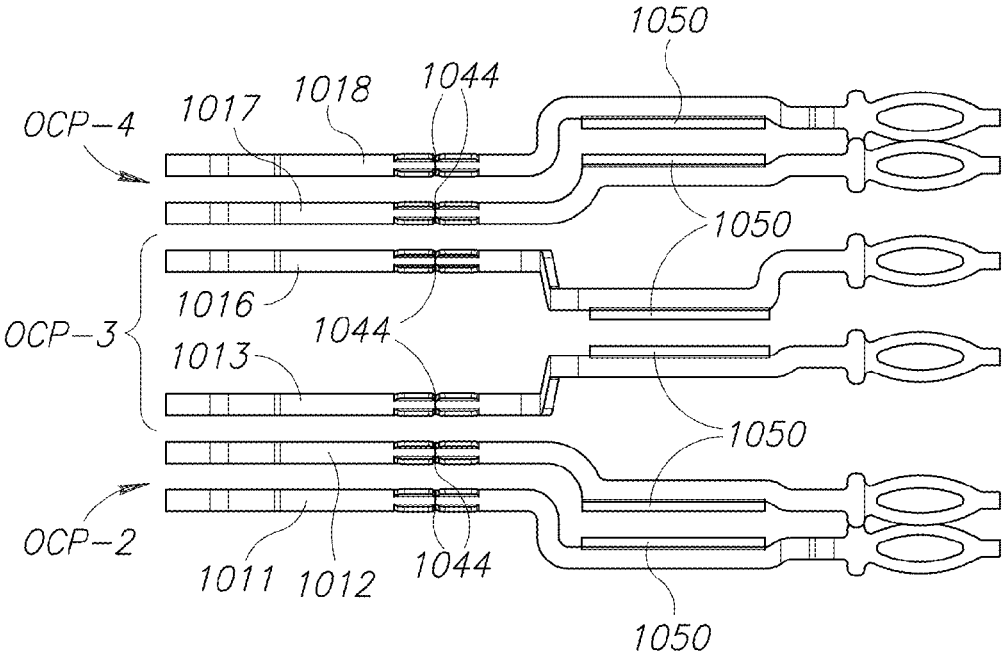
FIG. 14 is a top view of a second portion of the outlet contacts of FIG. 12.

FIG. 13 is a top view of the outlet contacts 1011, 1012, 1014, 1015, 1017, and 1018. FIG. 14 is a top view of the outlet contacts 1011, 1012, 1013, 1016, 1017, and 1018. Referring to FIG. 12, each of the outlet contacts 1011-1018 has a first end portion 1040 configured to be connected to the substrate 1030 (see FIGS. 10 and 11), and a second free end portion 1042 opposite the first end portion 1040. The second free end portions 1042 are arranged to contact the plug contacts P1-P8 (see FIG. 4), respectively, of the plug 100 (see FIG. 4).

Referring to FIG. 12, each of the outlet contacts 1011-1018 has a knuckle portion 1044 between the first end portion 1040 and the second free end portion 1042. The spring assembly 350 (see FIGS. 10 and 11) presses on the knuckle portions 1044 of the outlet contacts 1010. The plug contacts P1-P8 (see FIG. 4) contact the outlet contacts 1011-1018, respectively, at or near their knuckle portions 1044. Thus, a portion of each of the outlet contacts 1011-1018 between the second free end portion 1042 and the knuckle portion 1044 may be characterized as being a non-current carrying portion. Similarly, a portion of each of the outlet contacts 1011-1018 between the knuckle portion 1044 and the first end portion 1040 may be characterized as being a current carrying portion.

To achieve a desired (e.g., 100-Ohm) impedance, outlet contacts (such as the outlet contacts 342 depicted in FIGS. 5-7) must either be quite close together or very tall. Unfortunately, outlet contacts become stiffer as they get thicker (or taller). The outlet contacts 1010 are configured to achieve both a desired (e.g., 100-Ohm) impedance and a desired amount of flexibility. Each of the outlet contacts 1011-1018 has at least one thicker (or taller) portion 1050 (referred to hereafter as a fin 1050). Thus, at locations other than the fins 1050, the outlet contacts 1011-1018 may be thinner and more flexible. This configuration achieves the necessary thickness while at the same time achieving the desired flexibility.

By way of a non-limiting example, the outlet contacts 1010 may be formed from a sheet material (e.g., sheet metal) having a uniform thickness of about 0.20 millimeters. The fins 1050 may be formed by bending a portion of the sheet material upwardly. Thus, the fins 1050 are taller than other portions of the outlet contacts 1010. In this example, at the fins 1050, the outlet contacts 1010 may each have a height of about 0.75 millimeters.

Like the wires JW1-JW8 (see FIG. 2), the outlet contacts 1011-1018 electrically connected to the wires JW1-JW8, respectively, may be described as being organized into differential signaling (or transmission) pairs. Referring to FIG. 13, a first outlet contact pair OCP-1 includes the outlet contacts 1014 and 1015. A second outlet contact pair OCP-2 includes the outlet contacts 1011 and 1012. Referring to FIG. 14, a third (split) outlet contact pair OCP-3 includes the outlet contacts 1013 and 1016. Referring to FIGS. 13 and 14, a fourth outlet contact pair OCP-4 includes the outlet contacts 1017 and 1018. Each of the outlet contact pairs OCP-1 to OCP-4 may be transmission-optimized with carefully controlled impedance all the way from the outlet contacts 1010 to the wire contacts 360 (see FIGS. 10 and 11).

Referring to FIG. 13, the outlet contacts 1014 and 1015 (of the first outlet contact pair OCP-1) are configured to position the fin 1050 of the outlet contact 1014 alongside the fin 1050 of the outlet contact 1015. The fin 1050 of the outlet contact 1014 is spaced apart from and does not touch the fin 1050 of the outlet contact 1015 to inductively and/or capacitively couple together the outlet contacts 1014 and 1015 of the first outlet contact pair OCP-1.

Referring to FIGS. 13 and 14, the outlet contacts 1011 and 1012 (of the second outlet contact pair OCP-2) are configured to position the fin 1050 of the outlet contact 1011 alongside the fin 1050 of the outlet contact 1012. The fin 1050 of the outlet contact 1011 is spaced apart from and does not touch the fin 1050 of the outlet contact 1012 to inductively and/or capacitively couple together the outlet contacts 1011 and 1012 of the second outlet contact pair OCP-2.

Referring to FIG. 14, the outlet contacts 1013 and 1016 (of the third outlet contact pair OCP-3) are configured to position the fin 1050 of the outlet contact 1013 alongside the fin 1050 of the outlet contact 1016. The fin 1050 of the outlet contact 1013 is spaced apart from and does not touch the fin 1050 of the outlet contact 1016 to inductively and/or capacitively couple together the outlet contacts 1013 and 1016 of the third outlet contact pair OCP-3.

Referring to FIGS. 13 and 14, the outlet contacts 1017 and 1018 (of the fourth outlet contact pair OCP-4) are configured to position the fin 1050 of the outlet contact 1017 alongside the fin 1050 of the outlet contact 1018. The fin 1050 of the outlet contact 1017 is spaced apart from and does not touch the fin 1050 of the outlet contact 1018 to inductively and/or capacitively couple together the outlet contacts 1017 and 1018 of the fourth outlet contact pair OCP-4.

In the embodiment illustrated in FIGS. 13-16, the fins 1050 of the first, second, third, and fourth outlet contact pairs OCP-1 to OCP-4 are aligned along the same vertical plane. Further, the fins 1050 of the outlet contacts of the first, second, and fourth outlet contact pairs OCP-1, OCP-2, and OCP-4 are aligned along the same horizontal plane. However, as may be viewed in FIGS. 15 and 16, the fins 1050 of the outlet contacts 1013 and 1016 (of the third outlet contact pair OCP-3) are position above the fins 1050 of the outlet contacts 1014 and 1015 (of the first outlet contact pair OCP-1), respectively.

The impedance of each of the outlet contact pairs OCP-1 to OCP-4 may be configured for high speed transmission (e.g., 40 Gb/s, Category 8 Ethernet). By way of a non-limiting example, each of the outlet contact pairs OCP-1 to OCP-4 may transmit a wide-bandwidth signal (e.g., 2 GHz) carrying data encoded in amplitude. The reception of signals from other outlet contact pairs (crosstalk) would degrade that signal and make it harder to recover data encoded in the signal. The inductive and/or capacitive coupling between the outlet contacts of each of the outlet contact pairs OCP-1 to OCP-4 helps reduce such crosstalk within an outlet (e.g., the outlet 120 illustrated in FIGS. 2 and 5, the outlet 170 illustrated in FIG. 7, and/or other outlets constructed to comply with the RJ-45 standard) that includes the outlet contacts 1010.

Further, as may be seen in FIGS. 13-16, the outlet contact pairs OCP-1 to OCP-4 are spaced farther apart from one another than in a conventional RJ-45 type connector. The spacing of the outlet contact pairs OCP-1 to OCP-4 within an outlet (e.g., the outlet 120 illustrated in FIGS. 2 and 5, the outlet 170 illustrated in FIG. 7, and/or other outlets constructed to comply with the RJ-45 standard) that includes the outlet contacts 1010 concentrates electronic fields ("E-fields") between the pairs to reduce E-field coupling between different pairs. Crosstalk between the outlet contact pairs OCP-1 to OCP-4 falls off rapidly as they are moved farther apart. By way of a non-limiting example, at the location of the fins 1050, the outlet contact pair OCP-2 may be spaced a minimum distance of about 2.0 millimeters away from the outlet contact pair OCP-1. Similarly, at the location of the fins 1050, the outlet contact pair OCP-1 may be spaced a minimum distance of about 2.0 millimeters away from the outlet contact pair OCP-4. Continuing this example, at the location of the fins 1050, the outlet contact pairs OCP-2 and OCP-4 may each be spaced a minimum distance of about 3.0 millimeters away from the outlet contact pair OCP-3. Further, at the location of the fins 1050, the outlet contact pair OCP-1 may be spaced a minimum vertical distance of about 1.0 millimeters away from the outlet contact pair OCP-3.

In contrast to existing high speed connector technology (e.g. ARJ connectors and conventional RJ-45 type connectors), connectors that include the outlet contacts 1010, spacing (or distance) between the outlet contact pairs OCP-1 to OCP-4 reduces and/or eliminates pair-to-pair crosstalk of the type that occurs in prior art high speed connectors. Thus, an outlet (e.g., the outlet 120 illustrated in FIGS. 2 and 5, the outlet 170 illustrated in FIG. 7, and/or other outlets constructed to comply with the RJ-45 standard) that includes the outlet contacts 1010 does not need complex shielding. Instead, each of the outlet contact pairs OCP-1 to OCP-4 is spaced farther away from every other pair.

In embodiments in which the outlet contacts 1010 are formed from a sheet material, such as a sheet metal, the fins 1050 may be formed by bending a portion of each of the outlet contacts 1010 substantially orthogonally to a plane along which the plug contacts P1-P8 (see FIG. 4) are aligned.

At their fins 1050, each of the outlet contacts 1011-1018 has a generally L-shaped cross-sectional shape. However, at their thicker (or taller) portions 1050, the outlet contacts 1010 may have other shapes. For example, FIGS. 17A-17F depict alternate cross-sectional shapes that may be used to construct the taller or thicker portions 1050 of the outlet contacts 1010. For example, referring to FIGS. 17A and 17B, at their thicker (or taller) portions 1050, the outlet contacts 1010 may each have a generally square or rectangular cross-sectional shape. By way of other non-limiting examples, as shown in FIGS. 17C-17F, at their thicker (or taller) portions 1050, the outlet contacts 1010 may each have a generally U-shaped or V-shaped cross-sectional shape.

Dielectric Comb

Figure 15:
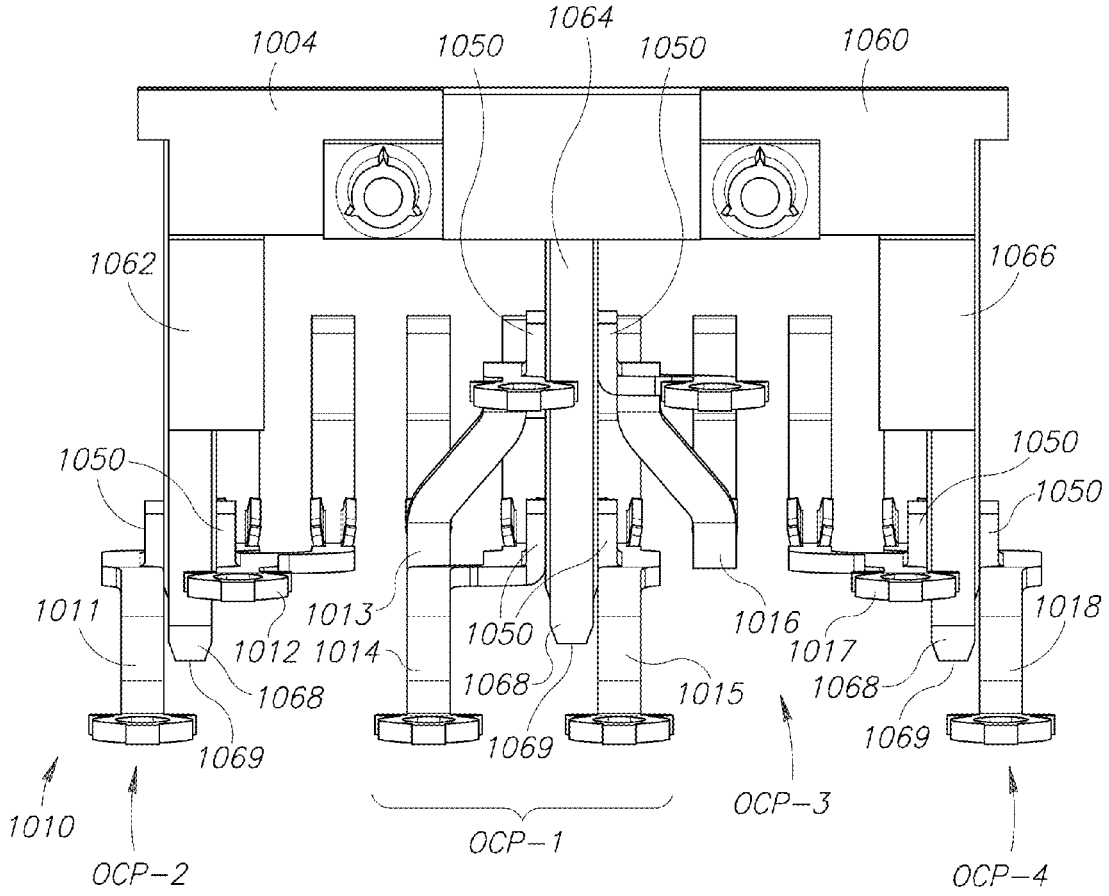
FIG. 15 is a first perspective view of the outlet contacts and a dielectric comb of the second embodiment of the subassembly.
Figure 16:
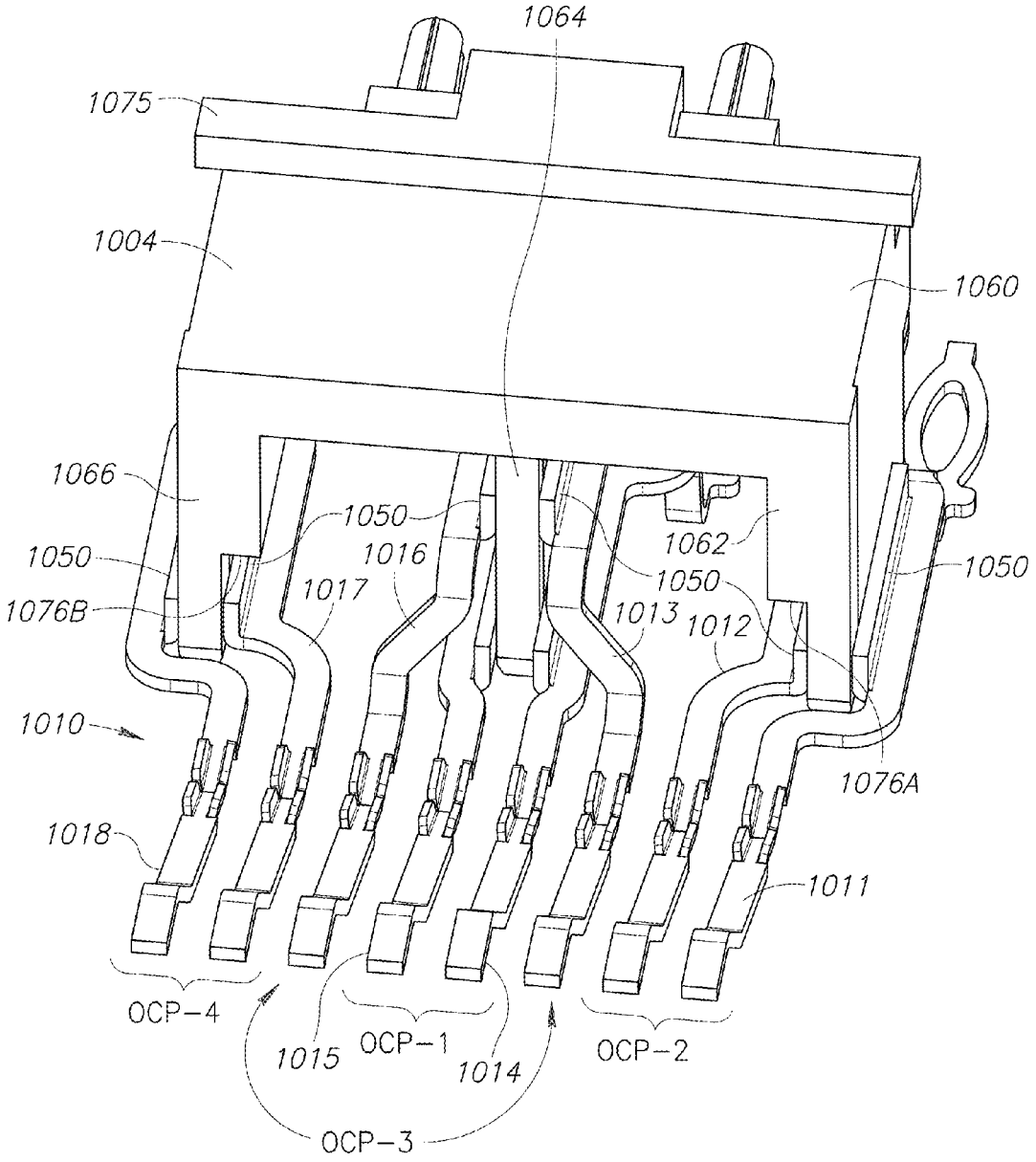
FIG. 16 is a second perspective view of the outlet contacts and the dielectric comb of the second embodiment of the subassembly.
Figure 17A:
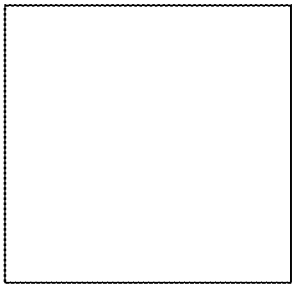
FIG. 17A is a first exemplary alternate cross-sectional shape that may be used to construct taller or thicker portions of the outlet contacts of the second embodiment of the subassembly.
Figure 17B:
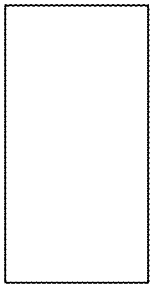
FIG. 17B is a second exemplary alternate cross-sectional shape that may be used to construct taller or thicker portions of the outlet contacts of the second embodiment of the subassembly.
Figure 17C:
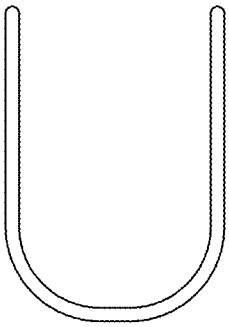
FIG. 17C is a third exemplary alternate cross-sectional shape that may be used to construct taller or thicker portions of the outlet contacts of the second embodiment of the subassembly.
Figure 17D:
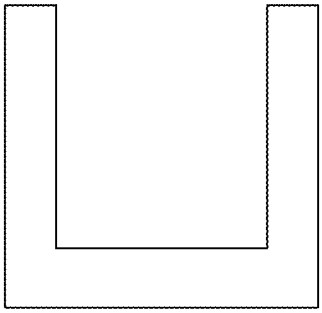
FIG. 17D is a fourth exemplary alternate cross-sectional shape that may be used to construct taller or thicker portions of the outlet contacts of the second embodiment of the subassembly.
Figure 17E:
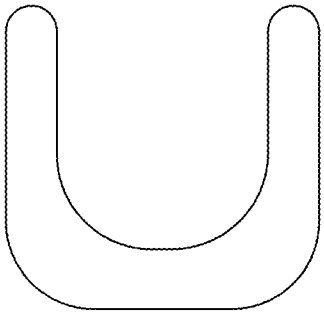
FIG. 17E is a fifth exemplary alternate cross-sectional shape that may be used to construct taller or thicker portions of the outlet contacts of the second embodiment of the subassembly.
Figure 17F:
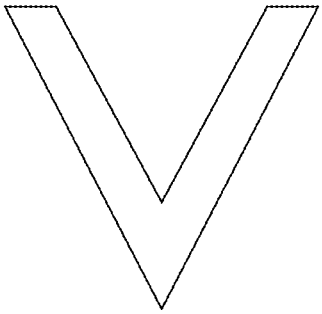
FIG. 17F is a sixth exemplary alternate cross-sectional shape that may be used to construct taller or thicker portions of the outlet contacts of the second embodiment of the subassembly.

Referring to FIGS. 15 and 16, the dielectric comb 1004 is configured to enhance electrical interaction, and allow the spacing between the outlet contact pairs OCP-1 to OCP-4 to be larger than it would otherwise need to be to achieve the same electrical characteristics. The dielectric comb 1004 may also help control the spacing between the outlet contacts of each of the outlet contact pairs OCP-1 to OCP-4. For example, the dielectric comb 1004 may be configured such that the outlet contacts of each of the outlet contact pairs OCP-1 to OCP-4 may be only about 0.5 millimeters or less apart. The dielectric comb 1004 may help increase impedance without requiring that the outlet contacts 1011-1018 be overly tall. In addition, the dielectric comb 1004 may help resist high potential ("Hi-Pot") over-voltage arcing.

Referring to FIG. 15, the dielectric comb 1004 has a body portion 1060 from which dielectric members 1062, 1064, and 1066 extend outwardly toward the outlet contacts 1010. The dielectric member 1062 extends between the fins 1050 of the outlet contacts 1011 and 1012 of the second outlet contact pair OCP-2. In the embodiment illustrated, the dielectric member 1062 extends from a first location at or near the substrate 1030 to a second location nearer the knuckle portions 1044 of the outlet contacts 1011 and 1012. Thus, the dielectric member 1062 extends along at least a portion of the current carrying portions of the outlet contacts 1011 and 1012. In the embodiment illustrated, the dielectric member 1062 extends along about one quarter of the length of the outlet contacts 1011 and 1012.

The dielectric member 1066 extends between the fins 1050 of the outlet contacts 1017 and 1018 of the fourth outlet contact pair OCP-4. In the embodiment illustrated, the dielectric member 1066 extends from a first location at or near the substrate 1030 to a second location nearer the knuckle portions 1044 of the outlet contacts 1017 and 1018. Thus, the dielectric member 1066 extends along at least a portion of the current carrying portions of the outlet contacts 1017 and 1018. In the embodiment illustrated, the dielectric member 1066 extends along about one quarter of the length of the outlet contacts 1017 and 1018.

The dielectric member 1064 extends between the fins 1050 of the outlet contacts 1013 and 1016 of the third outlet contact pair OCP-3. The dielectric member 1064 also extends between the fins 1050 of the outlet contacts 1014 and 1015 of the first outlet contact pair OCP-1. In the embodiment illustrated, the dielectric member 1064 extends from a first location at or near the substrate 1030 to a second location nearer the knuckle portions 1044 of the outlet contacts 1013-1016. Thus, the dielectric member 1064 extends along at least a portion of the current carrying portions of the outlet contacts 1013-1016. In the embodiment illustrated, the dielectric member 1064 extends along about one quarter of the length of the outlet contacts 1013-1016. The dielectric members 1062 and 1066 may extend further along the outlet contacts 1010 than the dielectric member 1064. However, this is not a requirement.

The dielectric comb 1004 may help achieve the desired impedance, without increasing unwanted crosstalk. As explained above, the outlet contacts 1010 and the dielectric members 1062, 1064, and 1066 of the dielectric comb 1004 are interleaved such that dielectric material is positioned between the outlet contacts of each of the outlet contact pairs OCP-1 to OCP-4. This enhances the inductive and/or capacitive coupling between the outlet contacts of the outlet contact pairs OCP-1 to OCP-4 where such coupling is desired, but does not enhance coupling between different outlet contact pairs. For example, the dielectric members 1062, 1064, and 1066 may increase the dielectric constant between the outlet contacts of each of the outlet contact pairs OCP-1 to OCP-4. This may provide improved high voltage protection.

As explained above, the dielectric members 1062, 1064, and 1066 help determine a minimum spacing between the outlet contacts of the outlet contact pairs OCP-1 to OCP-4. By way of a non-limiting example, the dielectric members 1062, 1064, and 1066 may have a thickness of about 0.5 millimeters or less.

In the embodiment illustrated, each of the dielectric members 1062, 1064, and 1066 is generally planar. Each of the dielectric members 1062, 1064, and 1066 has a distal free end portion 1068 with a lower edge 1069. Referring to FIG. 9, the lower edge 1069 extends toward the substrate 1030 alongside the outlet contacts 1010 and may be tapered downwardly toward the substrate 1030. Referring to FIG. 11, the dielectric member 1064 may have a tapered rear edge 1070 that tapers outwardly from the distal free end portion 1068 of the dielectric member 1064 toward the body portion 1060.

Referring to FIG. 11, one or more spacing portions 1072 may extend from the body portion 1060 toward the substrate 1030. Each of the spacing portions 1072 may be configured to abut the substrate 1030 to space the dielectric members 1062, 1064, and 1066 away from the substrate 1030.

In addition to helping to limit the required thickness of the outlet contacts 1010, the dielectric comb 1004 also serves to physically hold the outlet contacts 1010 in position horizontally with respect to one another. The outlet contacts 1010 may rub against the dielectric comb 1004. However, force from the plug 100 (see FIGS. 2, 4, and 7) positioned immediately in front of the dielectric comb 1004 and/or the optional spring assembly 350 will overcome any friction between the outlet contacts 1010 and the dielectric comb 1004 and push the outlet contacts 1010 back into their proper positions.

Referring to FIG. 10, one or more projections or mounting pegs 1074A and 10746 extend outwardly from the body portion 1060 of the dielectric comb 1004 toward the substrate 1030. The body portion 1060 of the dielectric comb 1004 is positioned between the spring assembly 350 and the outlet contacts 1010. Optionally, the body portion 1060 may abut the spring assembly 350. However, as may be viewed in FIG. 15, the body portion 1060 is spaced from the outlet contacts 1010 so that they may move (or deflect) with respect to the body portion 1060. In the embodiment illustrated in FIG. 16, the body portion 1060 has an optional upwardly projecting portion 1075 configured to abut the spring assembly 350. However, this is not a requirement.

All of the outlet contacts 1010 bend upwardly toward the body portion 1060 of the dielectric comb 1004 when the plug 100 (see FIGS. 2, 4, and 7) is inserted into an outlet (e.g., the outlet 120 illustrated in FIGS. 2 and 5, the outlet 170 illustrated in FIG. 7, and/or other outlets constructed to comply with the RJ-45 standard) including the subassembly 1002 (see FIGS. 8-11). The outlet contacts 1010 are somewhat springy, and push against the plug 100 for a reliable electrical connection. However, a RJ-11 type plug (not shown), commonly referred to as a telephone plug, has a slightly different size. If a RJ-11 type plug is plugged into an outlet (e.g., the outlet 120 illustrated in FIGS. 2 and 5, the outlet 170 illustrated in FIG. 7, and/or other outlets constructed to comply with the RJ-45 standard) including the subassembly 1002 (see FIGS. 8-11), the outermost outlet contacts 1011 and 1018 deflect upwardly more than twice the normal amount. The dielectric comb 1004 may be configured to allow the outermost outlet contacts 1011 and 1018 to deflect in this manner without encountering a physical limitation or obstruction. For example, as shown in FIG. 16, the outlet contacts 1011 and 1018 are positioned outside the dielectric comb 1004 and can deflect upwardly without encountering the body portion 1060.

The dielectric comb 1004 may be constructed from plastic (e.g., Ultem, Polycarbonate, acrylonitrile butadiene styrene ("ABS") with a relative dielectric constant of about 2.0 to about 3.15. or the like) for ease of adding mounting features and minimizing friction. The dielectric comb 1004 may be constructed from high dielectric constant materials, such as alumina (with a relative dielectric constant of about 9.6 to about 10.0) to allow the outlet contacts 1010 to be shorter or further apart.

Referring to FIGS. 10 and 11, the dielectric comb 1004 may be inserted and mounted to the substrate 1030 after the outlet contacts 1010 have been soldered to the substrate 1030. However, through application of ordinary skill in the art to the present teachings, other configurations of the dielectric comb 1004 may be constructed for use with other outlet architectures. For example, the dielectric comb 1004 may be interleaved with the outlet contacts 1011-1018 from below (as opposed to being interleaved from above as shown in FIGS. 9, 15, and 16). By way of another non-limiting example, dielectric members (not shown) of the dielectric comb 1004 could be inserted between adjacent ones of the outlet contact pairs OCP-1 to OCP-4. In such embodiments, the dielectric members may be shorter and thinner than the dielectric members 1062, 1064, and 1066.

By way of yet another non-limiting example, the dielectric comb 1004 may be unattached from the substrate 1030. In such embodiments, the dielectric comb 1004 may be characterized as "floating." Floating embodiments of the dielectric comb 1004 may have shorter (and potentially thinner) dielectric members than non-floating embodiments. Because the floating dielectric comb floats, it follows the outlet contacts 1010 even when they are deflected greatly.

In alternate embodiments, the dielectric comb 1004 and the spring assembly 350 (see FIGS. 8-11) may be combined into a single component (not shown).

Compensation Circuit

Referring to FIG. 9, the compensation circuit 1020 is substantially planar and positioned between the knuckle portions 1044 (see FIG. 12) and the first end portions 1040 (see FIG. 12) of the outlet contacts 1010. Thus, the compensation circuit 1020 is positioned along the current carrying portion of at least a portion of the outlet contacts 1010.

Figure 18:
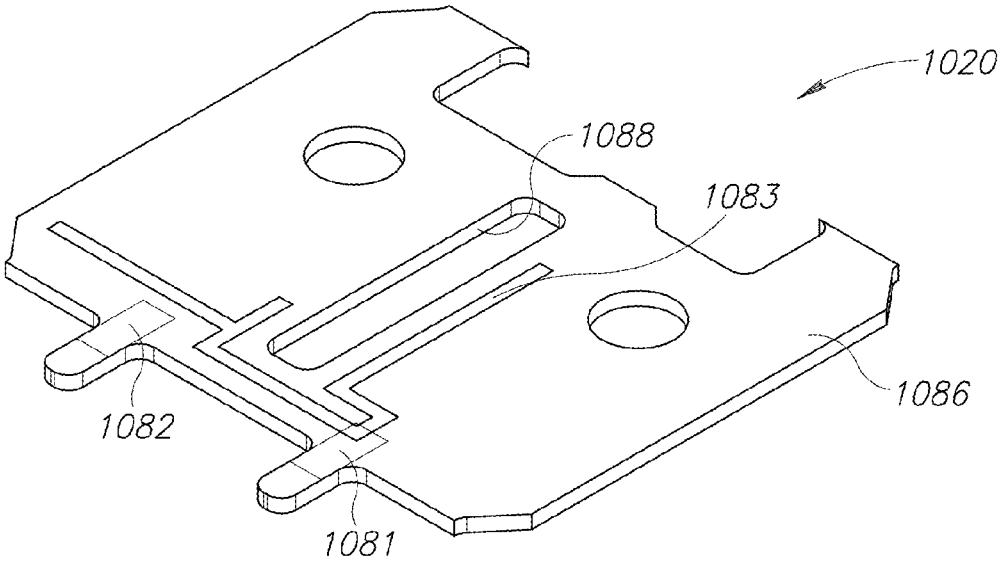
FIG. 18 is a first perspective view of a compensation circuit of the second embodiment of the subassembly showing first conductors.
Figure 19:
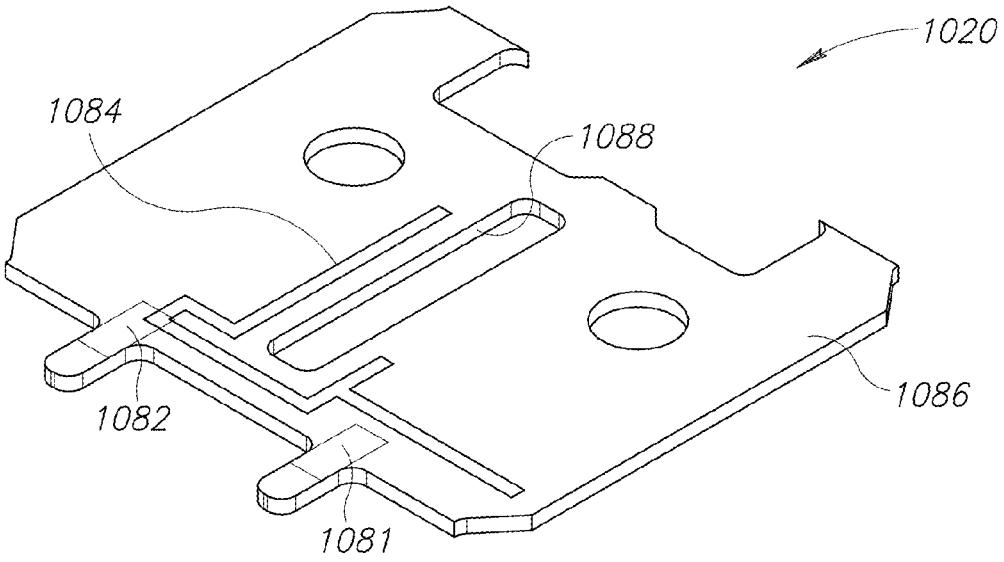
FIG. 19 is a second perspective view of the compensation circuit of the second embodiment of the subassembly showing second conductors.

Referring to FIGS. 18 and 19, the compensation circuit 1020 includes a first contact pad 1081 electrically connected (e.g., soldered) to the outlet contact 1013 (see FIG. 9) and a second contact pad 1082 electrically connected (e.g., soldered) to the outlet contact 1016 (see FIG. 9). The compensation circuit 1020 is configured to provide crosstalk compensation for the third outlet contact pair OCP-3 (see FIGS. 14-16). In the embodiment illustrated, the first and second contact pads 1081 and 1082 are connected to the outlet contacts 1013 and 1016 (see FIG. 9), respectively, between their knuckle portions 1044 (see FIG. 12) and their fins 1050 (see FIG. 12).

Referring to FIG. 18, the compensation circuit 1020 includes one or more first conductors 1083 (e.g., traces) connected to the first contact pad 1081. The first conductors 1083 extend alongside the outlet contacts 1014 and 1015 of the first outlet contact pair OCP-1 (see FIGS. 14-16), and near the outlet contact 1017 of the fourth outlet contact pair OCP-4 (see FIGS. 13-16).

Referring to FIG. 19, the compensation circuit 1020 includes one or more second conductors 1084 (e.g., traces) connected to the second contact pad 1082. The second conductors 1084 extend alongside the outlet contacts 1014 and 1015 of the first outlet contact pair OCP-1 (see FIGS. 13, 15, and 16), and near the outlet contact 1012 of the second outlet contact pair OCP-2 (see FIGS. 13-16). Referring to FIGS. 18 and 19, as is apparent to those of ordinary skill in the art, the first and second conductors 1083 and 1084 are physically disconnected from one another.

In the embodiments illustrated, the compensation circuit 1020 is patterned on a flexible substrate 1086 to form a "flex circuit." This flex circuit may be mechanically much simpler (and slightly smaller) than traditional outlet compensation circuits. As is apparent to those of ordinary skill in the art, the first and second conductors 1083 and 1084 may be positioned on different layers of the flexible substrate 1086.

Referring to FIG. 9, the compensation circuit 1020 is configured to fit in between the dielectric members 1062 and 1066 of the dielectric comb 1004. Referring to FIGS. 18 and 19, the flexible substrate 1086 includes a through-hole or slot 1088 configured to allow the dielectric member 1064 (see FIG. 9) of the dielectric comb 1004 to pass therethrough. Thus, the compensation circuit 1020 may be configured to be self-aligning with respect to the outlet contacts 1011-1018.

The second free end portions 1042 (see FIG. 12) of the outlet contacts 1010 experience the most deflection when the plug 100 (see FIGS. 2, 4, and 7) is inserted into an outlet (e.g., the outlet 120 illustrated in FIGS. 2 and 5, the outlet 170 illustrated in FIG. 7, and/or other outlets constructed to comply with the RJ-45 standard) that includes the outlet contacts 1010. However, the plug contacts P1-P8 (see FIG. 4) press on the outlet contacts 1010 at a location near the knuckle portions 1044 (see FIGS. 12-14), which is where the spring assembly 350 presses on the outlet contacts 1010. The plug contacts P1-P8 (see FIG. 4) and the spring assembly 350 press on the outlet contacts 1010 in opposite directions. Thus, the spring assembly 350 helps provide contact force in that area. The flexible substrate 1086 is attached to the outlet contacts 1013 and 1016 at location behind where the plug contacts P1-P8 (see FIG. 4) contact the outlet contacts 1010 to improve and/or optimize compensation performance. The flexible substrate 1086 does not experience significant deflection because the flexible substrate 1086 is attached to the outlet contacts 1013 and 1016 at location near where the spring assembly 350 presses on the outlet contacts 1010 to limit deflection.

Substrate

Referring to FIGS. 10 and 11, the substrate 1030 has a first forwardly facing side 1100 opposite a second rearwardly facing side 1102. The substrate 1030 includes apertures 1104A and 11048 substantially identical to the apertures 522A and 522B (see FIG. 6), respectively, and apertures 1106A and 11068 substantially identical to the apertures 552A and 552B (see FIG. 6), respectively. Referring to FIG. 10, the substrate 1030 may include apertures 1108A and 11088 configured to receive the mounting pegs 1074A and 10748, respectively, of the dielectric comb 1004. The apertures 1104A, 11048, 1106A, 11068, 1108A, and 11088 are formed in the forwardly facing side 1100. In the embodiment illustrated, the apertures 1104A, 11048, 1106A, 11068, 1108A, and 11088 have been implemented as through-holes. However, this is not a requirement.

Figure 20:
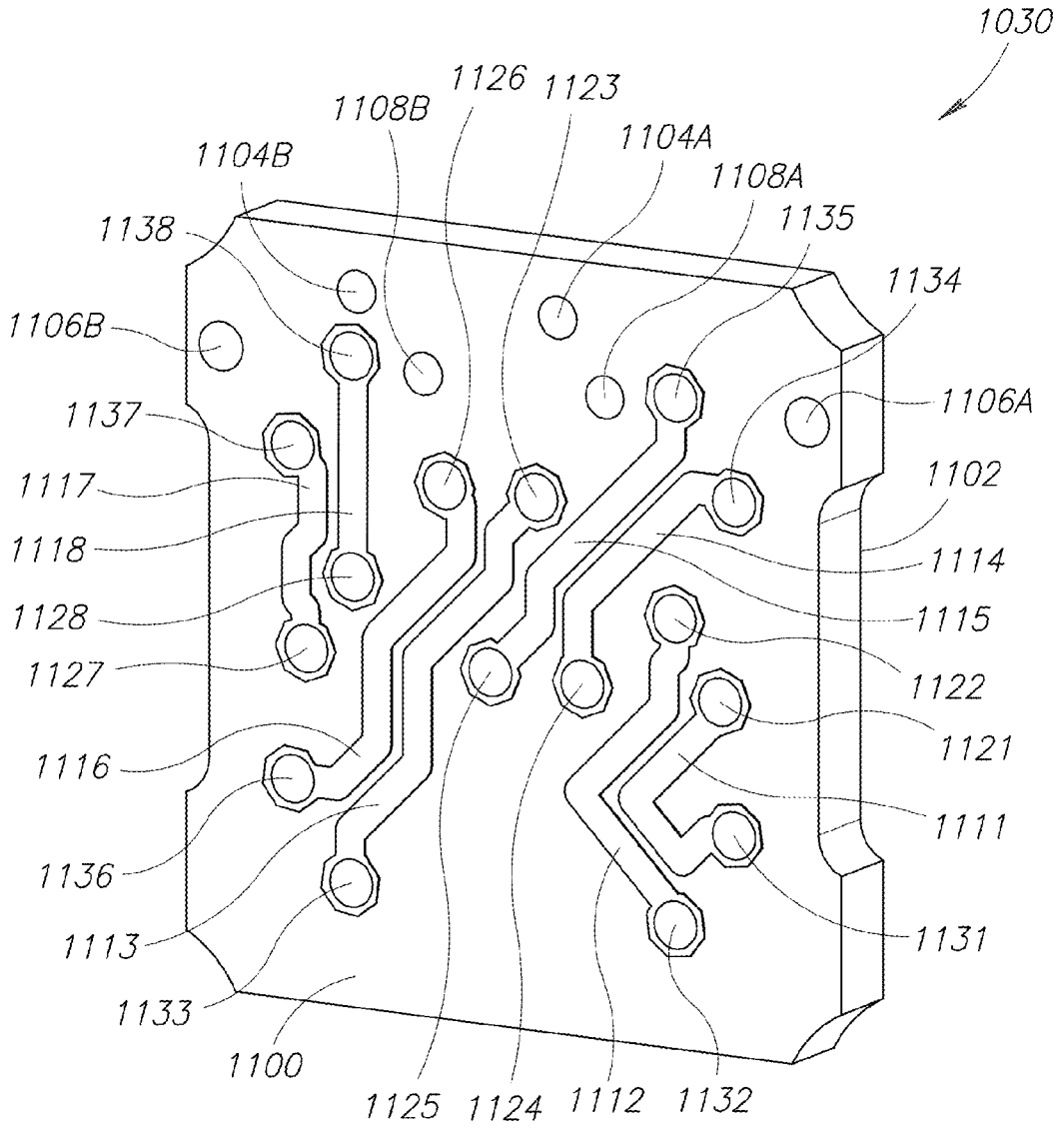
FIG. 20 is a perspective view of a substrate of the second embodiment of the subassembly.

As mentioned above, each of the outlet contact pairs OCP-1 to OCP-4 may be transmission-optimized from their second free end portions 1042 all the way back to the substrate 1030. Referring to FIG. 20, the substrate 1030 includes at least one conductor (e.g., trace) connecting the outlet contacts 1011-1018 to the wire contacts 361-368 (see FIG. 10), respectively. In the example illustrated in FIG. 20, traces 1111-1118 connect the outlet contacts 1011-1018 (see FIGS. 12, 15, and 16), respectively, to the wire contacts 361-368 (see FIG. 10), respectively. Thus, in this embodiment, the traces 1114 and 1115 form a first trace pair, the traces 1111 and 1112 form a second trace pair, the traces 1113 and 1116 form a third trace pair, and the traces 1117 and 1118 form a fourth trace pair. Each of the trace pairs may be transmission-optimized with carefully controlled impedance all the way from the outlet contacts 1010 to the wire contacts 360. The traces 1111-1118 may be formed on one or both of the first and second side 1100 and 1102 of the substrate 1030.

The substrate 1030 includes apertures 1121-1128 (e.g., plated through-holes) configured to receive the first end portions 1040 of the outlet contacts 1011-1018 (see FIGS. 12, 15, and 16), respectively, and electrically connect the outlet contacts 1011-1018 to the traces 1111-1118, respectively. The apertures 1121-1128 may be spaced apart from one another by substantially more than similar openings are spaced apart in a conventional RJ-type outlet. Such relatively wide spacing allows compensation circuitry to be placed in between at least some of the apertures 1121-1128.

For example, capacitive compensation circuitry may be placed between the apertures 1123 and 1125 and between the apertures 1124-1126.

The substrate 1030 also includes apertures 1131-1138 (e.g., plated through-holes) configured to receive each of the wire contacts 361-368 (see FIG. 10), respectively, and electrically connect the wire contacts 361-368 to the traces 1111-1118, respectively.

In the embodiment illustrated, the first end portions 1040 of the outlet contacts 1011-1018 may be pressed into the apertures 1121-1128, respectively, from the first forwardly facing side 1100 of the substrate 1030 and the wire contacts 361-368 may be pressed into the apertures 1131-1138, respectively, in the substrate 1030 from the second rearwardly facing side 1102 of the substrate 1030. Thus, as shown in FIGS. 8 and 9, the outlet contacts 1011-1018 and the wire contacts 361-368 extend away from the substrate 1030 in opposite directions. The outlet contacts 1011-1018 may be subsequently soldered into place, if desired.

Spring Assembly

The optional spring assembly 350 helps position the outlet contacts 1011-1018 to contact the plug contacts P1-P8 (see FIG. 4), respectively, when the plug 100 (see FIG. 4) is inserted into the outlet 120. While described as being an assembly, the spring assembly 350 may be implemented as a single unitary body. Exemplary suitable structures for implementing the optional spring assembly 350 are described in U.S. Pat. Nos. 6,641,443, 6,786,776, 7,857,667, and 8,425,255. Further, Leviton Manufacturing Co., Inc. manufactures and sells communication outlets incorporating Retention Force Technology ("RFT") suitable for implementing the spring assembly 350.

The spring assembly 350 biases the outlet contacts 1011-1018 against the contact positioning member 352. In the embodiment illustrated, the spring assembly 350 is configured to at least partially nest inside the contact positioning member 352. However, this is not a requirement. The spring assembly 350 may be constructed from a dielectric or non-conductive material (e.g., plastic).

The spring assembly 350 may be mounted to the substrate 1030 in a position adjacent the outlet contacts 1011-1018. In the embodiment illustrated, the spring assembly 350 has a pair of protrusions 520A and 520B configured to be inserted into apertures 1104A and 11048, respectively, of the substrate 1030.

Contact Positioning Member

Referring to FIGS. 10 and 11, the contact positioning member 352 may be mounted to the substrate 1030 in a position adjacent the outlet contacts 1011-1018 and the spring assembly 350. In the embodiment illustrated, the contact positioning member 352 has a pair of protrusions 550A and 550B configured to be inserted into the apertures 1106A and 11068, respectively, respectively, in the substrate 1030.

Referring to FIG. 6, in the embodiment illustrated, the contact positioning member 352 includes a front portion 580 with a transverse member 560. The transverse member 560 includes a plurality of upwardly extending dividers Dl-D7 configured to fit between adjacent ones of the outlet contacts 1011-1018 (see FIGS. 10 and 11) and help maintain the lateral positioning and/or spacing of the outlet contacts 1011-1018 and their electrical isolation from one another. Referring to FIGS. 10 and 11, the spring assembly 350 biases the outlet contacts 1011-1018 against the transverse member 560 (see FIG. 6) of the contact positioning member 352.

The contact positioning member 352 is constructed from a dielectric or non-conductive material (e.g., plastic).

Wire Contacts

As may be viewed in FIG. 10, the wire contacts 360 may include the eight wire contacts 361-368. As mentioned above, the wire contacts 361-368 are connected to the outlet contacts 1011-1018 (see FIG. 12), respectively, by the traces (not shown) formed on one or both of the first and second sides 1100 and 1102 of the substrate 1030. Thus, the wire contacts 361-368 may be characterized as corresponding to the outlet contacts 1011-1018, respectively. Similarly, the wire contacts 361-368 may be characterized as corresponding to the wires JW1-JW8 (see FIG. 2), respectively, of the cable C1 (see FIG. 2). Each of the wire contacts 361-368 may be implemented as an insulation displacement connector ("IDC"). However, this is not a requirement. In the embodiment illustrated, the wire contacts 361-368 are positioned on the substrate 1030 in a generally circular or rhombus shaped arrangement. Thus, not all of the wire contacts 361-368 are parallel with one another.

In the embodiment illustrated, the wire contacts 361-368 are implemented as IDCs configured to cut through the insulation 144 (see FIG. 3) of the wires JW1-JW8 (see FIG. 2), respectively, to form an electrical connection with the conductor 142 (see FIG. 3) of the wires JW1-JW8, respectively. As is apparent to those of ordinary skill in the art, the wires JW1-JW8 must be properly aligned with the IDCs for the IDCs to cut through the insulation 144.

Alternate Embodiment

Referring to FIGS. 21-24, in alternate embodiments, the outlet 120 (see FIGS. 2 and 5), the outlet 170 (see FIG. 7), and/or other outlets constructed to comply with the RJ-45 standard may include a subassembly 1300 instead of and in place of the subassembly 1002 (see FIGS. 8-11) or the subassembly 358 (see FIGS. 5 and 6). For ease of illustration, like reference numerals have been used in the drawings to identify like components.

Figure 22:
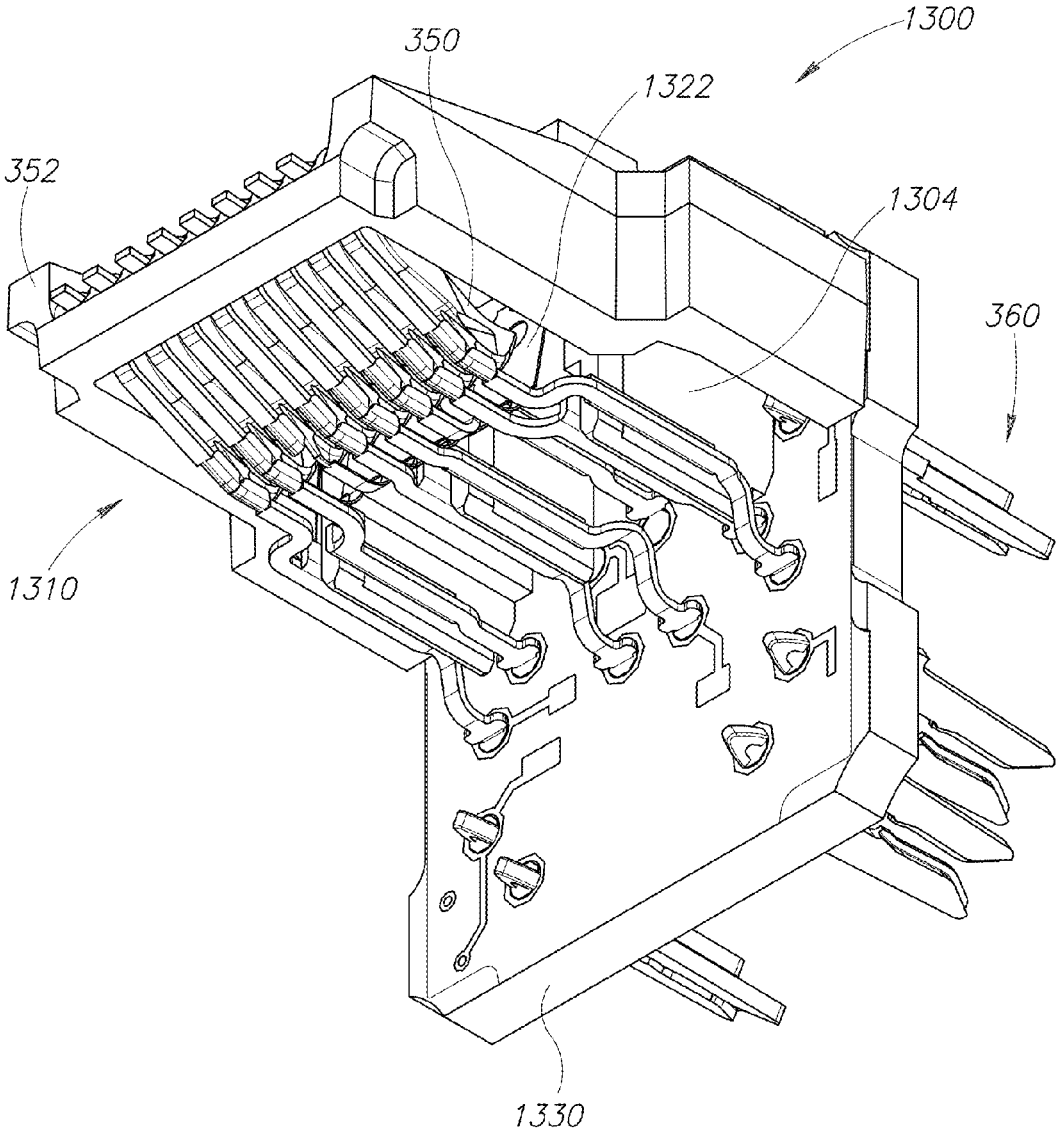
FIG. 22 is a second perspective view of the third embodiment of the subassembly.
Figure 23:
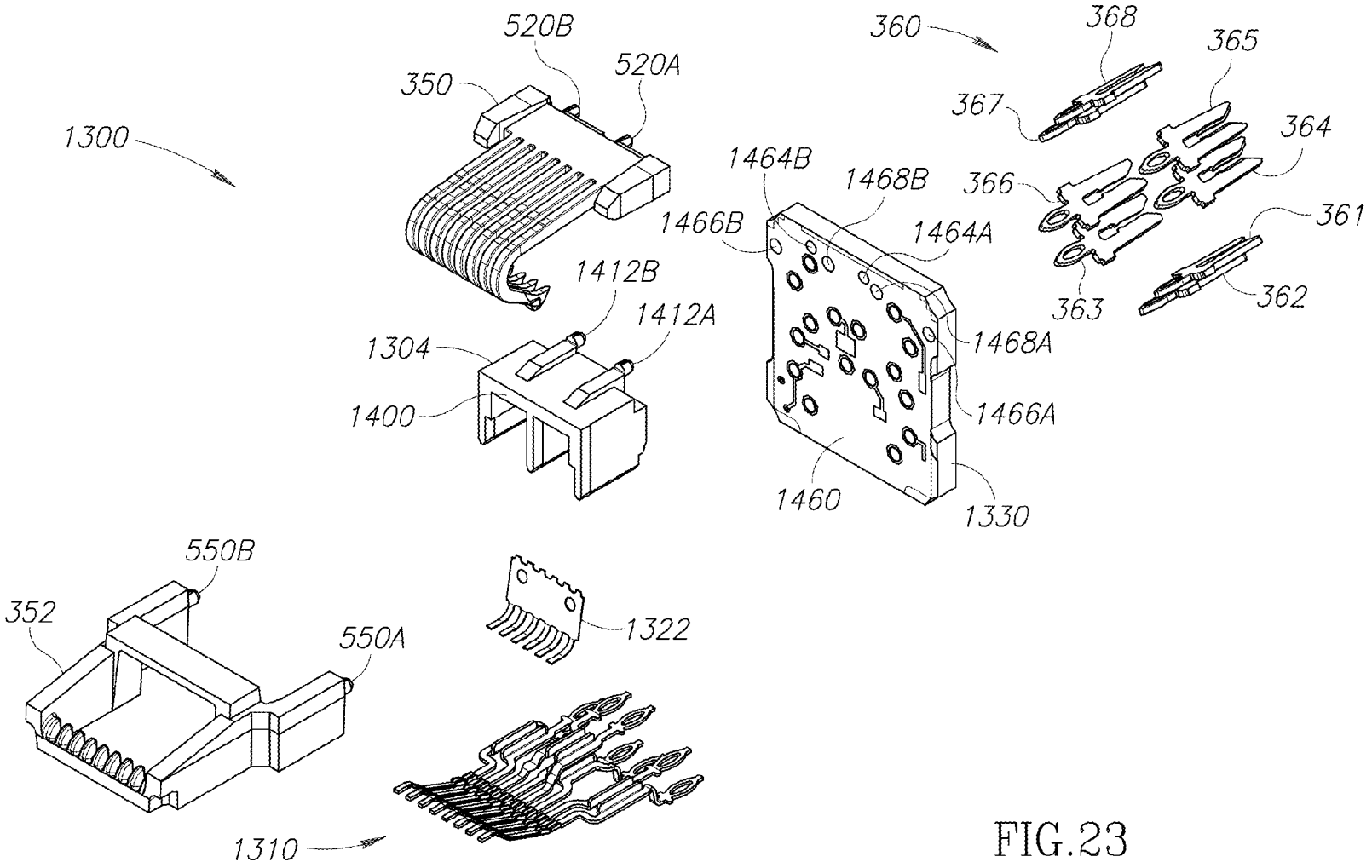
FIG. 23 is a first exploded perspective view of the third embodiment of the subassembly.
Figure 24:
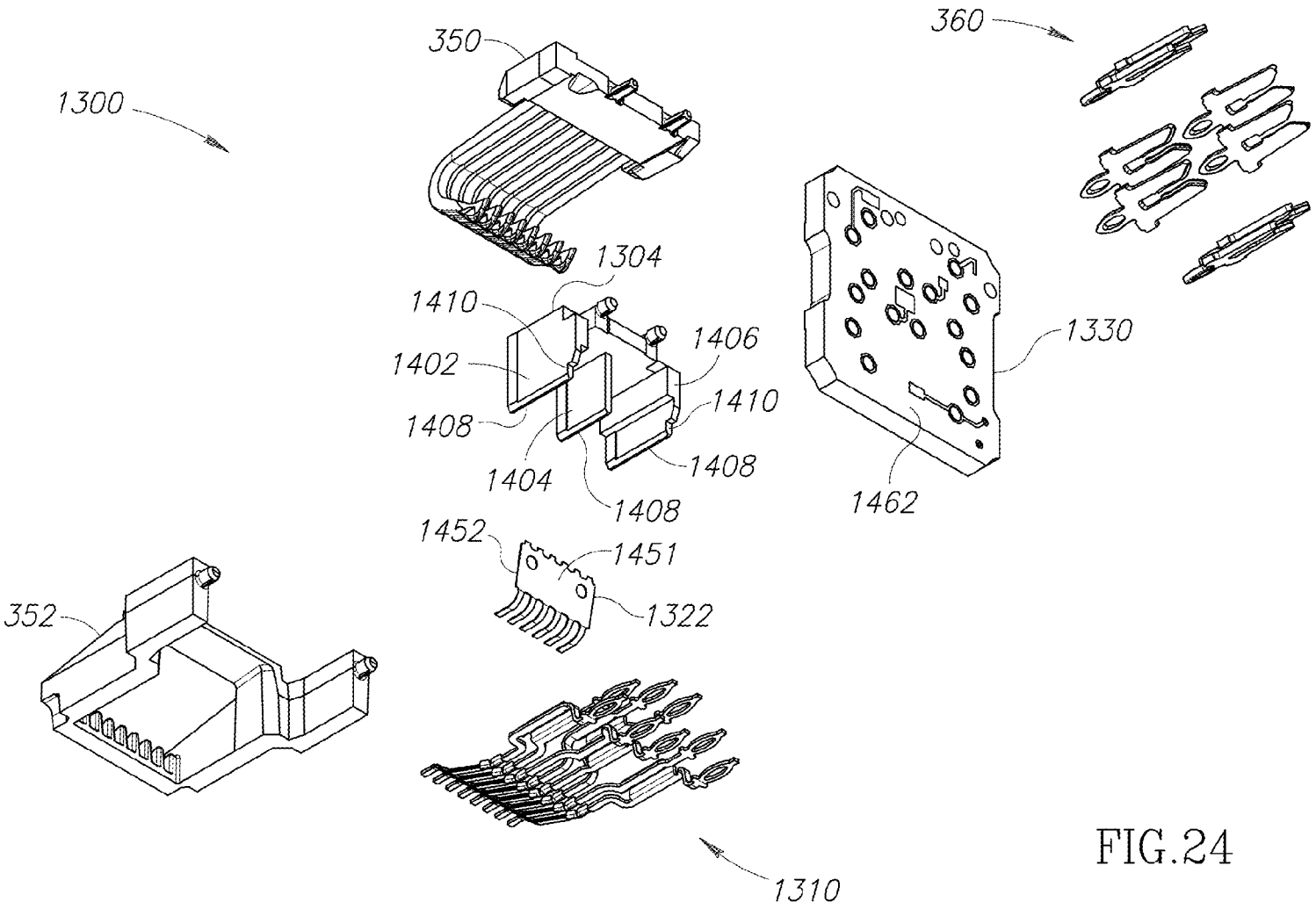
FIG. 24 is a second exploded perspective view of the third embodiment of the subassembly.

Referring to FIGS. 22-24, the subassembly 1300 includes a dielectric comb 1304, a plurality of outlet contacts 1310, a compensation circuit 1322, the optional spring assembly 350, the contact positioning member 352, a substrate 1330, and the wire contacts 360.

Outlet Contacts

Figure 25:
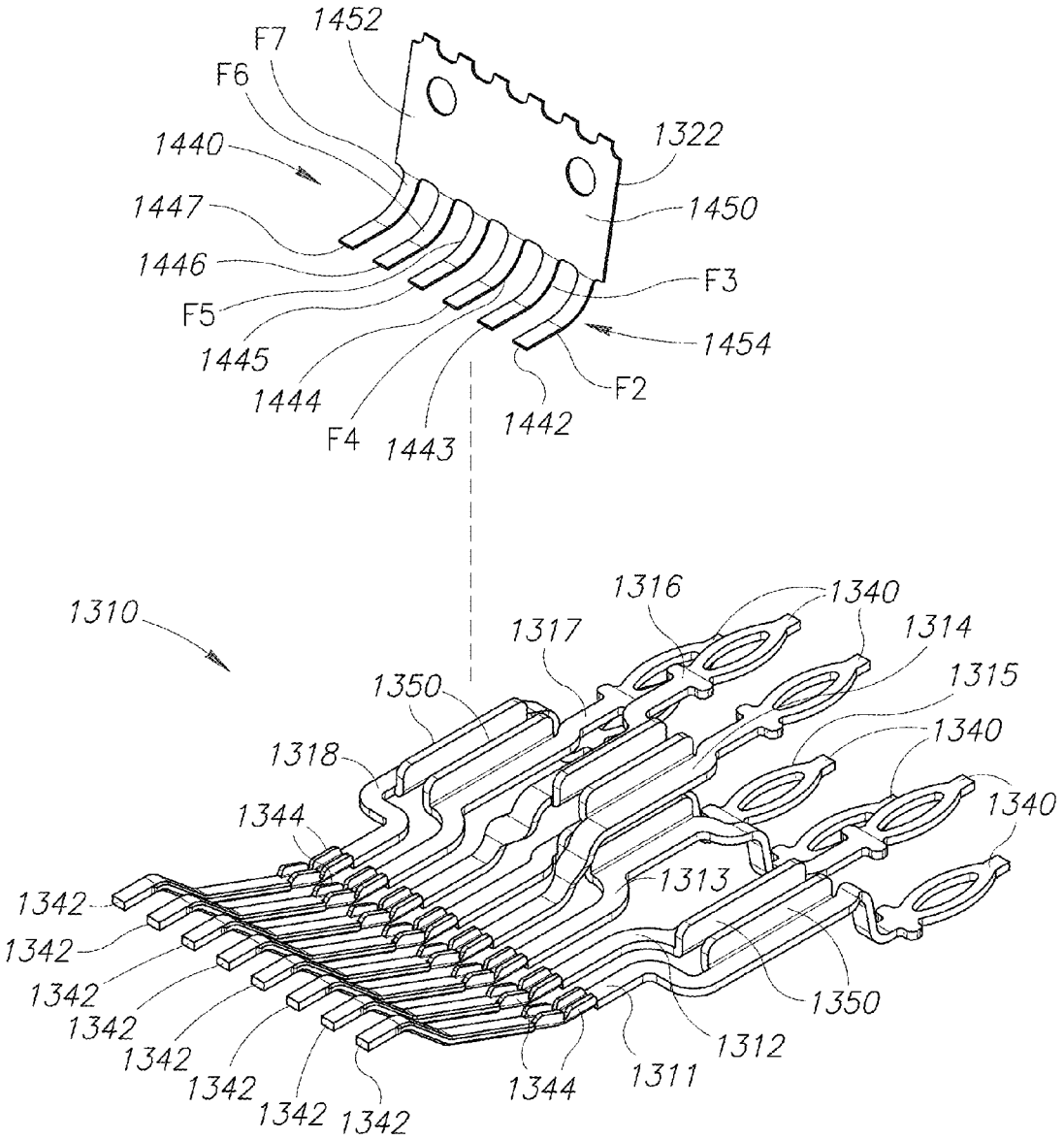
FIG. 25 is an exploded perspective view of a plurality of outlet contacts, and a compensation circuit of the third embodiment of the subassembly.

Referring to FIG. 25, one difference between the outlet contacts 1310 and the outlet contacts 1010 (see FIGS. 8-16) is that the outlet contacts 1310 are configured to provide crossover-type crosstalk compensation. In the embodiment illustrated, the outlet contacts 1310 include the eight individual outlet contacts 1311-1318 that correspond to the eight plug contacts P1-P8 (see FIG. 4), respectively. However, through application of ordinary skill in the art to the present teachings, embodiments including different numbers of outlet contacts (e.g., 4, 6, 10, 12, 16, etc.) may be constructed for use with plugs having different numbers of plug contacts.

Each of the outlet contacts 1311-1318 has a first end portion 1340 configured to be connected to the substrate 1330 (see FIGS. 21-24), and a second free end portion 1342 opposite the first end portion 1340. The second free end portions 1342 are arranged to contact the plug contacts P1-P8 (see FIG. 4), respectively, of the plug 100 (see FIG. 4) when the plug is inserted into an outlet (e.g., the outlet 120 illustrated in FIGS. 2 and 5, the outlet 170 illustrated in FIG. 7, and/or other outlets constructed to comply with the RJ-45 standard) including the subassembly 1300 (see FIGS. 21-24).

Each of the outlet contacts 1311-1318 has a knuckle portion 1344 (substantially similar to the knuckle portion 1044 depicted in FIG. 12-14) between the first end portion 1340 and the second free end portion 1342. The spring assembly 350 (see FIGS. 21-24) presses on the knuckle portions 1344 of the outlet contacts 1310. The plug contacts P1-P8 (see FIG. 4) contact the outlet contacts 1311-1318, respectively, at or near their knuckle portions 1344. Thus, a portion of each of the outlet contacts 1311-1318 between the second free end portion 1342 and the knuckle portion 1344 may be characterized as being a non-current carrying portion. Similarly, a portion of each of the outlet contacts 1311-1318 between the knuckle portion 1344 and the first end portion 1340 may be characterized as being a current carrying portion.

Like the outlet contacts 1010 (see FIGS. 8-16), each of the outlet contacts 1310 has at least one thicker (or taller) portion 1350 (referred to hereafter as a fin 1350) substantially similar to the fins 1050. At their fins 1350, each of the outlet contacts 1310 has a generally L-shaped cross-sectional shape. However, at their thicker (or taller) portions 1350, the outlet contacts 1310 may have other shapes. For example, FIGS. 17A-17F depict alternate cross-sectional shapes that may be used to construct the taller or thicker portions 1350 of the outlet contacts 1310.

By way of a non-limiting example, the outlet contacts 1310 may be formed from a sheet material (e.g., sheet metal) having a uniform thickness of about 0.20 millimeters. As will be described below, the fins 1350 may be formed by bending a portion of the sheet material upwardly. Thus, the fins 1350 are taller than other portions of the outlet contacts 1310. For example, at the fins 1350, the outlet contacts 1310 may each have a height of about 0.75 millimeters.

Like the outlet contacts 1011-1018, the outlet contacts 1311-1318 may be described as being organized into differential signaling (or transmission) pairs. A first outlet contact pair includes the outlet contacts 1314 and 1315. A second outlet contact pair includes the outlet contacts 1311 and 1312. A third outlet contact pair includes the outlet contacts 1313 and 1316. A fourth outlet contact pair includes the outlet contacts 1317 and 1318.

Figure 26:
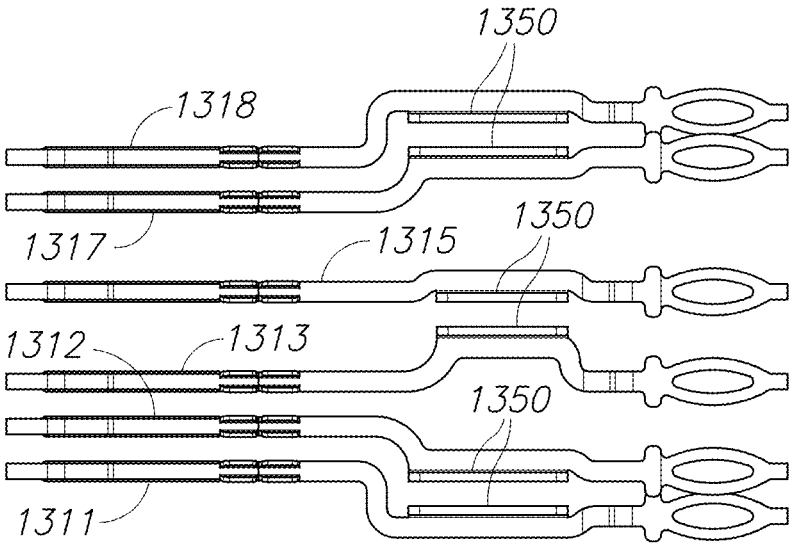
FIG. 26 is a top view of a first portion of the outlet contacts of FIG. 25.
Figure 27:
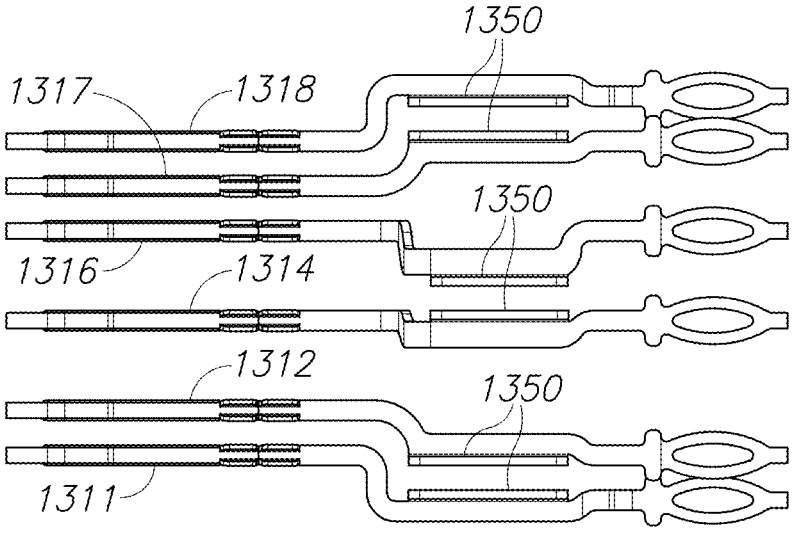
FIG. 27 is a top view of a second portion of the outlet contacts of FIG. 25.

Referring to FIGS. 26 and 27, the outlet contacts 1311 and 1312 (of the second outlet contact pair) are configured to position the fin 1350 of the outlet contact 1311 alongside the fin 1350 of the outlet contact 1312. The fin 1350 of the outlet contact 1311 is spaced apart from and does not touch the fin 1350 of the outlet contact 1312 to inductively and/or capacitively couple the outlet contacts 1311 and 1312 of the second outlet contact pair together.

The outlet contacts 1317 and 1318 (of the fourth outlet contact pair) are configured to position the fin 1350 of the outlet contact 1317 alongside the fin 1350 of the outlet contact 1318. The fin 1350 of the outlet contact 1317 is spaced apart from and does not touch the fin 1350 of the outlet contact 1318 to inductively and/or capacitively couple the outlet contacts 1317 and 1318 of the fourth outlet contact pair together.

Referring to FIG. 26, the outlet contacts 1313 and 1315 (of two different outlet contact pairs) are configured to position the fin 1350 of the outlet contact 1313 alongside the fin 1350 of the outlet contact 1315. The fin 1350 of the outlet contact 1313 is spaced apart from and does not touch the fin 1350 of the outlet contact 1315 to inductively and/or capacitively couple the outlet contacts 1313 and 1315 together. This coupling helps provide crossover-type crosstalk compensation.

Referring to FIG. 27, the outlet contacts 1314 and 1316 (of two different outlet contact pairs) are configured to position the fin 1350 of the outlet contact 1314 alongside the fin 1350 of the outlet contact 1316. The fin 1350 of the outlet contact 1314 is spaced apart from and does not touch the fin 1350 of the outlet contact 1316 to inductively and/or capacitively couple the outlet contacts 1314 and 1316 together. This coupling helps provide crossover-type crosstalk compensation.

In the embodiment illustrated, the fins 1350 of the first, second, third, and fourth outlet contact pairs are aligned along the same vertical plane. Further, the fins 1350 of the outlet contacts of the first and fourth outlet contact pairs are aligned along the same horizontal plane. However, the fins 1350 of the outlet contacts 1314 and 1316 are position above the fins 1350 of the outlet contacts 1313 and 1315, respectively.

The impedance of each of the outlet contact pairs may be configured for high-speed transmission (e.g., 40 Gb/s, Category 8 Ethernet). The inductive and/or capacitive coupling described above between selected ones of the outlet contacts 1311-1318 helps reduce crosstalk within an outlet (e.g., the outlet 120 illustrated in FIGS. 2 and 5, the outlet 170 illustrated in FIG. 7, and/or other outlets constructed to comply with the RJ-45 standard) that includes the subassembly 1300 (see FIGS. 21-24). Further, at least some of the outlet contact pairs are spaced farther apart from one another than in a conventional RJ-45 type connector. In contrast to other high speed connectors (e.g. ARJ connectors, and RJ-45 type connectors), an outlet (e.g., the outlet 120 illustrated in FIGS. 2 and 5, the outlet 170 illustrated in FIG. 7, and/or other outlets constructed to comply with the RJ-45 standard) that includes the subassembly 1300 (see FIGS. 21-24), spacing (or distance) between the outlet contact pairs is used to reduce and/or eliminate pair-to-pair crosstalk that occurs in many prior art connectors.

The outlet contacts 1310 may be positioned too close together to be formed from a single piece of sheet metal using a progressive die configured to stamp and form conventional outlet contacts with precision punches. Further, splitting them into two sets may not be enough to solve the spacing problem. Generally speaking, if sufficient space is provided to define the fins 1350, the outlet contacts 1310 are too far apart to obtain desirable electrical and/or transmission characteristics. On the other hand, if the outlet contacts 1310 are positioned close enough together to obtain desirable electrical and/or transmission characteristics, the fins 1350 will be too short. One non-limiting solution to this problem is to weld the fins 1350 onto the outlet contacts 1310. Another non-limiting solution is to form the outlet contacts 1310 and the fins 1350 using a stereo-lithographic process.

Yet another non-limiting solution is to first bend the fins 1350 upwardly and then shift the outlet contacts 1310 laterally into appropriate positions. However, as mentioned above, the neighboring fins 1350 may be too close together to stamp and fold. This may be avoided in part by making some (e.g., every other one) of the outlet contacts 1310 out of a separate piece of sheet metal (referred to as a "lead frame").

Figure 28:
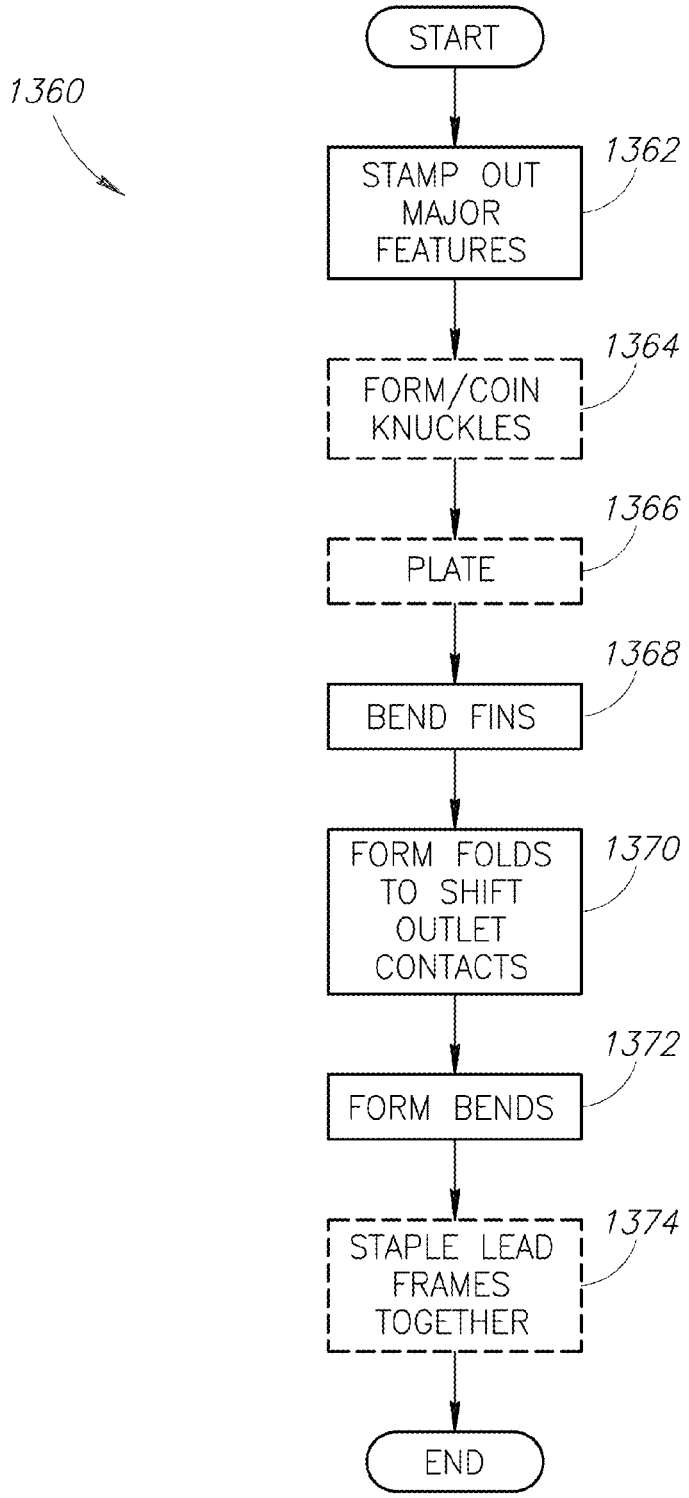
FIG. 28 is a flow diagram of a method of constructing the outlet contacts of FIG. 25.
Figure 29:
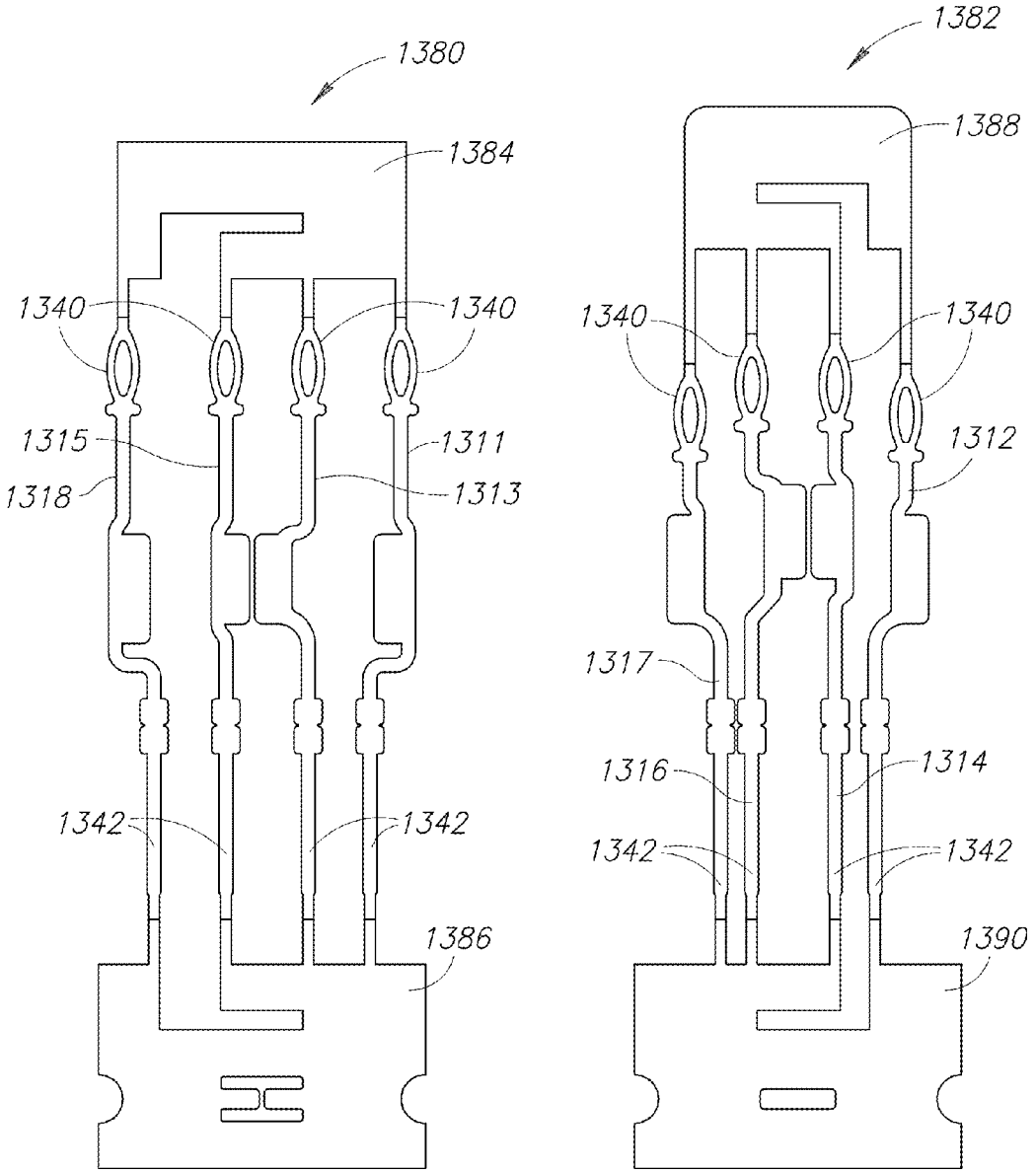
FIG. 29 is a top view of first and second lead frames used to construct the outlet contacts of FIG. 25.

FIG. 28 is a flow diagram of a method 1360 of constructing the outlet contacts 1310. In first block 1362, referring to FIG. 29, a first lead frame 1380 is stamped to define the outlet contacts 1311, 1313, 1315, and 1318, and a second lead frame 1382 is stamped to define the outlet contacts 1312, 1314, 1316, and 1317. Materials commonly used in the industry to construct outlet contacts may be used to construct the first and second lead frames 1380 and 1382. By way of a non-limiting example, the first and second lead frames 1380 and 1382 may be stamped from phosphor bronze C51000 spring temper shim stock having a thickness of about 0.20 millimeters. Additional non-limiting examples of suitable materials include phosphor-bronze and beryllium-copper with coatings of tin, nickel, and gold to help prevent corrosion, enhance conductivity, and aid solderability.

In the first lead frame 1380, the outlet contacts 1311, 1313, 1315, and 1318 are connected together at their first end portions 1340 by a first end portion 1384 of the first lead frame 1380. The outlet contacts 1311, 1313, 1315, and 1318 are also connected together at their second end portions 1342 by a second end portion 1386 of the first lead frame 1380.

Similarly, in the second lead frame 1382, the outlet contacts 1312, 1314, 1316, and 1317 are connected together at their first end portions 1340 by a first end portion 1388 of the second lead frame 1382. The outlet contacts 1312, 1314, 1316, and 1317 are also connected together at their second end portions 1342 by a second end portion 1390 of the second lead frame 1382.

Figure 30:
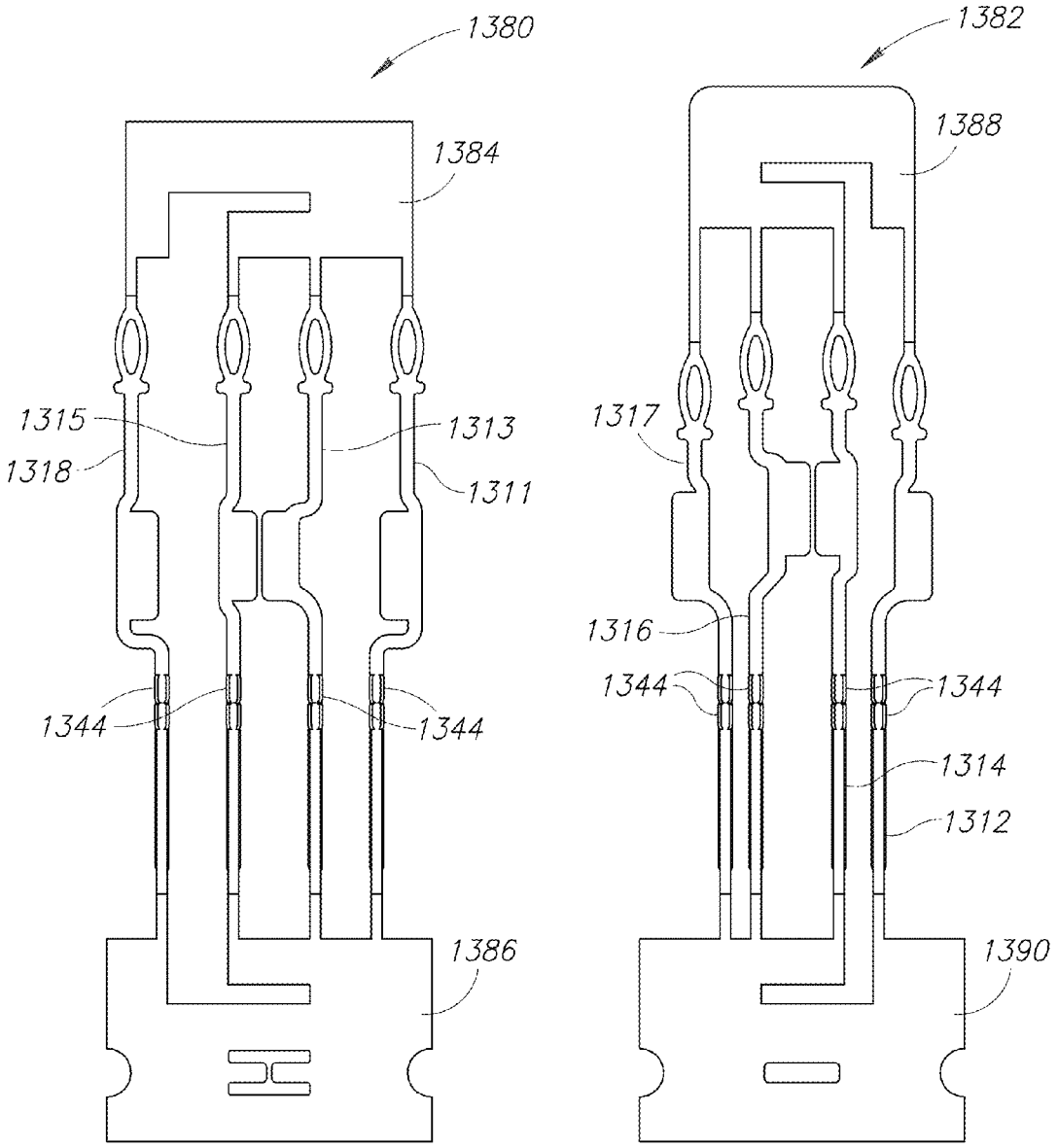
FIG. 30 is a top view of the first and second lead frames of FIG. 29 after an optional stamping or coining operation has been performed to define knuckle portions.

Then, referring to FIGS. 28 and 30, in optional block 1364, the first and second lead frames 1380 and 1382 may be stamped or coined to define the knuckle portions 1344. At this point, the first and second lead frames 1380 and 1382 are substantially planar except for the knuckle portions 1344.

Then, referring to FIG. 28, in optional block 1366, the first and second lead frames 1380 and 1382 may be plated. For example, the first and second lead frames 1380 and 1382 may be plated with nickel. Then, selected areas of the first and second lead frames 1380 and 1382 may be plated with gold.

Figure 31:
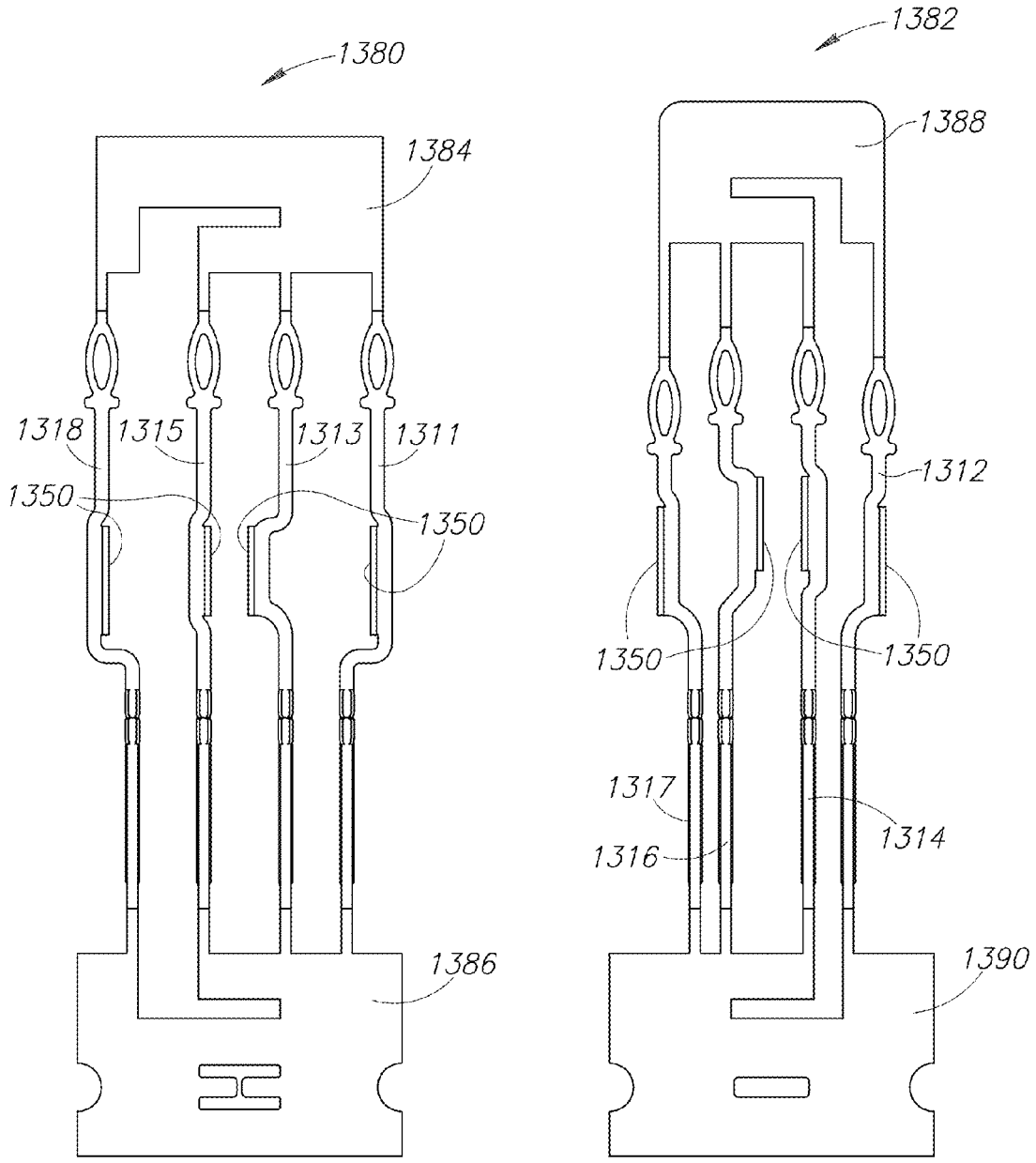
FIG. 31 is a top view of the first and second lead frames of FIG. 30 after a bending operation has been performed to define a plurality of fins.

Next, in block 1368, referring to FIG. 31, the fins 1350 are bent into the positions illustrated in FIGS. 26 and 27.

Figure 32:
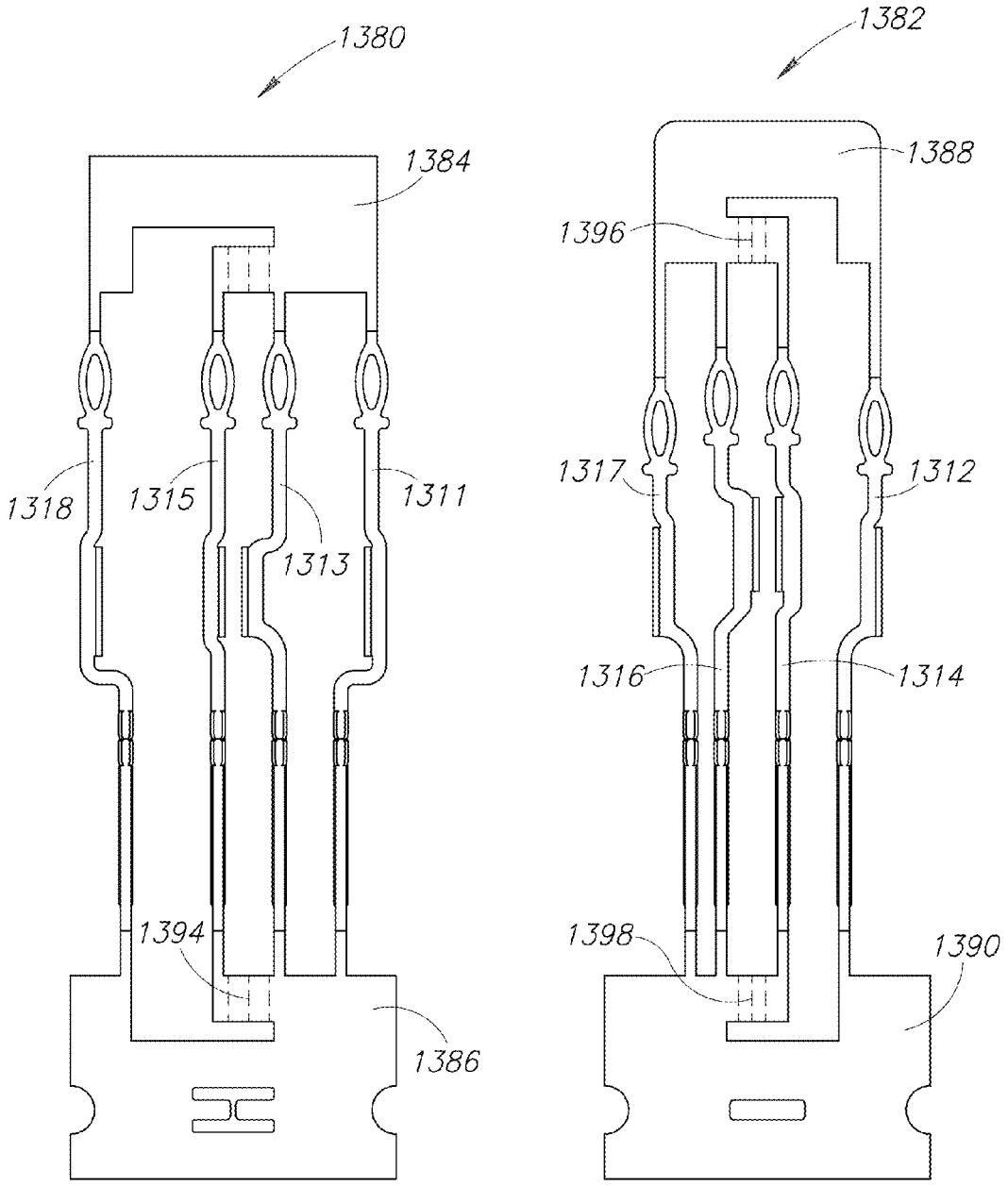
FIG. 32 is a top view of the first and second lead frames of FIG. 31 after a bending operation has been performed on the first and second lead frames to move third and fifth outlet contacts of the first lead frame closer together, and to move fourth and sixth outlet contacts of the second lead frame closer together.
Figure 33:
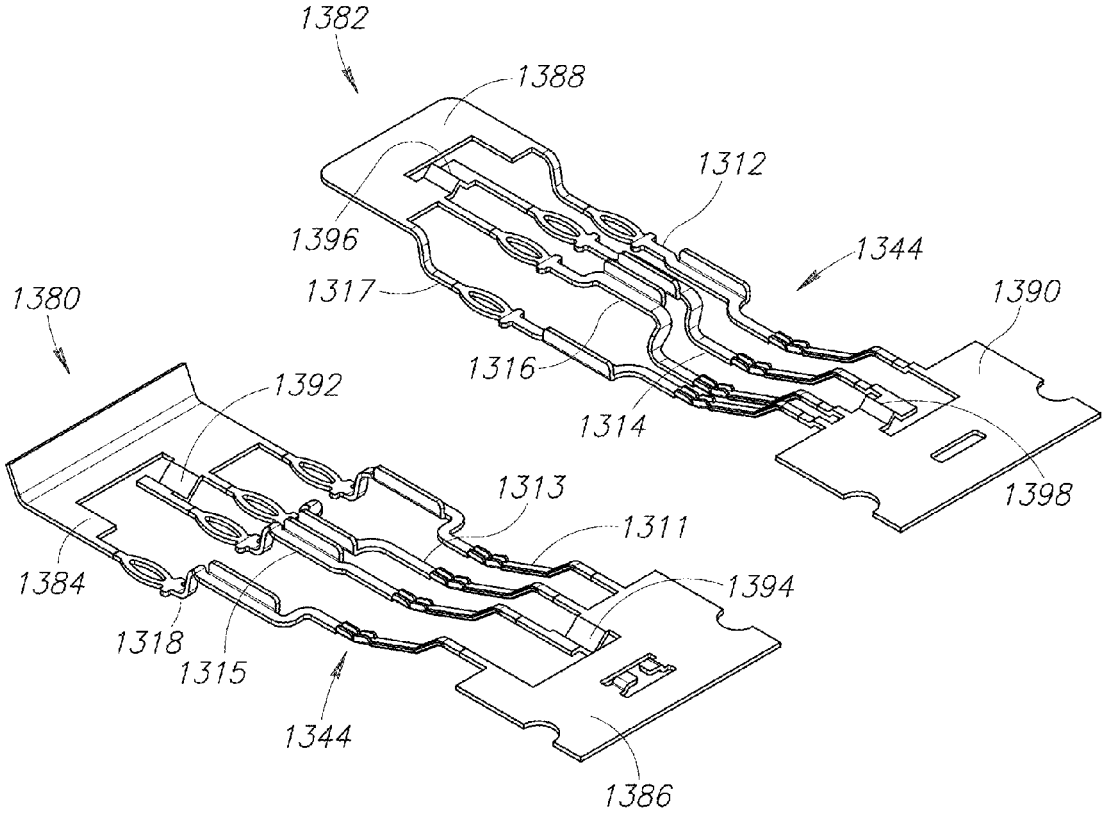
FIG. 33 is a perspective view of the first and second lead frames of FIG. 32 after one or more bending operations have been performed on the outlet contacts to define contours therein.

Referring to FIGS. 32 and 33, in block 1370 (see FIG. 28), the first lead frame 1380 is bent to position the outlet contacts 1313 and 1315 closer to one another, and the second lead frame 1382 is bent to position the outlet contacts 1314 and 1316 closer to one another. In the embodiment illustrated, in block 1370 (see FIG. 28), a first generally V-shaped bend 1392 is formed in the first end portion 1384 of the first lead frame 1380 between the outlet contacts 1313 and 1315, and a second generally V-shaped bend 1394 is formed in the second end portion 1386 of the first lead frame 1380 between the outlet contacts 1313 and 1315. Together, the bends 1392 and 1394 pull the outlet contacts 1313 and 1315 closer together.

Similarly, in the embodiment illustrated, in block 1370 (see FIG. 28), a first generally V-shaped bend 1396 is formed in the first end portion 1388 of the second lead frame 1382 between the outlet contacts 1314 and 1316. A second generally V-shaped bend 1398 is formed in the second end portion 1390 of the second lead frame 1382 between the outlet contacts 1314 and 1316. Together, the bends 1396 and 1398 pull the outlet contacts 1314 and 1316 closer together.

In block 1372 (see FIG. 28), referring to FIG. 33, the first lead frame 1380 is bent to form the contours in the outlet contacts 1311, 1313, 1315, and 1318, and the second lead frame 1382 is bent to form the contours in the outlet contacts 1312, 1314, 1316, and 1317. Thus, after block 1372 (see FIG. 28), the first and second lead frames 1380 and 1382 are no longer substantially planar. The bends at the knuckle portions 1344 may be less (e.g., about half) than those formed in other portions of the outlet contacts 1311-1318 to help prevent cracking in the plating, if any, applied in optional block 1366 (see FIG. 28).

Figure 34:
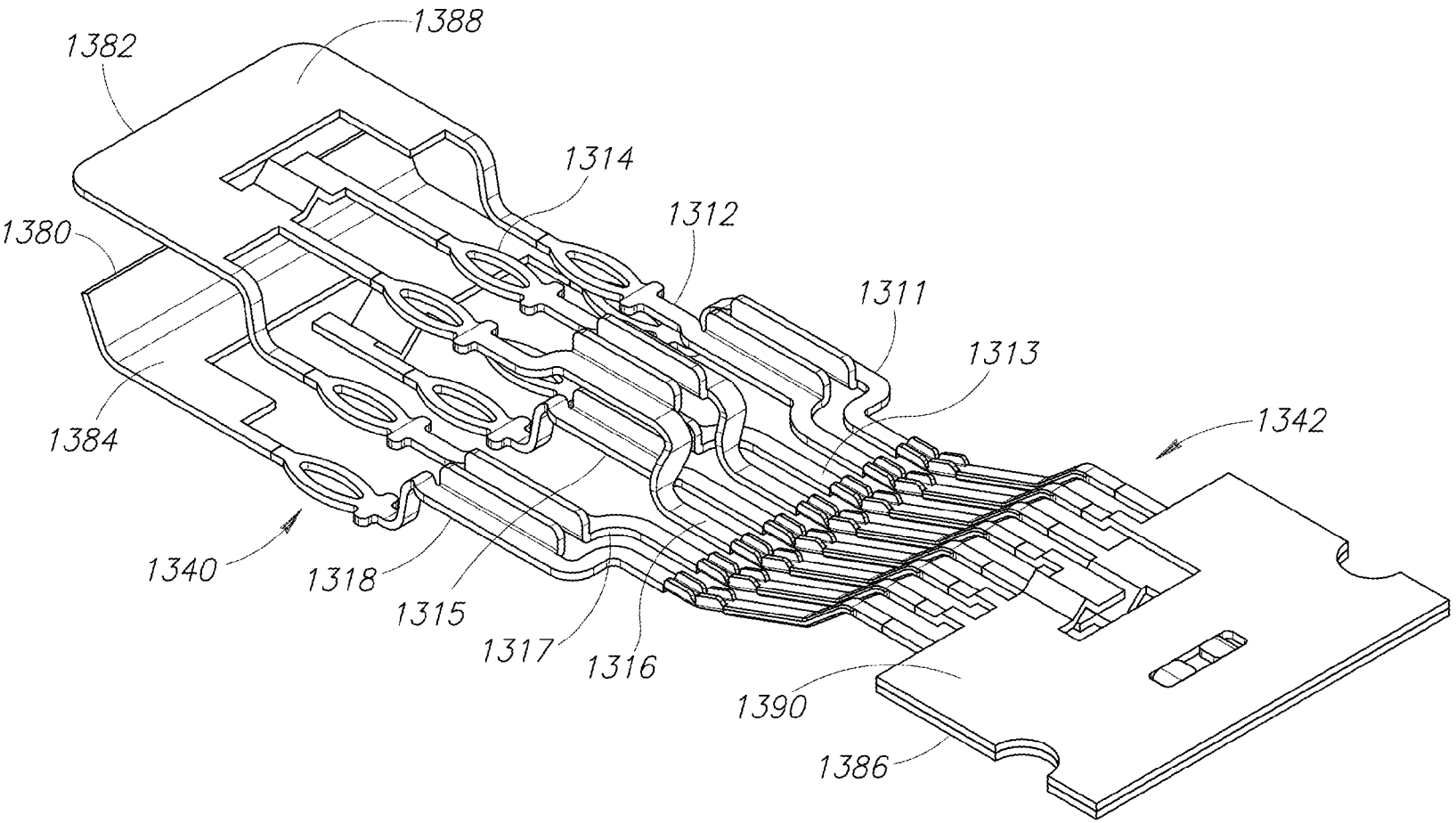
FIG. 34 is a perspective view of the first and second lead frames of FIG. 33 stapled together.

In optional block 1374 (see FIG. 28), referring to FIG. 34, the second end portions 1386 and 1390 of the first and second lead frames 1380 and 1382 may be stapled together. Stapling aligns the second free end portions 1342 of the outlet contacts 1310.

Then, the method 1360 (see FIG. 28) terminates. As is apparent to those of ordinary skill in the art, referring to FIG. 34, before an outlet (e.g., the outlet 120 illustrated in FIGS. 2 and 5, the outlet 170 illustrated in FIG. 7, and/or other outlets constructed to comply with the RJ-45 standard) that includes the subassembly 1300 (see FIGS. 21-24) is assembled, the first and second end portions 1384 and 1386 are trimmed from the outlet contacts 1311, 1313, 1315, and 1318, and the first and second end portions 1388 and 1390 are trimmed from the outlet contacts 1312, 1314, 1316, and 1317. A substantially similar process can be used to form the outlet contacts 1011 through 1018.

Dielectric Comb

Figure 35:
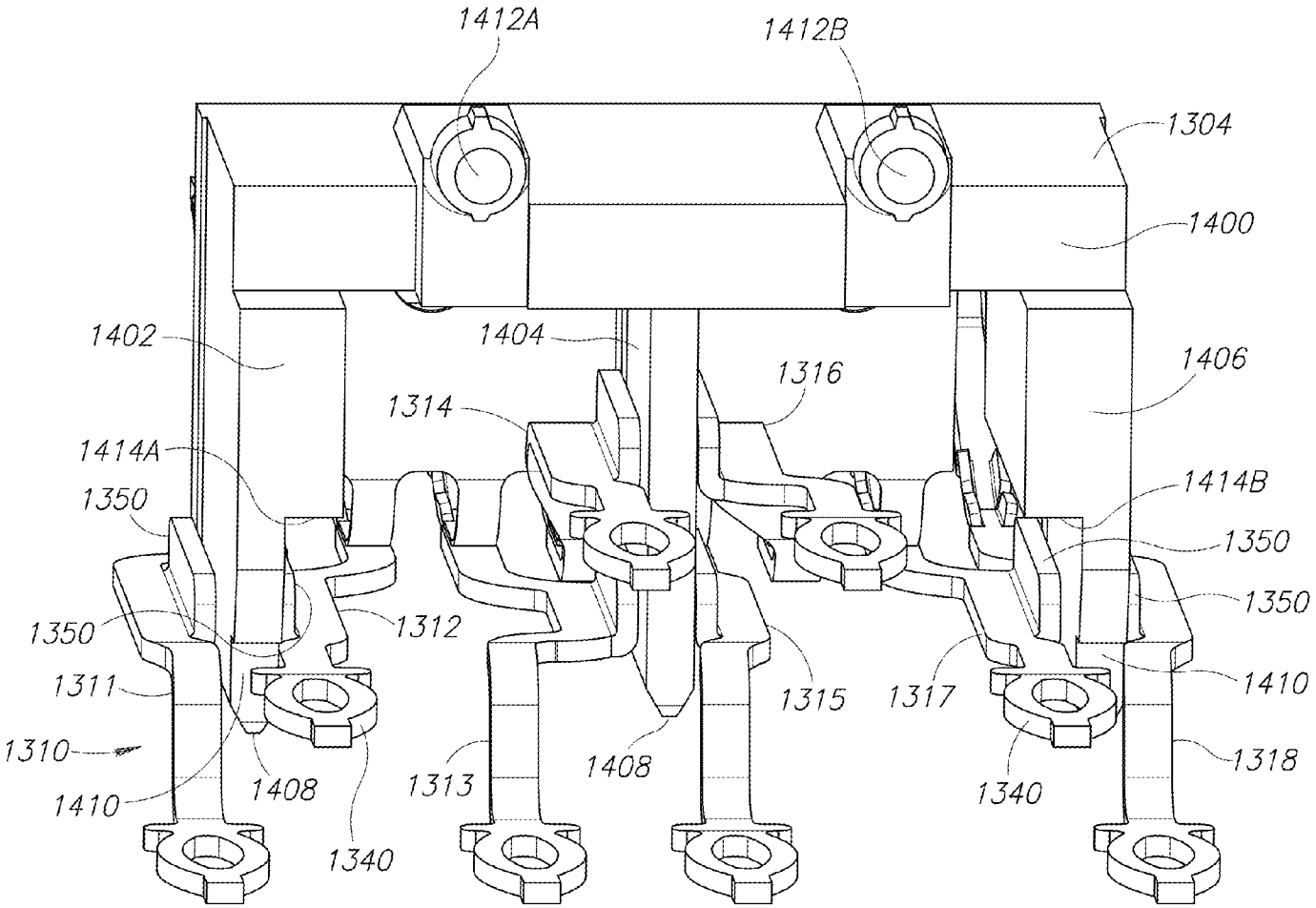
FIG. 35 is a perspective view of the outlet contacts and a dielectric comb of the third embodiment of the subassembly.

Referring to FIG. 35, the dielectric comb 1304 is substantially similar to the dielectric comb 1004 (see FIGS. 9-11, 15, and 16) and may be configured to perform the same or similar functions described with respect to the dielectric comb 1004. The dielectric comb 1304 may be constructed from any material suitable for constructing the dielectric comb 1004.

The dielectric comb 1304 has a body portion 1400 from which dielectric members 1402, 1404, and 1406 extend outwardly toward the outlet contacts 1310. The dielectric member 1402 extends between the fins 1350 of the outlet contacts 1311 and 1312 (of the second outlet contact pair). In the embodiment illustrated, the dielectric member 1402 extends from a first location at or near the substrate 1330 to a second location nearer the knuckle portions 1344 of the outlet contacts 1311 and 1312. Thus, the dielectric member 1402 extends along at least a portion of the current carrying portions of the outlet contacts 1311 and 1312. In the embodiment illustrated, the dielectric member 1402 extends along about one quarter of the length of the outlet contacts 1311 and 1312.

The dielectric member 1406 extends between the fins 1350 of the outlet contacts 1317 and 1318 (of the fourth outlet contact pair). In the embodiment illustrated, the dielectric member 1406 extends from a first location at or near the substrate 1330 to a second location nearer the knuckle portions 1344 of the outlet contacts 1317 and 1318. Thus, the dielectric member 1406 extends along at least a portion of the current carrying portions of the outlet contacts 1317 and 1318. In the embodiment illustrated, the dielectric member 1406 extends along about one quarter of the length of the outlet contacts 1317 and 1318.

The dielectric member 1404 extends between the fins 1350 of the outlet contacts 1314 and 1316. The dielectric member 1404 also extends between the fins 1350 of the outlet contacts 1313 and 1315. In the embodiment illustrated, the dielectric member 1404 extends from a first location at or near the substrate 1330 to a second location nearer the knuckle portions 1344 of the outlet contacts 1313-1316. Thus, the dielectric member 1404 extends along at least a portion of the current carrying portions of the outlet contacts 1313-1316. In the embodiment illustrated, the dielectric member 1404 extends along about one quarter of the length of the outlet contacts 1313-1316. The dielectric members 1402 and 1406 may extend further along the outlet contacts 1310 than the dielectric member 1404. However, this is not a requirement.

The dielectric comb 1304 may help achieve the desired impedance, without increasing unwanted crosstalk. As explained above, the outlet contacts 1310 and the dielectric members 1402, 1404, and 1406 of the dielectric comb 1304 are interleaved. This enhances the inductive and/or capacitive coupling between the outlet contacts of the first and fourth outlet contact pairs as well as between the outlet contacts 1314 and 1316, and between the outlet contacts 1313 and 1315 where such coupling is desired. For example, the dielectric members 1402, 1404, and 1406 may increase the dielectric constant between the outlet contacts of the first and fourth outlet contact pairs as well as between the outlet contacts 1314 and 1316, and between the outlet contacts 1313 and 1315. This may provide improved high voltage protection.

Each of the dielectric members 1402, 1404, and 1406 may be generally planar. Referring to FIG. 24, each of the dielectric members 1402, 1404, and 1406 has a lower edge 1408. Referring to FIG. 35, each of the dielectric members 1402 and 1406 includes a notch 1410. The notch 1410 formed in the dielectric member 1402 is positioned to accommodate the first end portion 1340 of the outlet contact 1312. Similarly, the notch 1410 formed in the dielectric member 1406 is positioned to accommodate the first end portion 1340 of the outlet contact 1317.

Referring to FIG. 23, one or more projections or mounting pegs 1412A and 1412B extend outwardly from the body portion 1400 of the dielectric comb 1304 toward the substrate 1330.

Referring to FIG. 35, the outlet contacts 1311 and 1318 are positioned outside the dielectric comb 1304 and can deflect upwardly. In contrast, the outlet contacts 1312-1317 are positioned inside the dielectric comb 1304 and may also be deflected upwardly but toward the body portion 1400.

Referring to FIGS. 23 and 24, the dielectric comb 1304 may be mounted to the substrate 1330 in substantially the same manner that the dielectric comb 1004 (see FIGS. 9-11, 15, and 16) may be mounted to the substrate 1030 (see FIGS. 8-11 and 20). Further, like the dielectric comb 1004, the dielectric comb 1304 may be unattached from the substrate 1330. In such embodiments, the dielectric comb 1304 may be characterized as "floating."

Referring to FIGS. 22-24, in alternate embodiments, the dielectric comb 1304 and the spring assembly 350 may be combined into a single component (not shown).

Compensation Circuits

Referring to FIG. 25, the compensation circuit 1322 has a plurality of electrically conductive contacts 1440 configured to physically contact selected ones of the outlet contacts 1310. In the example illustrated, the contacts 1440 include the contacts 1442-1447 configured to physically contact the outlet contacts 1312-1317, respectively. In this manner, electrical connections are formed between the contacts 1442-1447 and the outlet contacts 1312-1317, respectively. In alternate embodiments, the contacts 1442 and 1447 may be omitted. In such embodiments, the contacts 1443-1446 physically contact the outlet contacts 1313-1316, respectively, and form electrical connections therewith.

In the embodiment illustrated, the contacts 1442-1447 physically contact (e.g., are soldered to) the outlet contacts 1312-1317, respectively, between the first end portions 1340 and their knuckle portions 1344. Thus, the contacts 1442-1447 physically contact the outlet contacts 1312-1317, respectively, at their current carrying portions. Similarly, in embodiments omitting the contacts 1442 and 1447, the contacts 1443-1446 physically contact the outlet contacts 1313-1316, respectively, at their current carrying portions.

The contacts 1440 are connected to compensation circuitry (described below) patterned on a flexible substrate 1452 to form a "flex circuit." Referring to FIG. 36, the flexible substrate 1452 of the compensation circuit 1322 may curve or bend upwardly away from the outlet contacts 1310 and rest against the body portion 1400 of the dielectric comb 1304.

The flexible substrate 1452 has a first side 1450 opposite a second side 1451 (see FIG. 24). In the embodiment illustrated, the flexible substrate 1452 includes a plurality of outwardly extending generally parallel finger portions 1454. A different one of the contacts 1440 is formed on each of the finger portions 1454 on the second side 1451 (see FIG. 24) of the flexible substrate 1452. Thus, in the embodiment illustrated, the finger portions 1454 include figure portions F2-F7 with the contact 1442-1447, respectively, formed thereon. In alternate embodiments, the contacts 1442 and 1447 and the finger portions F2 and F7 may be omitted.

Substrate

Referring to FIGS. 23 and 24, the substrate 1330 has a first forwardly facing side 1460 opposite a second rearwardly facing side 1462. The substrate 1330 includes apertures 1464A and 1464B substantially identical to the apertures 522A and 522B (see FIG. 6), respectively, and apertures 1466A and 1466B substantially identical to the apertures 552A and 552B (see FIG. 6), respectively. The protrusions 520A and 520B of the spring assembly 350 may be received in the apertures 1464A and 1464B, respectively, and the protrusions 550A and 550B of the contact positioning member 352 may be received in the apertures 1466A and 1466B, respectively. The substrate 1330 may include apertures 1468A and 1468B configured to receive the mounting pegs 1412A and 1412B, respectively, of the dielectric comb 1304. The apertures 1464A, 1464B, 1466A, 1466B, 1468A, and 1468B are formed in the forwardly facing side 1460. In the embodiment illustrated, the apertures 1464A, 1464B, 1466A, 1466B, 1468A, and 1468B have been implemented as through-holes. However, this is not a requirement.

Figure 37:
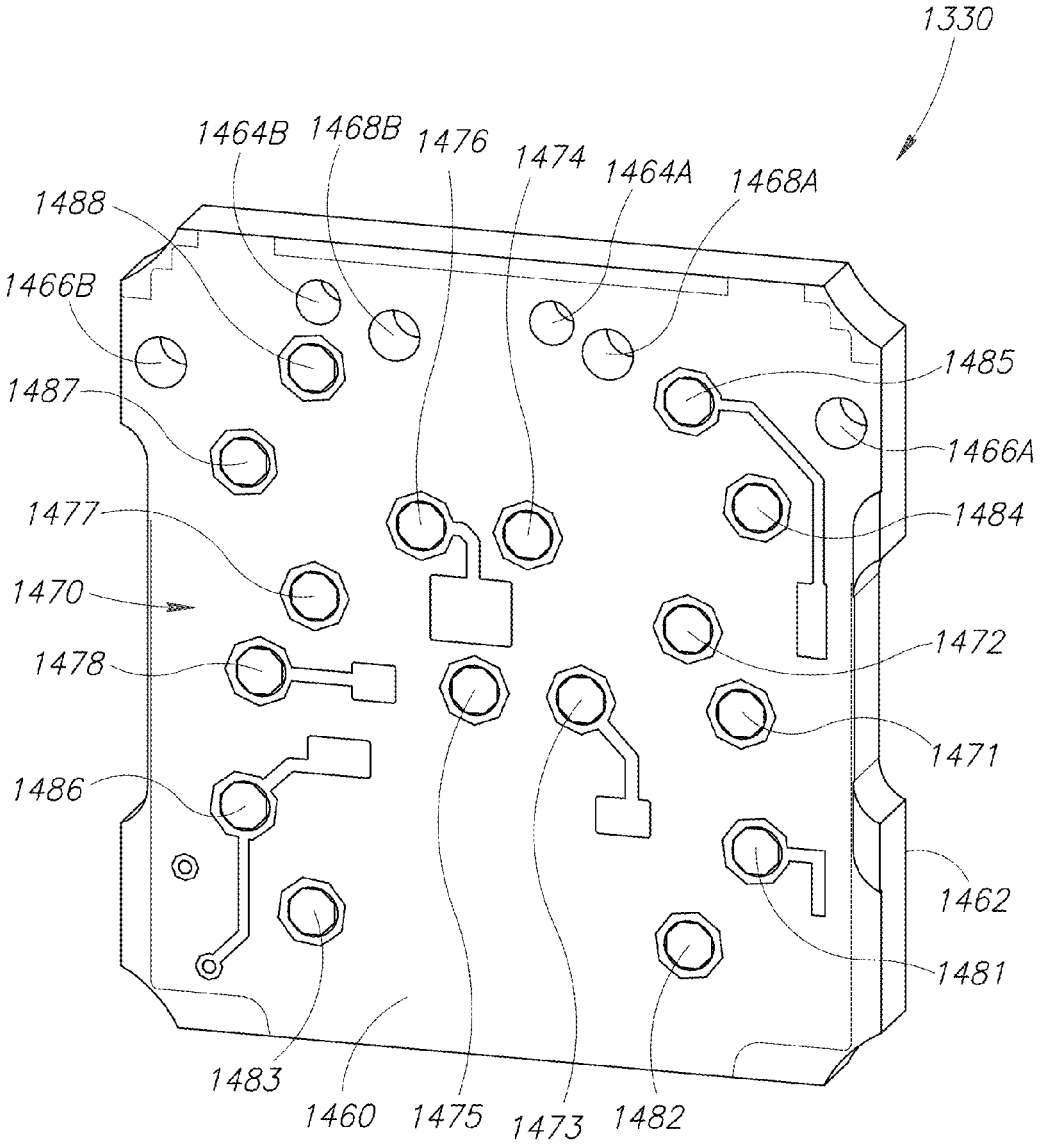
FIG. 37 is a perspective view of a substrate of the third embodiment of the subassembly.

Referring to FIG. 37, the substrate 1330 includes a plurality of conductors 1470 (e.g., traces) that connect the outlet contacts 1311-1318 to the wire contacts 361-368 (see FIG. 23), respectively. As is apparent to those of ordinary skill in the art, other configurations of the conductors 1470 may be used and the substrate 1330 is not limited to use with the configuration illustrated.

Referring to FIG. 37, the substrate 1030 includes apertures 1471-1478 (e.g., plated through-holes) configured to receive the first end portions 1340 (see FIG. 25) of the outlet contacts 1311-1318 (see FIG. 25), respectively, and electrically connect each of the outlet contacts 1311-1318 to a portion of the conductors 1470. The apertures 1471-1478 may be spaced apart from one another by substantially more than similar openings are spaced apart in a conventional RJ-type outlet. Such relatively wide spacing allows compensation circuitry to be placed in between at least some of the apertures 1471-1478. For example, capacitive compensation circuitry may be placed between the apertures 1473 and 1474 and between the apertures 1475 and 1476.

The substrate 1330 also includes apertures 1481-1488 (e.g., plated through-holes) configured to receive each of the wire contacts 361-368 (see FIG. 23), respectively, and electrically connect the wire contacts 361-368 (see FIG. 23) to a portion of the conductors 1470.

Figure 21:
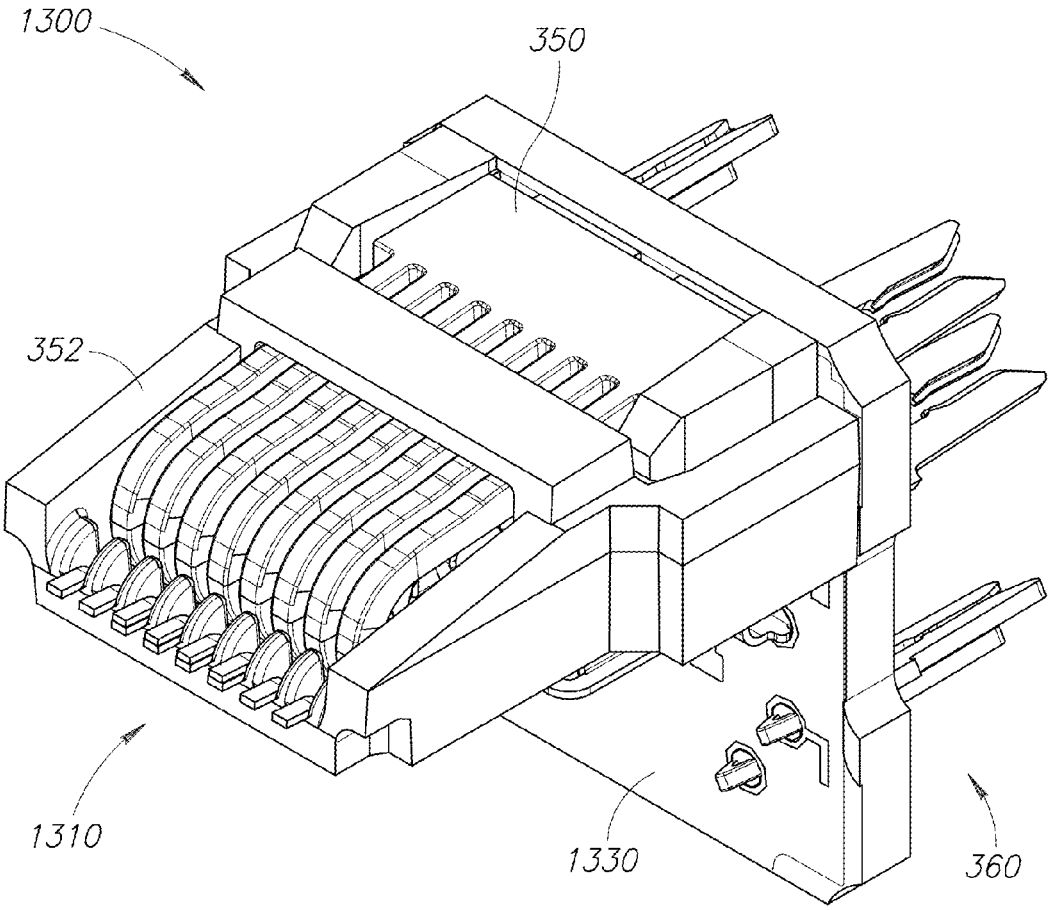
FIG. 21 is a first perspective view of a third embodiment of a subassembly for use with an outlet.

In the embodiment illustrated, the first end portions 1340 of the outlet contacts 1311-1318 may be pressed into the apertures 1471-1478, respectively, from the first forwardly facing side 1460 of the substrate 1330 and the wire contacts 361-368 may be pressed into the apertures 1481-1488, respectively, in the substrate 1330 from the second rearwardly facing side 1462 of the substrate 1330. Thus, as shown in FIGS. 21 and 22, the outlet contacts 1310 and the wire contacts 360 extend away from the substrate 1330 in opposite directions. The outlet contacts 1310 may be subsequently soldered into place, if desired.

Alternate Embodiment

Figure 36:
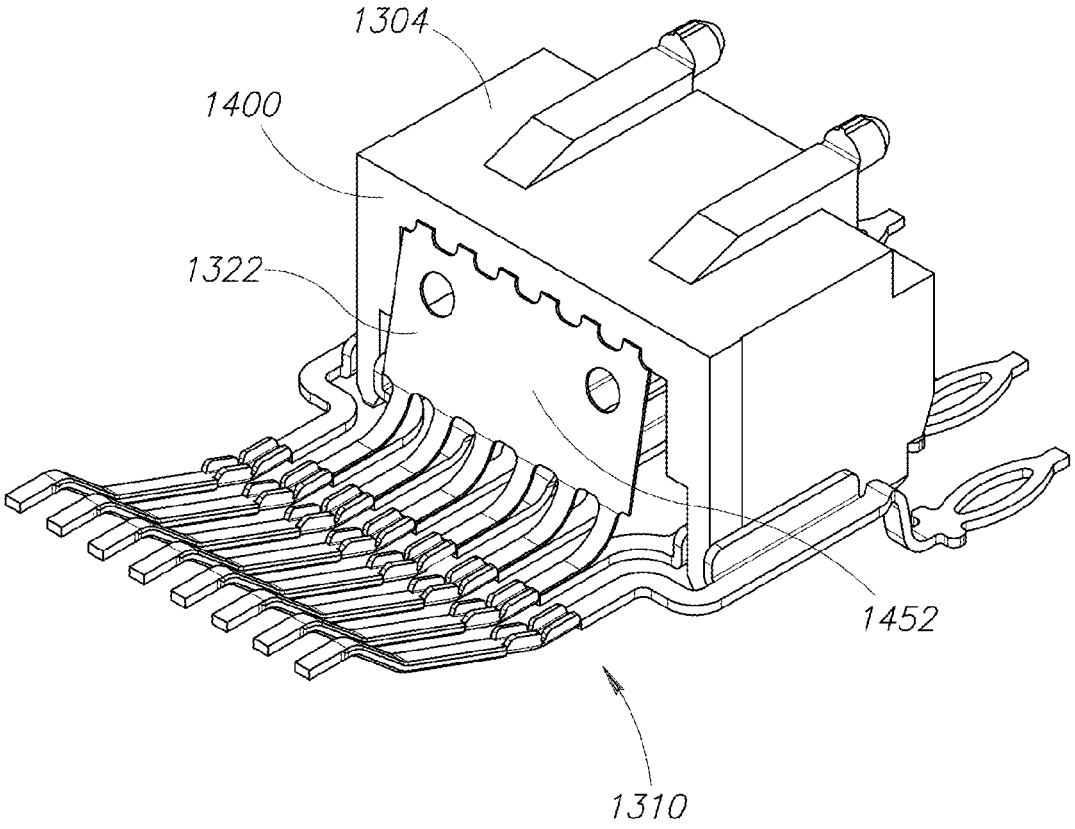
FIG. 36 is a perspective view of the compensation circuit, the outlet contacts, and a dielectric comb of the third embodiment of the subassembly.
Figure 38:
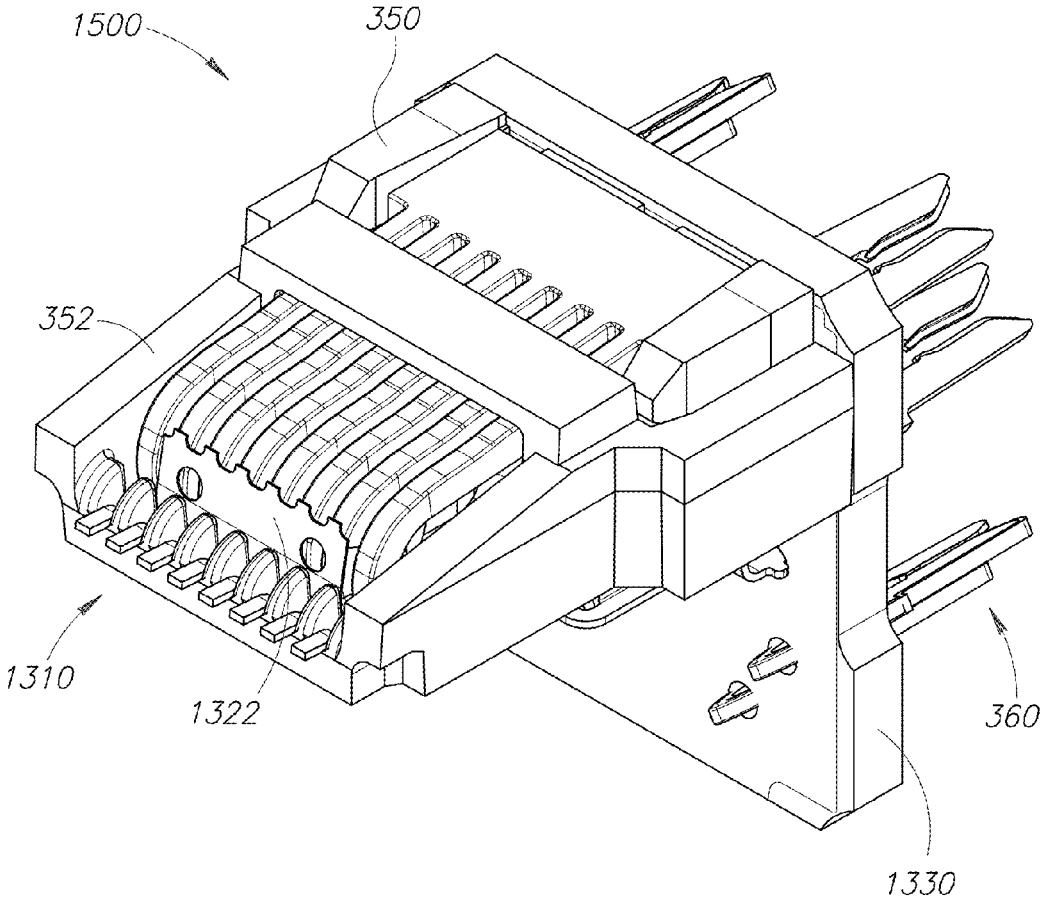
FIG. 38 is a perspective view of a fourth embodiment of a subassembly for use with an outlet.

Referring to FIG. 38, in alternate embodiments, the outlet 120 (see FIGS. 2 and 5), the outlet 170 (see FIG. 7), and/or other outlets constructed to comply with the RJ-45 standard may include a subassembly 1500 instead of and in place of the subassembly 1002 (see FIGS. 8-11), the subassembly 358 (see FIGS. 5 and 6), or the subassembly 1310 (see FIG. 36). For ease of illustration, like reference numerals have been used in the drawings to identify like components.

Figure 39:
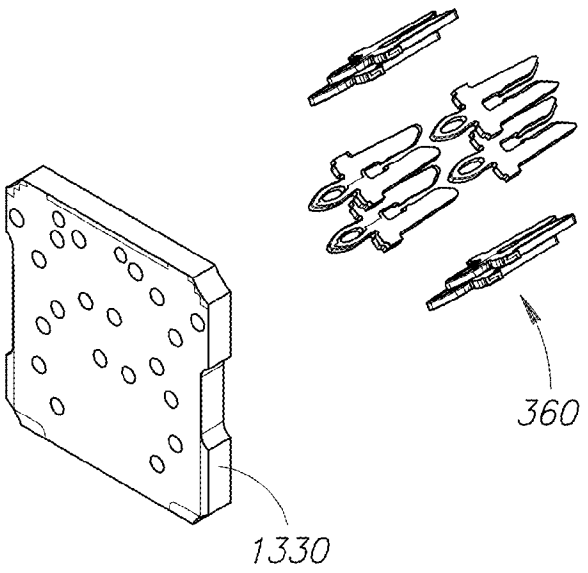
FIG. 39 is an exploded perspective view of the fourth embodiment of the subassembly of FIG. 38.
Figure 39:
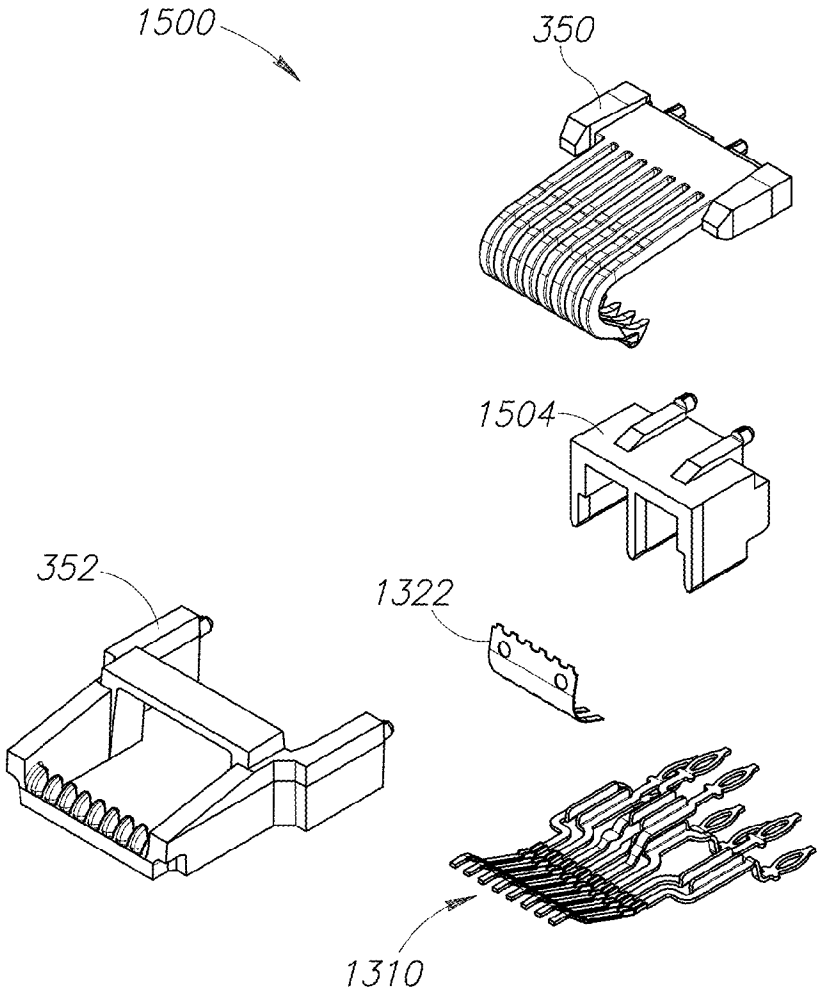

Referring to FIG. 39, the subassembly 1500 includes a dielectric comb 1504, the compensation circuit 1322, the outlet contacts 1310, the optional spring assembly 350, the contact positioning member 352, the substrate 1330, and the wire contacts 360.

Dielectric Comb

Referring to FIG. 39, the dielectric comb 1504 is substantially similar to the dielectric comb 1304 (see FIGS. 22-24, 35, and 36) and may be configured to perform the same or similar functions described with respect to the dielectric comb 1304. The dielectric comb 1304 may be constructed from any material suitable for constructing the dielectric comb 1004. Because the dielectric comb 1504 differs only with respect to a few minor design choices and is functionally equivalent to the dielectric comb 1304, the dielectric comb 1504 will not be described in detail. In alternate embodiments, the dielectric comb 1504 and the spring assembly 350 (see FIGS. 38, 39, and 41) may be combined into a single component (not shown).

Compensation Circuit

Figure 40:
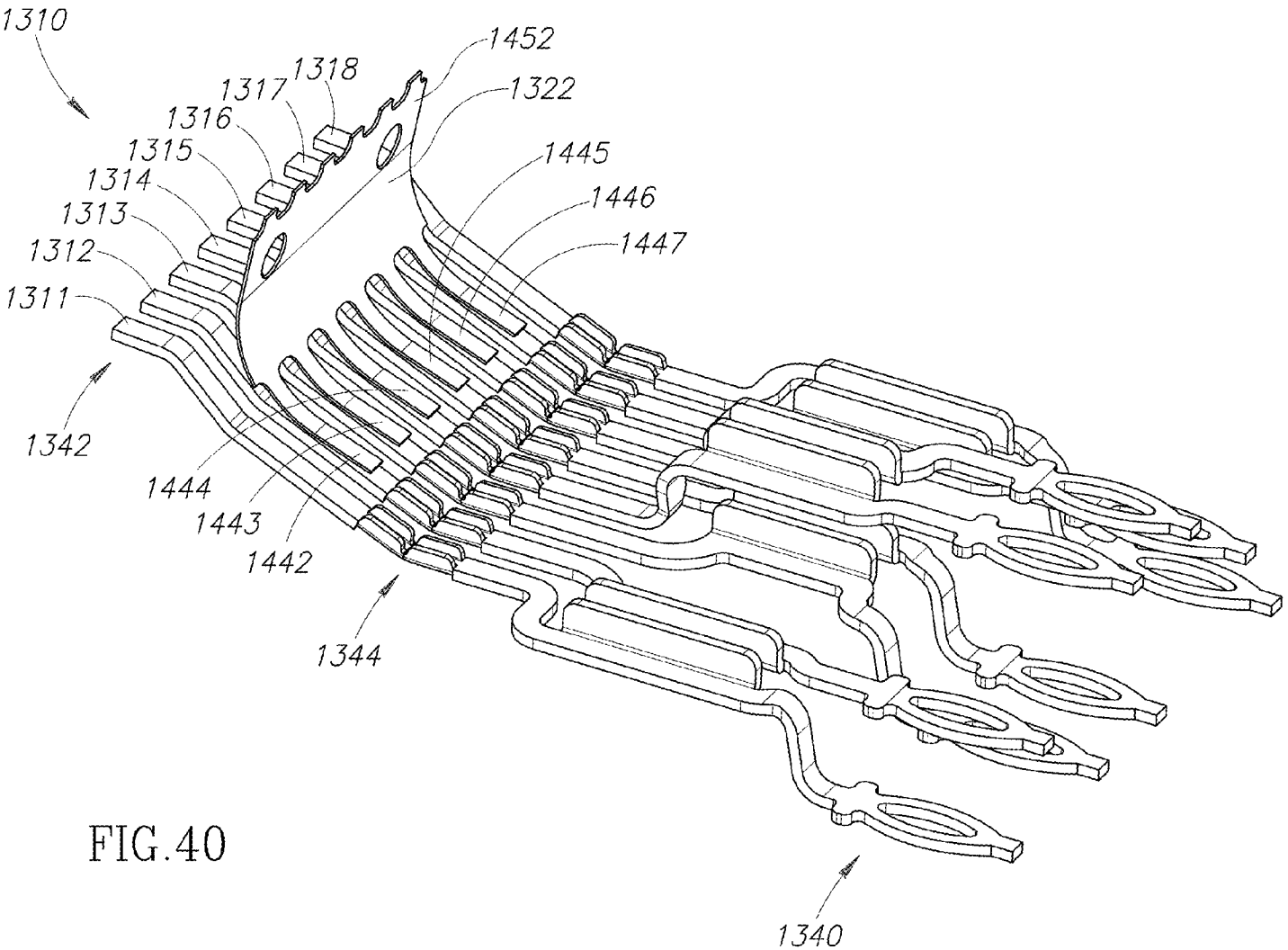
FIG. 40 is a perspective view of a compensation circuit and outlet contacts of the fourth embodiment of the subassembly.

Referring to FIG. 40, as mentioned above, the conductive contacts 1442-1447 of the compensation circuit 1322 are configured to physically contact the outlet contacts 1312-1317, respectively, and form electrical connections therewith. Without being limited by theory, it is believed that it may be advantageous for the contacts 1442-1447 to physically contact the outlet contacts 1312-1317, respectively, at locations that are half way in between the second free end portions 1342 of the outlet contacts 1312-1317 and locations whereat one or more imbalances are introduced. An imbalance is introduced into the outlet contacts 1312-1317 where a first one of them crosses over a second one of them. In the embodiment illustrated, the contacts 1442-1447 physically contact (e.g., are soldered to) the outlet contacts 1312-1317, respectively, between their second free end portions 1342 and their knuckle portions 1344. Thus, in the embodiment illustrated, the contacts 1442-1447 physically contact (e.g., are soldered to) the non-current carrying portions of the outlet contacts 1312-1317, respectively.

Similarly, in embodiments omitting the contacts 1442 and 1447, the contacts 1443-1446 physically contact the outlet contacts 1313-1316, respectively, on their non-current carrying portions.

Figure 41:
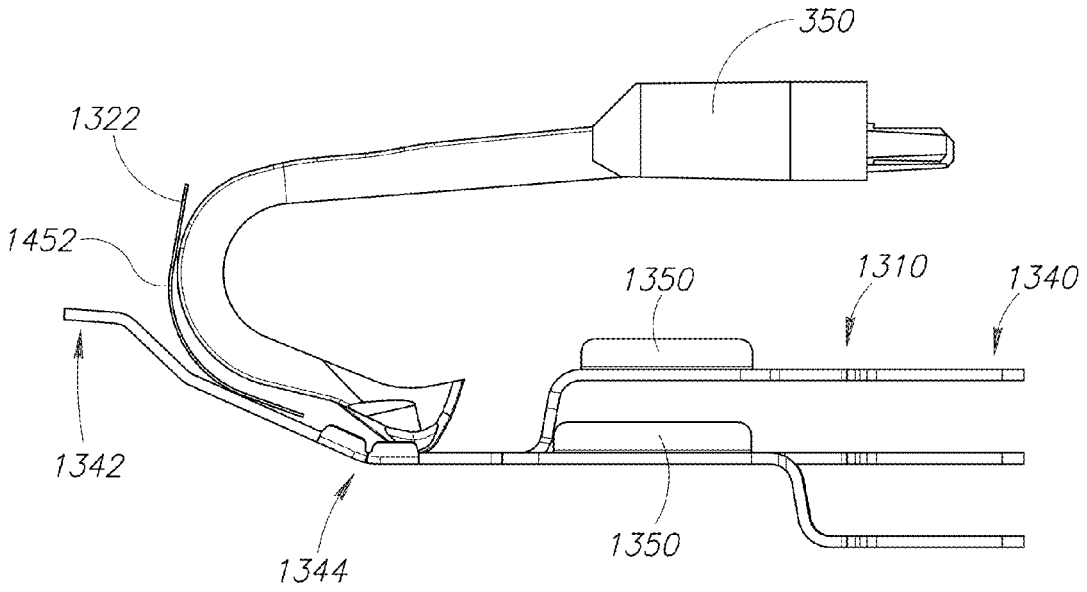
FIG. 41 is a side view of the spring assembly, the compensation circuit, and the outlet contacts of the third embodiment of the subassembly.

Referring to FIG. 41, the flexible substrate 1452 of the compensation circuit 1322 may curve or bend upwardly away from the outlet contacts 1310 and around the spring assembly 350. Optionally, the flexible substrate 1452 may be attached to the spring assembly 350.

Position of Compensation Circuit

Referring to FIG. 25, in the subassembly 1300 (see FIGS. 21-24), the contacts 1440 physically contact the upper surfaces of selected ones of the outlet contacts 1310 (e.g., the outlet contacts 1312-1317) between their first end portions 1340 and their knuckle portions 1344. Thus, the contacts 1440 physically contact the selected ones of the outlet contacts 1310 (e.g., the outlet contacts 1312-1317) at their current carrying portions. Referring to FIG. 36, the flexible substrate 1452 of the compensation circuit 1322 may curve or bend upwardly away from the outlet contacts 1310 and rest against the body portion 1400 of the dielectric comb 1304.

Referring to FIG. 40, in the subassembly 1500 (see FIGS. 38 and 39), the contacts 1440 (see FIG. 25) of the compensation circuit 1322 physically contact the upper surfaces of selected ones of the outlet contacts 1310 (e.g., the outlet contacts 1312-1317) between their second free end portions 1342 and their knuckle portions 1344. Thus, in the embodiment illustrated, the contacts 1440 (see FIG. 25) physically contact (e.g., are soldered to) the non-current carrying portions of the selected ones of the outlet contacts 1310 (e.g., the outlet contacts 1312-1317). Further, referring to FIG. 41, the flexible substrate 1452 curves or bends upwardly away from the outlet contacts 1310 and around the spring assembly 350. This may be characterized as being a "Forward Flex" configuration.

Thus, the figures depict the compensation circuit 1322 in two different locations. However, the compensation circuit 1322 may be positioned at any location along the selected ones of the outlet contacts 1310 (e.g., the outlet contacts 1312-1317). For example, the compensation circuit 1322 may be positioned at or near the first end portions 1340 of the outlet contacts 1312-1317 (or the outlet contacts 1313-1316). Further, the compensation circuit 1322 may be physically connected to the lower surfaces of the outlet contacts 1312-1317 (or the outlet contacts 1313-1316), instead of their upper surfaces, at any location along the outlet contacts 1312-1317 (or the outlet contacts 1313-1316).

Referring to FIG. 40, as mentioned above, in some embodiments, the contacts 1442 and 1447 may be omitted. In such embodiments, the contacts 1443-1446 may be connected to the upper or lower surfaces of the outlet contacts 1313-1316, respectively, anywhere along the lengths of the outlet contacts 1313-1316, respectively.

Compensation Circuitry

Compensation of the type disclosed herein makes it possible to satisfy very high bit rate requirements of a RJ-45 connector and at the same time, introduce little to no crosstalk. The compensation circuit 1322 may be characterized as being a high-impedance compensation flex circuit configured to reduce and/or eliminate crosstalk between outlet contacts (e.g., the outlet contacts 1311-1318). As mentioned above, the compensation circuit 1322 includes the contacts 1440 (see FIG. 25) that are connected to compensation circuitry patterned on the flexible substrate 1452. Three exemplary embodiments for implementing the compensation circuitry are described below. As is apparent to those of ordinary skill in the art, different portions of the compensation circuitry may be positioned on different layers of the flexible substrate 1452.

For ease of illustration, the contacts 1440 (see FIG. 25) of the compensation circuit 1322 will be described below as being connected (e.g., soldered) to selected ones of the outlet contacts 1310. However, as is apparent to those of ordinary skill in the art, the compensation circuit 1322 is not limited to use with any particular outlet contacts. By way of non-limiting examples, the compensation circuit 1322 may be used with conventional outlet contacts, the outlet contacts 342 (see FIGS. 5-7 and 51), the outlet contacts 1010 (see FIGS. 8-12, 15, and 16), the outlet contacts 1310, and the like. For example, the compensation circuit 1322 may be used in the subassembly 358 illustrated in FIGS. 5 and 6 (instead of the flexible PCB 530 illustrated in FIG. 6), the subassembly 1002 illustrated in FIGS. 8-11 (instead of the compensation circuit 1020 illustrated in FIGS. 9-11, 18, and 19), the subassembly 1300 illustrated in FIGS. 21-24, and/or the subassembly 1500 illustrated in FIGS. 38 and 39.

First Embodiment

Figure 42:
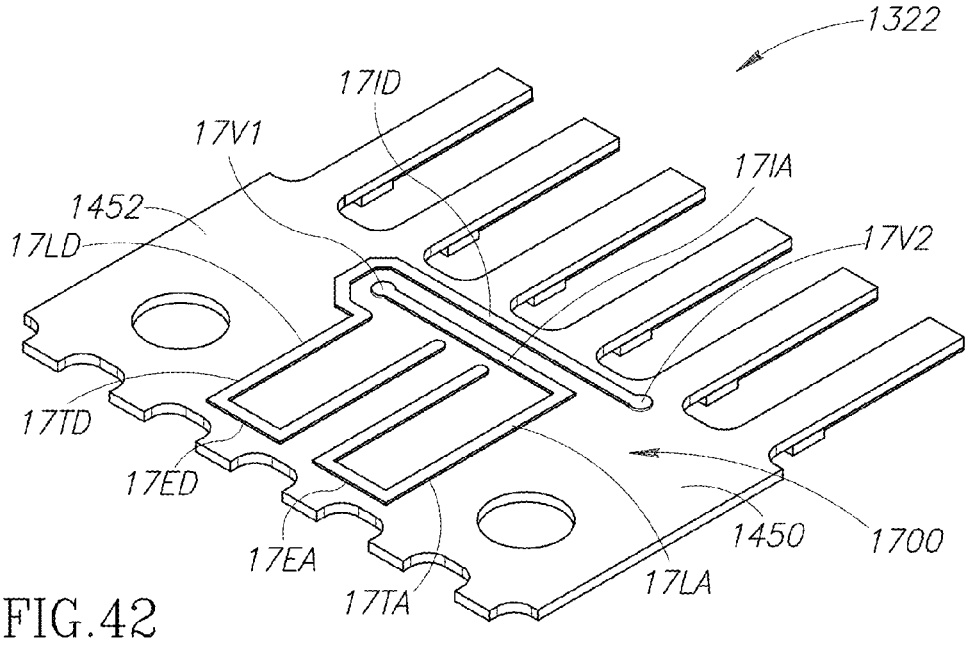
FIG. 42 is a perspective view of a first side of a flexible substrate of the compensation circuit of FIG. 40 including a first embodiment of compensation circuitry.
Figure 44:
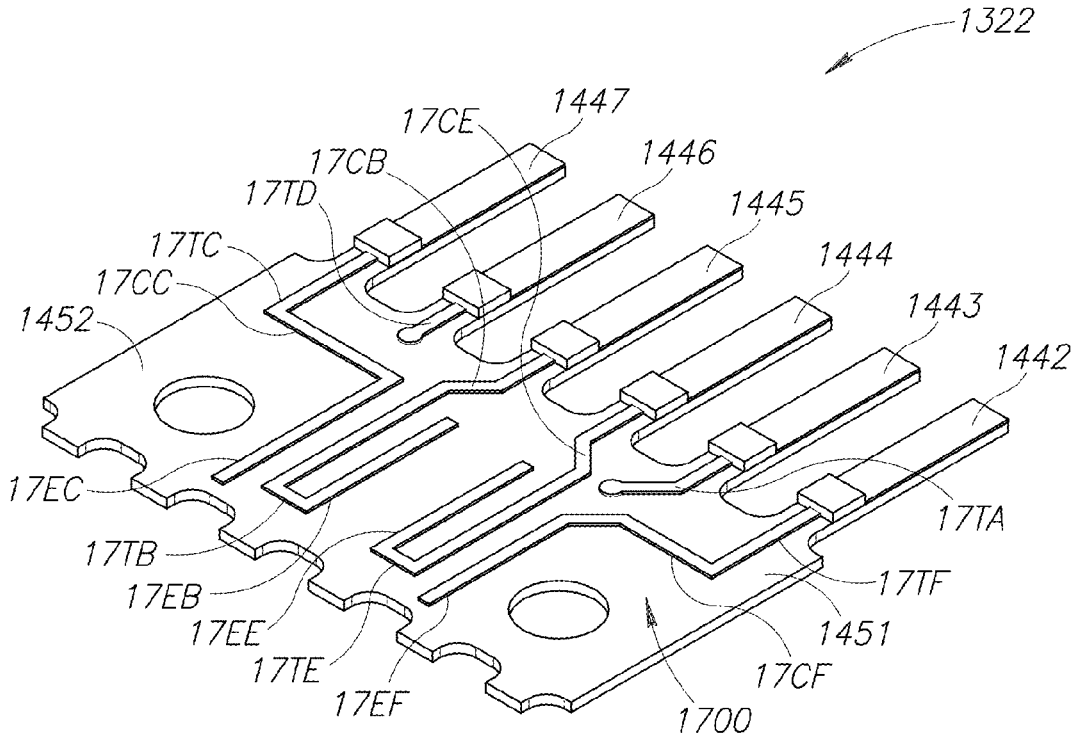
FIG. 44 is a perspective view of a second side of the flexible substrate of the compensation circuit of FIG. 40 including the first embodiment of compensation circuitry.

FIGS. 42 and 44 depict the compensation circuit 1322 including in a first embodiment of compensation circuitry 1700. In such embodiments, the compensation circuit 1322 may be characterized as being a two-layer high-impedance high-speed compensation flex circuit. The compensation circuitry 1700 employs a special technique for crosstalk compensation that does not absorb the signal being conveyed by the third split pair of outlet contacts (e.g., the outlet contacts 1313 and 1316 depicted in FIGS. 25 and 40).

Figure 43:
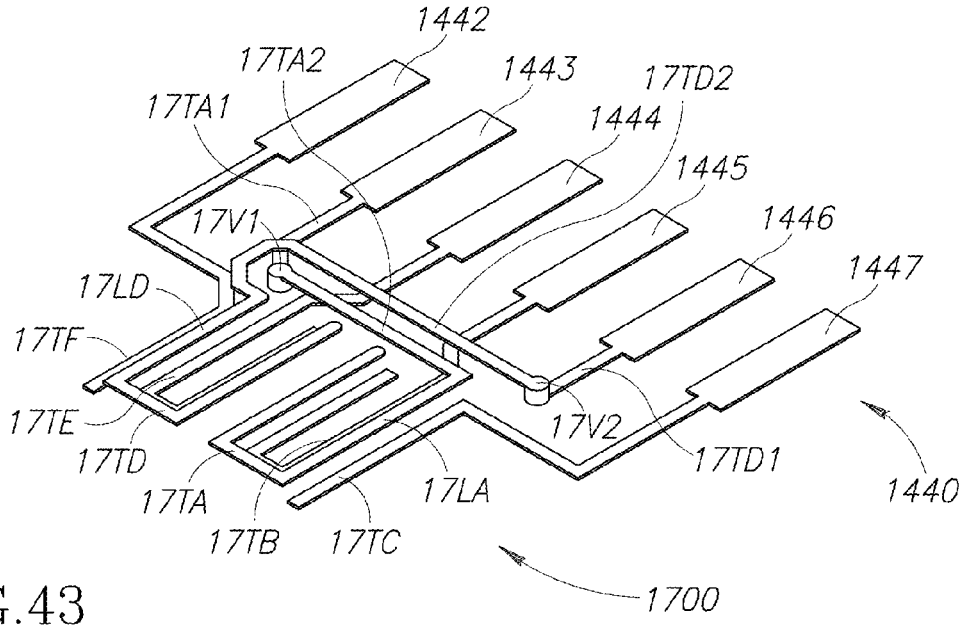
FIG. 43 is the perspective view of FIG. 42 omitting the flexible substrate.

Referring to FIG. 43, the compensation circuitry 1700 includes traces 17TA-17TF connected to the contacts 1443, 1445, 1447, 1446, 1444, and 1442, respectively. The traces 17TB, 17TC, 17TE, and 17TF extend entirely on the second side 1451 (see FIG. 44) of the flexible substrate 1452. The trace 17TA has a first portion 17TA1 that extends from the contact 1443 along the second side 1451 (see FIG. 44) of the flexible substrate 1452 to a via 17V1. The trace 17TA has a second portion 17TA2 that extends from the via 17V1 along the first side 1450 (see FIG. 42) of the flexible substrate 1452.

Referring to FIG. 42, the trace 17TA has an end portion 17EA positioned on the first side 1450 of the flexible substrate 1452. An intermediate portion 17IA connects the end portion 17EA of the trace 17TA to the via 17V1. In the embodiment illustrated, the intermediate portion 17IA is substantially linear.

Referring to FIG. 44, the traces 17TB and 17TC have end portions 17EB and 17EC, respectively, positioned on the second side 1451 of the flexible substrate 1452. A connecting portion 17CB of the trace 17TB positioned on the second side 1451 of the flexible substrate 1452 connects the end portion 17EB of the trace 17TB to the contact 1445. In the embodiment illustrated, the intermediate portion 17IA (see FIG. 42) of the trace 17TA crosses over the end portion 17EB and/or the connecting portion 17CB of the trace 17TB. The intermediate portion 17IA (see FIG. 42) of the trace 17TA also crosses over the trace 17TE. The first portion 17TA1 (see FIG. 43) of the trace 17TA crosses under the trace 17TD.

A connecting portion 17CC of the trace 17TC positioned on the second side 1451 of the flexible substrate 1452 connects the end portion 17EC of the trace 17TC to the contact 1447. None of the traces 17TA, 17TB, and 17TD-17TF crosses over the trace 17TC.

The end portion 17EA (see FIG. 42) of the trace 17TA is spaced apart from the end portion 17EB of the trace 17TB by the flexible substrate 1452. The end portion 17EA (see FIG. 42) of the trace 17TA and the end portion 17EB of the trace 17TB are relatively long when compared with the end portion 17EC of the trace 17TC. Thus, the longer end portions 17EA and 17EB of the traces 17TA and 17TB are formed on opposite sides of the flexible substrate 1452 and are substantially parallel to one another along spaced apart planes defined by the first and second sides 1450 and 1451, respectively, of the flexible substrate 1452.

The end portions 17EA and 17EB of the traces 17TA and 17TB have the same general two-dimensional shape. For example, in the embodiment illustrated, the end portions 17EA and 17EB are generally U-shaped. However, the shape defined by the end portion 17EB is smaller than and would be completely surrounded by the shape defined by the end portion 17EA if the end portions 17EA and 17EB were in the same plane.

The shorter end portion 17EC of the trace 17TC is spaced apart from the longer end portion 17EA of the trace 17TA by the flexible substrate 1452. In the embodiment illustrated, the shorter end portion 17EC is substantially linear and substantially parallel with at least a substantially linear portion 17LA (see FIGS. 42 and 43) of the longer end portion 17EA of the trace 17TA. If the substantially linear portion 17LA of the trace 17TA were in the same plane as the end portions 17EB and 17EC of the traces 17TB and 17TC, respectively, the substantially linear portion 17LA would extend between the end portions 17EB and 17EC of the traces 17TB and 17TC and contact neither the end portion 17EB of the trace 17TB nor the end portion 17EC of the trace 17TC.

Referring to FIG. 25, a signal on the outlet contact 1316 (for example) radiates crosstalk to the nearby outlet contacts 1317 and 1315. To counteract this crosstalk, the counter-signal being conveyed by the outlet contact 1313 is conducted by the trace 17TA (see FIG. 44). Referring to FIG. 44, the longer end portion 17EA of the trace 17TA radiates a crosstalk canceling signal onto both the longer end portion 17EB of the trace 17TB (which is connected to the outlet contact 1315) and the shorter end portion 17EC of the trace 17TC (which is connected to the outlet contact 1317). In other words, distributed coupling along the relatively thin traces 17TA-17TC applies the counter-signal to the traces 17TB and 17TC thereby reducing crosstalk using less capacitance (and thus higher impedance) than the conventional high-speed compensation circuit 12 illustrated in FIGS. 1A-1C. Inductance distributed along the traces 17TA-17TC acts with the capacitance to resonate at a very high frequency that also helps reduce crosstalk.

The traces 17TD-17TF provide similar functionality. Referring to FIG. 42, the trace 17TD has an end portion 17ED positioned on the first side 1450 of the flexible substrate 1452. An intermediate portion 17ID connects the end portion 17ED of the trace 17TD to the via 17V2. In the embodiment illustrated, the intermediate portion 17ID has a substantially linear portion connected to the via 17V2, and a curved portion that connects the linear portion to the end portion 17ED and extends partway around the via 17V1.

Referring to FIG. 44, the traces 17TE and 17TF have end portions 17EE and 17EF, respectively, positioned on the second side 1451 of the flexible substrate 1452. A connecting portion 17CE of the trace 17TE positioned on the second side 1451 of the flexible substrate 1452 connects the end portion 17EE of the trace 17TE to the contact 1444. In the embodiment illustrated, the intermediate portion 17ID (see FIG. 42) of the trace 17TD crosses over the end portion 17EE and/or the connecting portion 17CE of the trace 17TE. The intermediate portion 17ID (see FIG. 42) of the trace 17TD also crosses over the trace 17TB and the first portion 17TA1 (see FIG. 43) of the trace 17TA.

A connecting portion 17CF of the trace 17TF positioned on the second side 1451 of the flexible substrate 1452 connects the end portion 17EF of the trace 17TF to the contact 1442. None of the traces 17TA-17TE crosses over the trace 17TF.

The end portion 17ED (see FIG. 42) of the trace 17TD is spaced apart from the end portion 17EE of the trace 17TE by the flexible substrate 1452. The end portion 17ED (see FIG. 42) of the trace 17TD and the end portion 17EE of the trace 17TE are relatively long when compared with the end portion 17EF of the trace 17TF. Thus, the longer end portions 17ED and 17EE of the traces 17TD and 17TE are formed on opposite sides of the flexible substrate 1452 and are substantially parallel to one another along spaced apart planes defined by the first and second sides 1450 and 1451, respectively, of the flexible substrate 1452.

The end portions 17ED and 17EE of the traces 17TD and 17TE have the same general two-dimensional shape. For example, in the embodiment illustrated, the end portions 17ED and 17EE are generally U-shaped. However, the shape defined by the end portion 17EE is smaller than and would be completely surrounded by the shape defined by the end portion 17ED if the end portions 17ED and 17EE were in the same plane.

The shorter end portion 17EF of the trace 17TF is spaced apart from the longer end portion 17ED of the trace 17TD by the flexible substrate 1452. In the embodiment illustrated, the shorter end portion 17EF is substantially linear and substantially parallel with at least a substantially linear portion 17LD (see FIGS. 42 and 43) of the longer end portion 17ED of the trace 17TD. If the substantially linear portion 17LD of the trace 17TD were in the same plane as the end portions 17EE and 17EF of the traces 17TE and 17TF, respectively, the substantially linear portion 17LD would extend between the end portions 17EE and 17EF of the traces 17TE and 17TF and contact neither the end portion 17EE of the trace 17TE nor the end portion 17EF of the trace 17TF.

Referring to FIG. 25, a signal on the outlet contact 1313 (for example) radiates crosstalk to the nearby outlet contacts 1312 and 1314. To counteract this crosstalk, the counter-signal being conveyed by the outlet contact 1316 is conducted by the trace 17TD (see FIG. 44). The longer end portion 17ED of the trace 17TD radiates a crosstalk canceling signal onto both the longer end portion 17EE of the trace 17TE (which is connected to the outlet contact 1314) and the shorter end portion 17EF of the trace 17TF (which is connected to the outlet contact 1312). In other words, distributed coupling along the relatively thin traces 17TD-17TF applies the counter-signal to the traces 17TE and 17TF thereby reducing crosstalk using less capacitance (and thus higher impedance) than the conventional high-speed compensation circuit 12 illustrated in FIGS. 1A-1C. Inductance distributed along the traces 17TD-17TF acts with the capacitance to resonate at a very high frequency that also helps reduce crosstalk.

By way of a non-limiting example, the traces 17TA-17TF may have a width of about 0.10 millimeters and a thickness of about 35 micrometers ("μm").

In some embodiments, the contacts 1442 and 1447 are omitted. In such embodiments, the traces 17TF and 17TC may be omitted from the compensation circuitry 1700.

Second Embodiment

Figure 45:
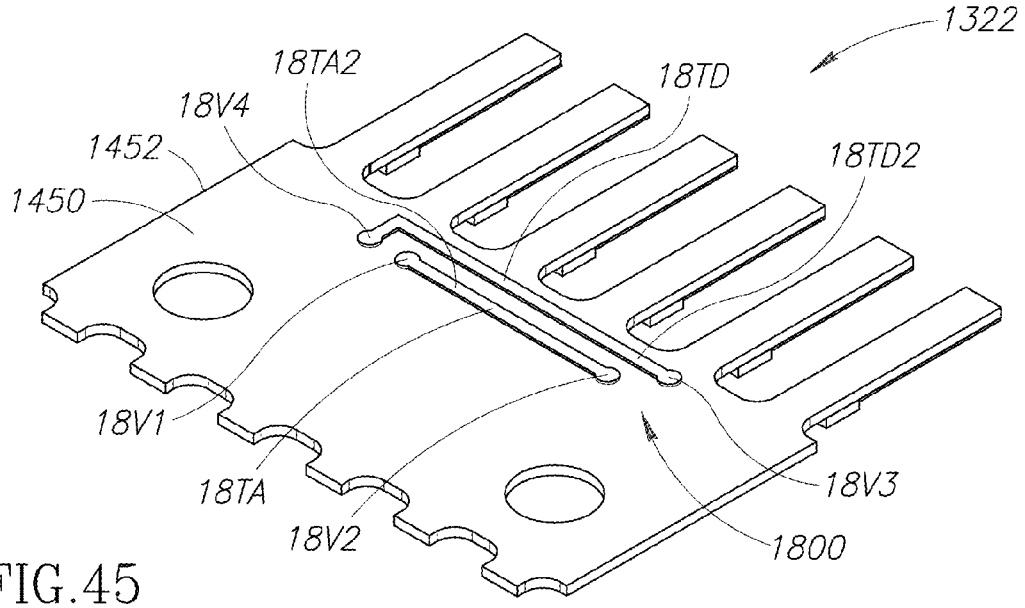
FIG. 45 is a perspective view of the first side of the flexible substrate of the compensation circuit of FIG. 40 including a second embodiment of compensation circuitry.
Figure 46:
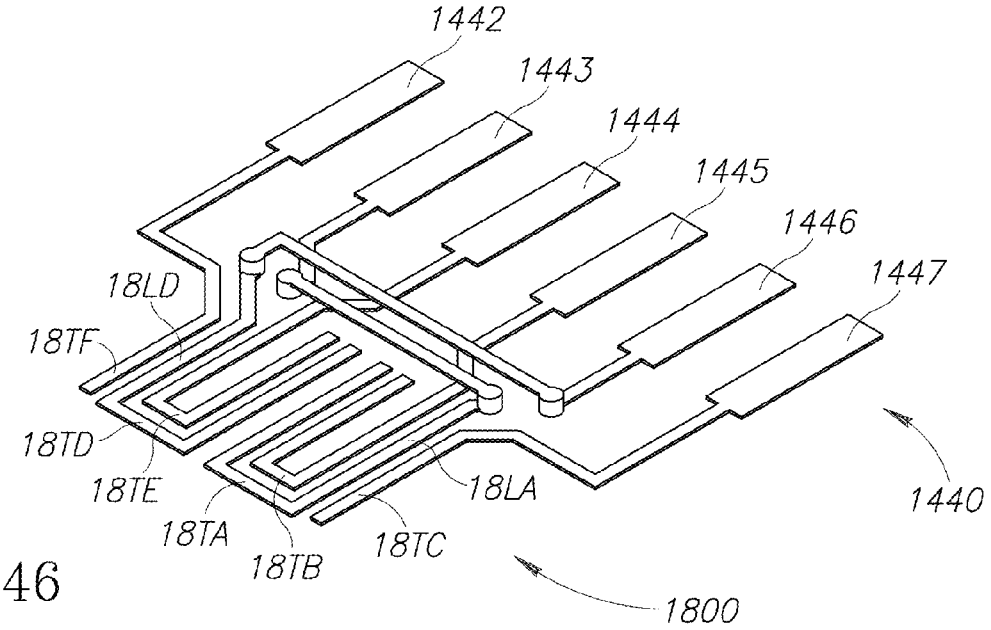
FIG. 46 is the perspective view of FIG. 45 omitting the flexible substrate.
Figure 47:
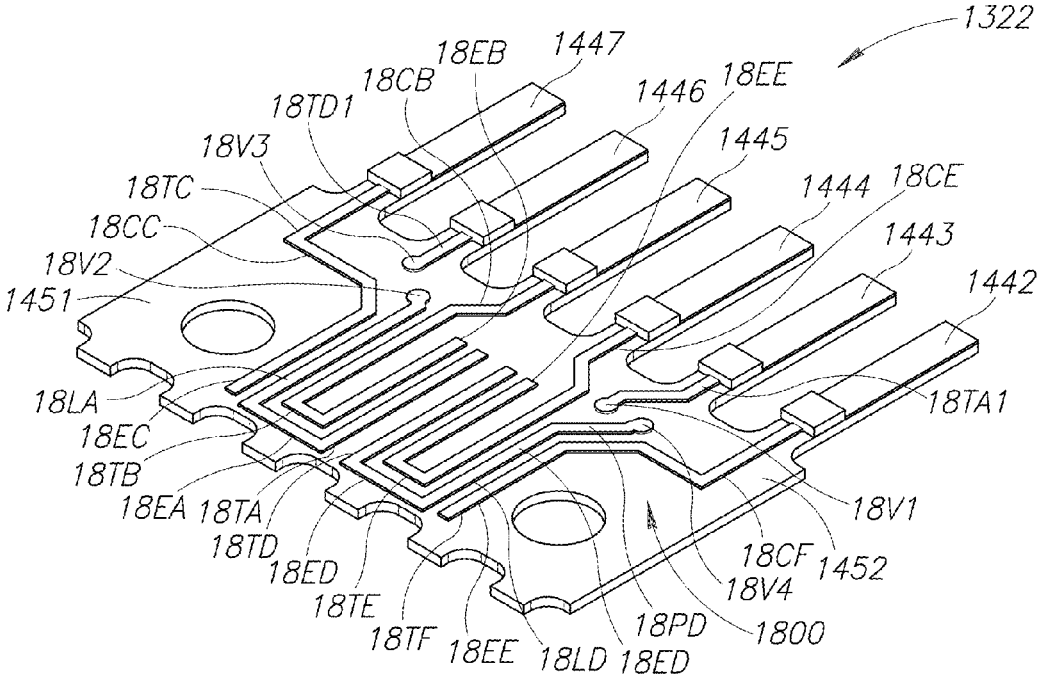
FIG. 47 is a perspective view of the second side of the flexible substrate of the compensation circuit of FIG. 40 including the second embodiment of compensation circuitry.

FIGS. 45 and 47 depict the compensation circuit 1322 including in a second embodiment of compensation circuitry 1800. In such embodiments, the compensation circuit 1322 may be characterized as being a single-layer high-impedance high-speed compensation flex circuit. This embodiment employs a special technique similar to that employed by the compensation circuitry 1800.

Referring to FIG. 47, the compensation circuitry 1800 includes traces 18TA-18TF connected to the contacts 1443, 1445, 1447, 1446, 1444, and 1442, respectively. By way of a non-limiting example, the traces 18TA-18TF may each have a width of about 0.10 millimeters and a thickness of about 35 micrometers ("μm").

The traces 18TB, 18TC, 18TE, and 18TF extend entirely on the second side 1451 of the flexible substrate 1452. The trace 18TA has a first portion 18TA1 that extends from the contact 1443 along the second side 1451 of the flexible substrate 1452 to a via 18V1. Referring to FIG. 45, the trace 18TA has an intermediate portion 18TA2 that extends from the via 18V1 along the first side 1450 to a via 18V2. Referring to FIG. 47, the trace 18TA has an end portion 18EA that extends from the via 18V2 along the second side 1451 of the flexible substrate 1452.

The trace 18TB has an end portion 18EB. A connecting portion 18CB of the trace 18TB connects the end portion 18EB of the trace 18TB to the contact 1445. In the embodiment illustrated, the intermediate portion 18TA2 of the trace 18TA is substantially linear and crosses over the end portion 18EB and/or the connecting portion 18CB of the trace 18TB. The intermediate portion 18TA2 (see FIG. 42) of the trace 18TA also crosses over the trace 18TE. The first portion 18TA1 (see FIG. 47) of the trace 18TA crosses under the trace 18TD.

The trace 18TC has an end portion 18EC. A connecting portion 18CC of the trace 18TC connects the end portion 18EC of the trace 18TC to the contact 1447. None of the traces 18TA, 18TB, and 18TD-18TF crosses over the trace 18TC.

The end portions 18EA and 18EB of the traces 18TA and 18TB are spaced apart from one another along the second side 1451 of the flexible substrate 1452. The end portions 18EA and 18EB of the traces 18TA and 18TB are relatively long when compared with the end portion 18EC of the trace 18TC. The end portions 18EA and 18EB of the traces 18TA and 18TB have the same general two-dimensional shape. For example, in the embodiment illustrated, the end portions 18EA and 18EB are generally U-shaped. However, the shape defined by the end portion 18EB is smaller than and completely surrounded by the shape defined by the end portion 18EA.

The shorter end portion 18EC of the trace 18TC is spaced apart from the longer end portion 18EA of the trace 18TA along the second side 1451 of the flexible substrate 1452. In the embodiment illustrated, the shorter end portion 18EC is substantially linear and substantially parallel with at least a substantially linear portion 18LA of the longer end portion 18EA of the trace 18TA. Thus, the substantially linear portion 18LA extends between the end portions 18EB and 18EC of the traces 18TB and 18TC and contacts neither the end portion 18EB of the trace 18TB nor the end portion 18EC of the trace 18TC.

Referring to FIG. 25, a signal on the outlet contact 1316 (for example) radiates crosstalk to the nearby outlet contacts 1317 and 1315. To counteract this crosstalk, the counter-signal being conveyed by the outlet contact 1313 is conducted by the trace 18TA (see FIG. 47). Referring to FIG. 47, the longer end portion 18EA of the trace 18TA radiates a crosstalk canceling signal onto both the longer end portion 18EB of the trace 18TB (which is connected to the outlet contact 1315) and the shorter end portion 18EC of the trace 18TC (which is connected to the outlet contact 1317). In other words, distributed coupling along the relatively thin traces 18TA-18TC applies the counter-signal to the traces 18TB and 18TC thereby reducing crosstalk using less capacitance (and thus higher impedance) than the conventional high-speed compensation circuit 12 illustrated in FIGS. 1A-1C. Inductance distributed along the traces 18TA-18TC acts with the capacitance to resonate at a very high frequency that also helps reduce crosstalk.

The traces 18TD-18TF provide similar functionality. The trace 18TD has a first portion 18TD1 that extends from the contact 1446 along the second side 1451 of the flexible substrate 1452 to a via 18V3. Referring to FIG. 45, the trace 18TD has an intermediate portion 18TD2 that extends from the via 18V3 along the first side 1450 to a via 18V4. Referring to FIG. 47, the trace 18TD has an end portion 18ED that extends from the via 18V4 along the second side 1451 of the flexible substrate 1452.

The trace 18TE has an end portion 18EE. A connecting portion 18CE of the trace 18TE connects the end portion 18EE of the trace 18TE to the contact 1444. In the embodiment illustrated, the intermediate portion 18TD2 (see FIG. 45) of the trace 18TD is substantially linear and crosses over the end portion 18EE and/or the connecting portion 18CE of the trace 18TE. The intermediate portion 18TD2 (see FIG. 45) of the trace 18TD also crosses over the trace 18TB. The intermediate portion 18TD2 (see FIG. 45) of the trace 18TD crosses over the first portion 18TA1 of the trace 18TA.

The trace 18TF has an end portion 18EF. A connecting portion 18CF of the trace 18TF connects the end portion 18EF of the trace 18TF to the contact 1442. None of the traces 18TA-18TD crosses over the trace 18TF.

The end portions 18ED and 18EE of the traces 18TD and 18TE are spaced apart from one another along the second side 1451 of the flexible substrate 1452. The end portions 18ED and 18EE of the traces 18TD and 18TE are relatively long when compared with the end portion 18EF of the trace 18TF. The end portions 18ED and 18EE of the traces 18TD and 18TE have the same general two-dimensional shape. For example, in the embodiment illustrated, the end portions 18ED and 18EE are generally U-shaped. However, the shape defined by the end portion 18EE is smaller than and completely surrounded by the shape defined by the end portion 18ED.

The shorter end portion 18EF of the trace 18TF is spaced apart from the longer end portion 18ED of the trace 18TD along the second side 1451 of the flexible substrate 1452. In the embodiment illustrated, the shorter end portion 18EF is substantially linear and substantially parallel with at least a substantially linear portion 18LD of the longer end portion 18ED of the trace 18TD. Thus, the substantially linear portion 18LD extends between the end portions 18EE and 18EF of the traces 18TE and 18TF and contacts neither the end portion 18EE of the trace 18TE nor the end portion 18EF of the trace 18TF.

In the embodiment illustrated, the linear portion 18LD of the trace 18TD defines part of the general U-shape of the end portion 18ED of the trace 18TD. Specifically, the linear portion 18LD forms one of the legs of the U-shape. Further, the linear portion 18LD is connected to the via 18V4 by an angled portion 18PD that does not form part of the U-shape.

Referring to FIG. 25, a signal on the outlet contact 1313 (for example) radiates crosstalk to the nearby outlet contacts 1312 and 1314. To counteract this crosstalk, the counter-signal being conveyed by the outlet contact 1316 is conducted by the trace 18TD (see FIG. 47). Referring to FIG. 47, the longer end portion 18ED of the trace 18TD radiates a crosstalk canceling signal onto both the longer end portion 18EE of the trace 18TE (which is connected to the outlet contact 1314) and the shorter end portion 18EF of the trace 18TF (which is connected to the outlet contact 1312). In other words, distributed coupling along the relatively thin traces 18TD-18TF applies the counter-signal to the traces 18TE and 18TF thereby reducing crosstalk using less capacitance (and thus higher impedance) than the conventional high-speed compensation circuit 12 illustrated in FIGS. 1A-1C. Inductance distributed along the traces 18TD-18TF acts with the capacitance to resonate at a very high frequency that also helps reduce crosstalk.

Thus, the compensation circuitry 1800 operates in much the same manner as the compensation circuitry 1700 (see FIGS. 42-44). However, the relatively long and thin end portions 18EA-18EF of the traces 18TA-18TF, respectively, are all positioned on the same side (or layer) of the flexible substrate 1452. Controlling tolerances may be easier with this arrangement because the structures that interact (e.g., the end portions 18EA-18EC, and the end portions 18ED-18EF) may be formed using the same optical template.

In some embodiments, the contacts 1442 and 1447 are omitted. In such embodiments, the traces 18TF and 18TC may be omitted from the compensation circuitry 1800.

Figure 1A:
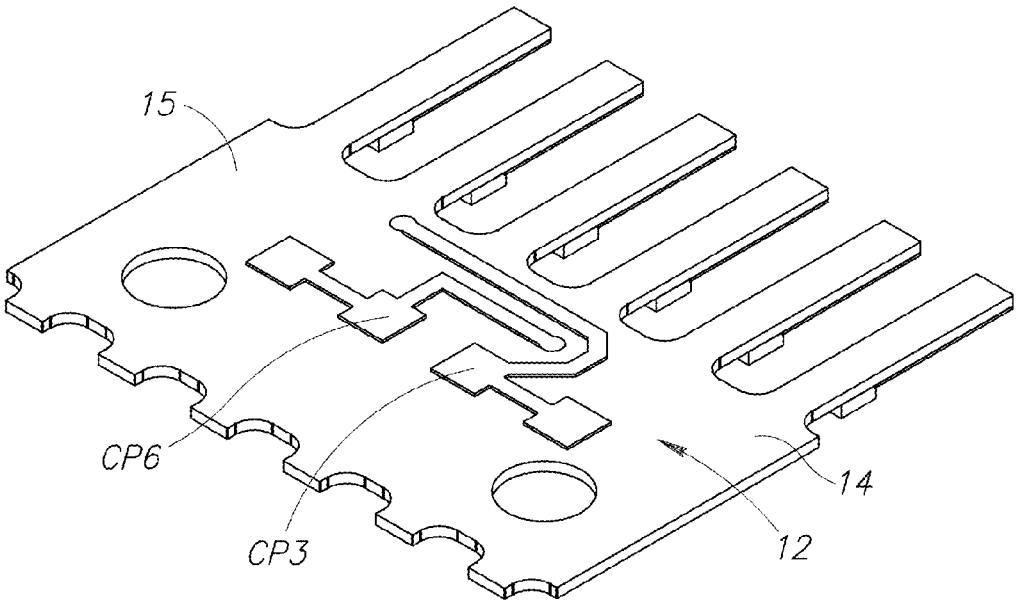
FIG.1A (PRIOR ART)
FIG. 1A is a perspective view of a first side of a prior art high-speed compensation circuit formed on a flexible substrate.
Figure 1B:
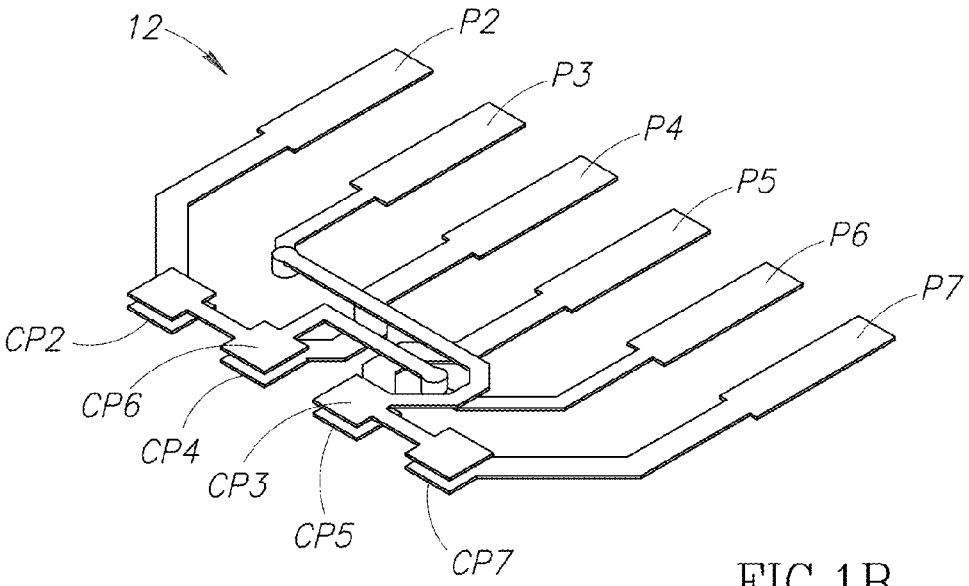
FIG.1B (PRIOR ART)
FIG. 1B is a perspective view of the first side of the prior art high-speed compensation circuit omitting the flexible substrate.
Figure 1C:
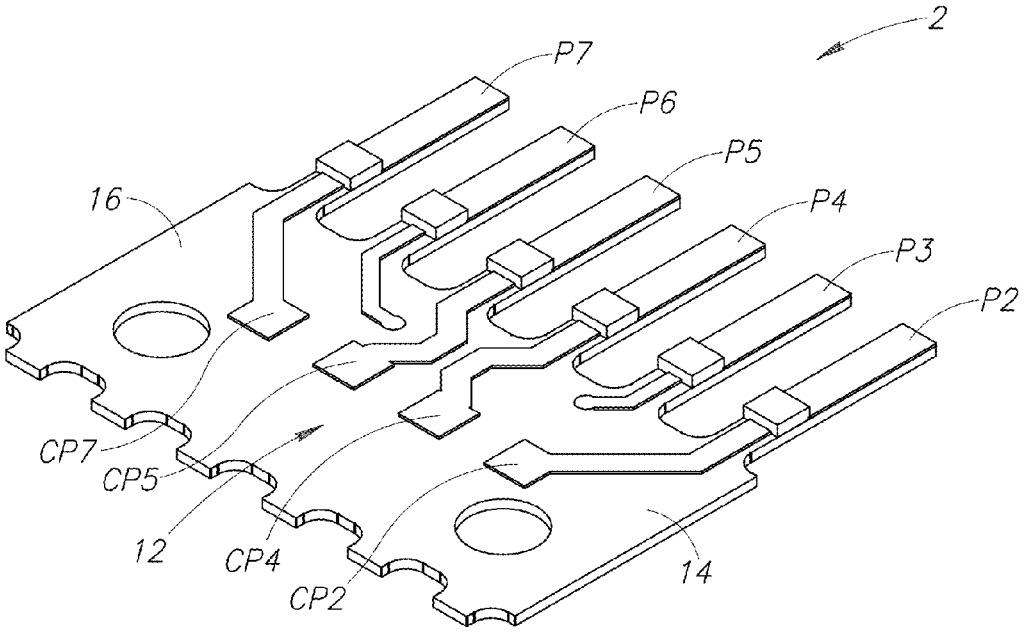
FIG.1C (PRIOR ART)
FIG. 1C is a perspective view of a second side of the prior art high-speed compensation circuit of FIG. 1A.

The compensation circuitry 1700 and 1800 differ significantly from conventional approaches (like the conventional high-speed compensation circuit 12 illustrated in FIGS. 1A-1C) that use "lumped element" capacitive plates or fingers. In contrast, the compensation circuitry 1700 and 1800 each use single trace interaction. The single trace (e.g., each of the traces 17TA, 17TD, 18TA, and 18TD) spreads out capacitive and inductive compensation effects. This distributed compensation increases impedance (of the compensation) and provides a beneficial resonance, which both improve signal transfer. This increased (or high) impedance compensation makes it possible to pass signal power, while experiencing only a satisfactory amount of insertion loss, through an outlet (e.g., the outlet 120 illustrated in FIGS. 2 and 5, the outlet 170 illustrated in FIG. 7, and/or other outlets constructed to comply with the RJ-45 standard) that includes the compensation circuit 1322.

Third Embodiment

Figure 48:
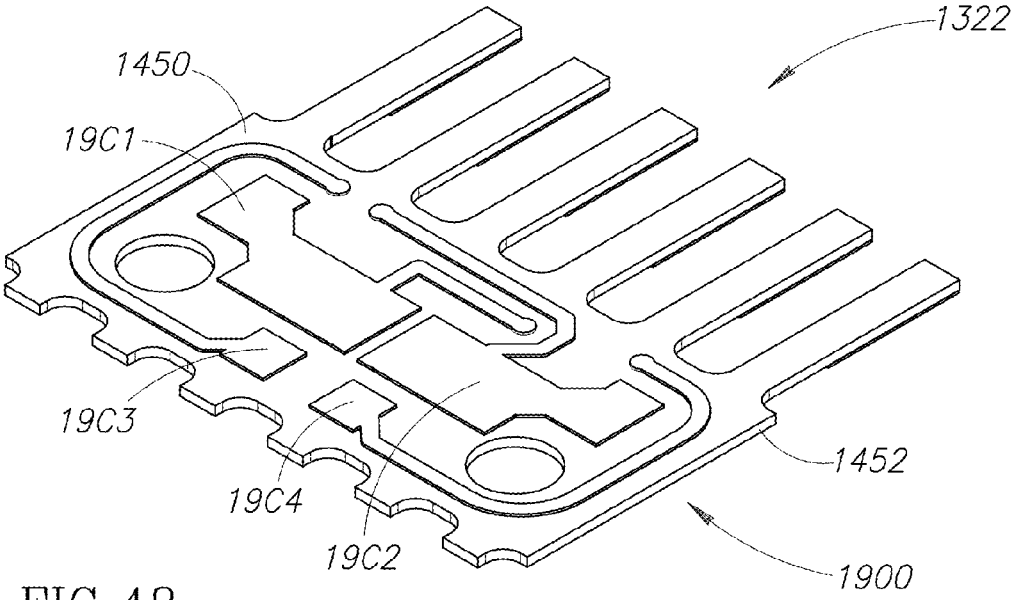
FIG. 48 is a perspective view of the first side of the flexible substrate of the compensation circuit of FIG. 40 including a third embodiment of compensation circuitry.
Figure 50:
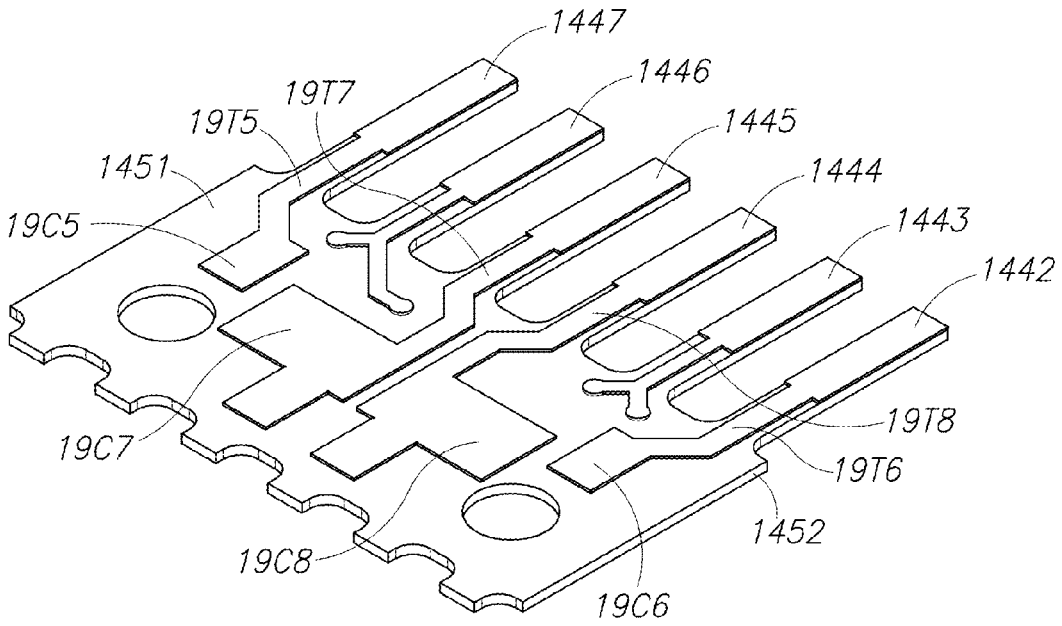
FIG. 50 is a perspective view of the second side of the flexible substrate of the compensation circuit of FIG. 40 including the third embodiment of compensation circuitry.
Figure 51:
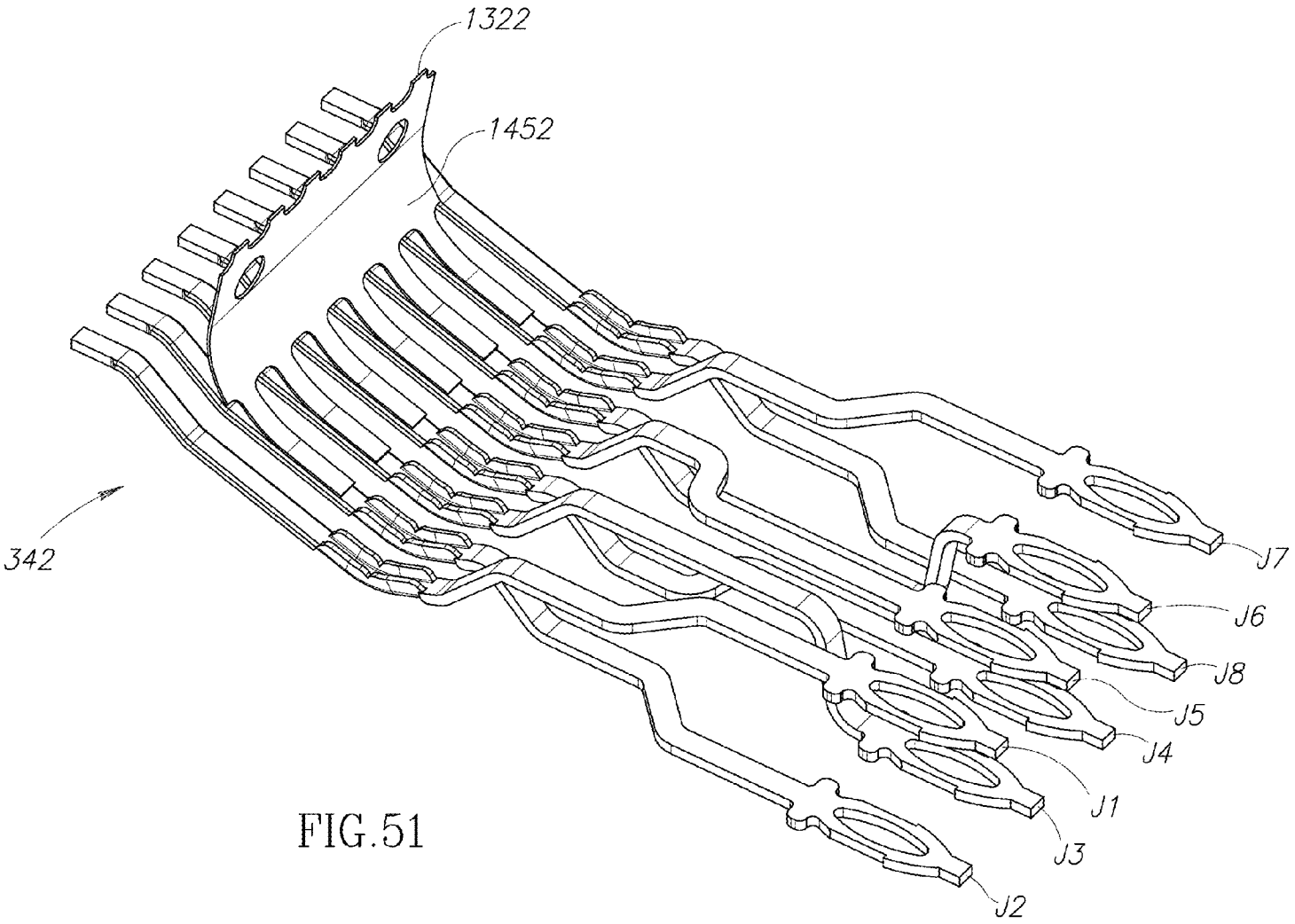
FIG. 51 is a perspective view of the compensation circuit of FIG. 40 attached to the outlet contacts of the first embodiment of the subassembly illustrated in FIG. 6.

FIGS. 48 and 50 depict the compensation circuit 1322 including in a third embodiment of compensation circuitry 1900. In such embodiments, the compensation circuit 1322 may be characterized as being a two-stage high-speed compensation flex circuit.

Two-stage crosstalk compensation or reduction relies on delaying part of the compensation to reduce total crosstalk.

To introduce enough delay, conventional two-stage crosstalk reduction uses long structures. Unfortunately, because of space limitations, such long structures could not be formed on a flexible circuit board and placed inside a communication outlet that conforms with the RJ-45 standard.

However, the inventors made a surprising breakthrough. At frequencies greater than 1.0 Gigahertz, structures operable to implement two-stage crosstalk reduction may be formed on a flexible circuit board that is small enough to be placed inside a communication outlet that conforms with the RJ-45 standard (e.g., the outlet 120 illustrated in FIGS. 2 and 5, the outlet 170 illustrated in FIG. 7, and the like).

Figure 49:
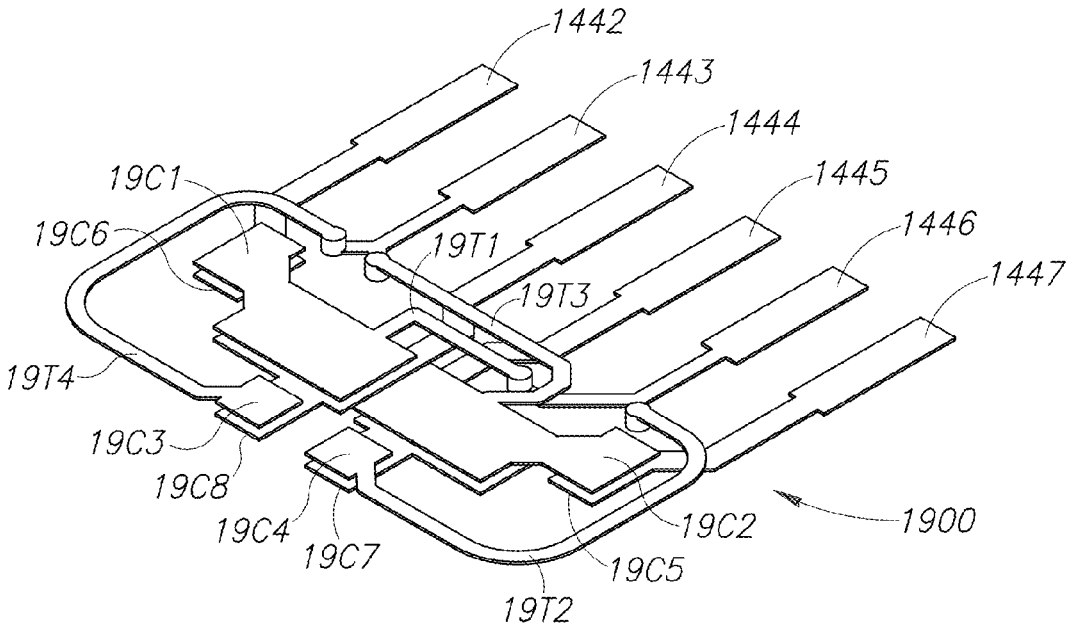
FIG. 49 is the perspective view of FIG. 48 omitting the flexible substrate.

Referring to FIG. 48, capacitor plates 19C1-19C4 are formed on the first side 1450 of the flexible substrate 1452. Referring to FIG. 49, the first and fourth capacitor plates 19C1 and 19C4 are connected by traces 19T1 and 19T2, respectively, to the contact 1446. The trace 19T2 is longer than the trace 19T1. Thus, the signal received by the contact 1446 (from the outlet contact 1316) must travel further and takes longer to reach the fourth capacitor plate 19C4 than the first capacitor plate 19C1.

The second and third capacitor plates 19C2 and 19C3 are connected by traces 19T3 and 19T4, respectively, to the contact 1443. The trace 19T3 is longer than the trace 19T4. Thus, the signal received by the contact 1443 (from the outlet contact 1313) must travel further and takes longer to reach the third capacitor plate 19C3 than the second capacitor plate 19C2.

Referring to FIG. 50, capacitor plates 19C5-19C8 are formed on the second side 1451 of the flexible substrate 1452. The fifth capacitor plate 19C5 is connected by a trace 19T5 to the contact 1447. The sixth capacitor plate 19C6 is connected by a trace 19T6 to the contact 1442. The seventh capacitor plate 19C7 is connected by a trace 19T7 to the contact 1445. The eighth capacitor plate 19C8 is connected by a trace 19T8 to the contact 1444.

Referring to FIG. 49, the first capacitor plate 19C1 is juxtaposed across the flexible substrate 1452 (see FIGS. 48 and 50) with both the sixth capacitor plate 19C6 and the eighth capacitor plate 19C8. Further, the eighth capacitor plate 19C8 is juxtaposed across the flexible substrate 1452 (see FIGS. 48 and 50) with the third capacitor plate 19C3. Thus, the first, third, sixth, and eighth capacitor plates 19C1, 19C3, 19 C6, and 19C8 are capacitively coupled together. This coupling, capacitively couples together the contacts 1442, 1443, 1444, and 1446 (and therefore, the outlet contacts 1312, 1313, 1314, and 1316).

Similarly, the second capacitor plate 19C2 is juxtaposed across the flexible substrate 1452 (see FIGS. 48 and 50) with both the fifth capacitor plate 19C5 and the seventh capacitor plate 19C7. Further, the seventh capacitor plate 19C7 is juxtaposed across the flexible substrate 1452 (see FIGS. 48 and 50) with the fourth capacitor plate 19C4. Thus, the second, fourth, fifth, and seventh capacitor plates 19C2, 19C4, 19 C5, and 19C7 are capacitively coupled together. This coupling, capacitively couples together the contacts 1443, 1445, 1446, and 1447 (and therefore, the outlet contacts 1313, 1315, 1316, and 1317).

The first stage of the two-stage crosstalk reduction is implemented as follows. As mentioned above, the signal on the outlet contact 1316 (for example) radiates noise and produces crosstalk in the nearby outlet contacts 1315 and 1317. To counteract that crosstalk, the counter-signal of the outlet contact 1313 is conducted (by the trace 19T3) to the second capacitor plate 19C2. Capacitive coupling between the second capacitor plate 19C2 and the fifth and seventh capacitor plates 19C5 and 19C7 (connected to the contacts 1447 and 1445, respectively) reduces (or at least partially cancels) crosstalk in the outlet contacts 1315 and 1317 caused by the outlet contact 1316. Similarly, to counteract crosstalk in the outlet contacts 1312 and 1314 caused by the outlet contact 1313, the counter-signal of the outlet contact 1316 is conducted (by the trace 19T1) to the first capacitor plate 19C1. Capacitive coupling between the first capacitor plate 19C1 and the sixth and eighth capacitor plates 19C6 and 19C8 (connected to the contacts 1442 and 1444, respectively) reduces (or at least partially cancels) crosstalk in the outlet contacts 1312 and 1314 caused by the outlet contact 1313.

The second stage of the two-stage crosstalk reduction, which occurs at the same time that the first stage is occurring, is implemented as follows. As mentioned above, the signal received by the contact 1446 (from the outlet contact 1316) must travel further and takes longer to reach the fourth capacitor plate 19C4 than the first capacitor plate 19C1. Thus, the signal traveling along the trace 19T2 is delayed with respect to the signal traveling along the trace 19T1. That delay shifts the phase of the signal before the signal reaches the fourth capacitor plate 19C4 (via the trace 19T2) and affects the seventh and second capacitor plates 19C7 and 19C2 that are connected to the contacts 1445 and 1443 (and therefore, the outlet contacts 1315 and 1313), respectively. Further, as mentioned above, the second capacitor plate 19C2 is capacitively coupled to the fifth capacitor plate 19C5 that is connected to the contact 1447 (and therefore, the outlet contacts 1317). The phase is changed enough (along the trace 19T2) that when the delayed signal from the contact 1446 combines with the counter-signal received from the outlet contact 1313 (via the trace 19T3), the total crosstalk on the outlet contacts 1315 and 1317 is further reduced.

Similarly, as mentioned above, the signal received by the contact 1443 (from the outlet contact 1313) must travel further and takes longer to reach the third capacitor plate 19C3 than the second capacitor plate 19C2. Thus, the signal traveling along the trace 19T4 is delayed with respect to the signal traveling along the trace 19T3. That delay shifts the phase of the signal before the signal reaches the third capacitor plate 19C3 (via the trace 19T4) and affects the eighth and first capacitor plates 19C8 and 19C1 that are connected to the contacts 1444 and 1446 (and therefore, the outlet contacts 1314 and 1316), respectively. Further, as mentioned above, the first capacitor plate 19C1 is capacitively coupled to the sixth capacitor plate 19C6 that is connected to the contact 1442 (and therefore, the outlet contacts 1312). The phase is changed enough (along the trace 19T4) that when the delayed signal from the contact 1443 combines with the counter-signal received from the outlet contact 1316 (via the trace 19T1), the total crosstalk on the outlet contacts 1314 and 1312 is further reduced.

In some embodiments, the contacts 1442 and 1447 are omitted. In such embodiments, the capacitor plates 19C6 and 19C5 and the traces 18T6 and 18T5 may be omitted from the compensation circuitry 1800.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A communication connector comprising:

a plurality of elongated contacts each having first, second, and third portions, the first portion having a first height, the second portion having a second height, the first height being greater than the second height, the third portion being configured to contact an electrical contact of a different communication connector, the plurality of elongated contacts comprising a plurality of contact pairs, each pair being configured to transmit a differential signal and comprising a first contact and a second contact, the first portion of the first contact being positioned alongside the first portion of the second contact to capacitively couple the first and second contacts together;

a compensation circuit connected to each of a portion of the plurality of elongated contacts at a position located between the first and third portions;

a plurality of wire contacts comprising a different wire contact corresponding to each of the plurality of elongated contacts; and a substrate comprising a plurality of electrical conductors that comprise a different electrical conductor corresponding to each of the plurality of elongated contacts that connects the elongated contact to the corresponding wire contact, the first portion of the each of the plurality of elongated contacts being positioned between the substrate and the third portion of the elongated contact.

2. The communication connector of claim 1, wherein the first contact of a first one of the plurality of contact pairs crosses over the second contact of the first contact pair at a crossover location, and the portion of the plurality of elongated contacts connected to the compensation circuit comprise the first contact pair.

3. The communication connector of claim 1, wherein the compensation circuit is a first compensation circuit, each of the plurality of elongated contacts has a first end portion connected to the electrical conductor corresponding to the elongated contact, each of the plurality of elongated contacts has a second end portion opposite the first end portion, the third portion of each of the plurality of elongated contacts is positioned between the first and second end portions, and the communication connector further comprises a second compensation circuit connected to the second end portion of each of a portion of the plurality of elongated contacts.

4. The communication connector of claim 1, wherein the each of the plurality of elongated contacts is formed from a conductive sheet material, and the first portion with the first height is formed by bending a portion of the conductive sheet material.

5. The communication connector of claim 1, wherein the first portion of each of the plurality of elongated contacts has an L-shaped cross-sectional shape.

6. The communication connector of claim 1, further comprising:

a dielectric comb comprising a dielectric member that extends between the first portion of the first contact of a first one of the plurality of contact pairs, and the first portion of the second contact of the first contact pair.

7. The communication connector of claim 6, wherein the dielectric member also extends between the first portion of the first contact of a second one of the plurality of contact pairs, and the first portion of the second contact of the second contact pair.

8. The communication connector of claim 7, wherein the dielectric member is a first dielectric member, and the dielectric comb further comprises:

a second dielectric member that extends between the first portion of the first contact of a third one of the plurality of contact pairs, and the first portion of the second contact of the third contact pair, and a third dielectric member that extends between the first portion of the first contact of a fourth one of the plurality of contact pairs, and the first portion of the second contact of the fourth contact pair.

9. The communication connector of claim 6, wherein the dielectric member is a first dielectric member, the dielectric comb further comprises a second dielectric member that extends between the first portion of the first contact of a second one of the plurality of contact pairs, and the first portion of the first contact of a third one of the plurality of contact pairs, and the second dielectric member also extends between the first portion of the second contact of the second contact pair, and the first portion of the second contact of the third contact pair.

10. The communication connector of claim 9, wherein the dielectric comb further comprises a third dielectric member that extends between the first portion of the first contact of a fourth one of the plurality of contact pairs, and the first portion of the second contact of the fourth contact pair.

11. The communication connector of claim 10, wherein the first portions of a second of the plurality of contact pairs are spaced at least 3 millimeters away from the first portions of a third of the plurality of contact pairs, the first portions of a fourth of the plurality of contact pairs are spaced at least 3 millimeters away from the first portions of the third contact pair, and the third contact pair is positioned between the second contact pair and the fourth contact pair.

12. The communication connector of claim 11, wherein the first portions of a first of the plurality of contact pairs are spaced vertically from the first portions of the third contact pair.

13. A communication connector comprising:

a plurality of contact pairs each comprising first and second contacts, each pair being configured to transmit a differential signal, the first and second contacts comprising first and second thicker portions, respectively, the first and second thicker portions being positioned alongside one another and coupling the first and second contacts together at least one of capacitively and inductively, the first and second thicker portions each having been formed by bending a portion of a conductive sheet material, the first and second thicker portions each having an L-shaped cross-sectional shape;

a plurality of wire contact pairs comprising a different wire contact pair corresponding to each of the plurality of contact pairs; and a substrate comprising a plurality of electrical conductor pairs that comprise a different electrical conductor pair corresponding to each of the plurality of contact pairs and connecting the contact pair to the corresponding wire contact pair.

14. The communication connector of claim 13, further comprising:

a dielectric comb comprising a dielectric member that extends between the first and second thicker portions of a first one of the plurality of contact pairs.

15. A communication connector comprising:

a plurality of elongated contacts each having a first portion and at least one second portion, the first portion having a first height, each of the at least one second portion having a second height, the first height being greater than the second height, each of the plurality of elongated contacts having a first end portion opposite a second end portion, each of the plurality of elongated contacts having an intermediate portion positioned between the first and second end portions and configured to contact an electrical contact of a different communication connector, the plurality of elongated contacts comprising a plurality of contact pairs, each pair being configured to transmit a differential signal and comprising a first contact and a second contact, the first portion of the first contact being positioned alongside the first portion of the second contact to capacitively couple the first and second contacts together, the first contact of a first one of the plurality of contact pairs crossing over the second contact of the first contact pair at a crossover location;

a compensation circuit connected to each of a portion of the plurality of elongated contacts comprising the first contact pair, the compensation circuit being connected to each of the portion of the plurality of elongated contacts at a position located between the intermediate portion of the elongated contact and the second end portion of the elongated contact, the compensation circuit being connected to the first contact of the first contact pair at a location approximately midway between the cross over location and the second end portion of the first contact of the first contact pair;

a plurality of wire contacts comprising a different wire contact corresponding to each of the plurality of elongated contacts; and a substrate comprising a plurality of electrical conductors that comprise a different electrical conductor corresponding to each of the plurality of elongated contacts that connects the elongated contact to the corresponding wire contact, the first end portion of each of the plurality of elongated contacts being connected to the electrical conductor corresponding to the elongated contact.

16. The communication connector of claim 15, wherein the compensation circuit is a second compensation circuit, and the communication connector further comprises a first compensation circuit connected to each of a portion of the plurality of elongated contacts at a position located between the intermediate portion and the first end portion.

17. The communication connector of claim 15, wherein the each of the plurality of elongated contacts is formed from a conductive sheet material, and the first portion with the first height is formed by bending a portion of the conductive sheet material.

18. The communication connector of claim 15, wherein the first portion of each of the plurality of elongated contacts has an L-shaped cross-sectional shape.

19. The communication connector of claim 15, further comprising:

a dielectric comb comprising a dielectric member that extends between the first portion of the first contact of a first one of the plurality of contact pairs, and the first portion of the second contact of the first contact pair.

20. The communication connector of claim 19, wherein the dielectric member also extends between the first portion of the first contact of a second one of the plurality of contact pairs, and the first portion of the second contact of the second contact pair.

21. The communication connector of claim 20, wherein the dielectric member is a first dielectric member, and the dielectric comb further comprises:

a second dielectric member that extends between the first portion of the first contact of a third one of the plurality of contact pairs, and the first portion of the second contact of the third contact pair, and a third dielectric member that extends between the first portion of the first contact of a fourth one of the plurality of contact pairs, and the first portion of the second contact of the fourth contact pair.

22. The communication connector of claim 19, wherein the dielectric member is a first dielectric member, the dielectric comb further comprises a second dielectric member that extends between the first portion of the first contact of a second one of the plurality of contact pairs, and the first portion of the first contact of a third one of the plurality of contact pairs, and the second dielectric member also extends between the first portion of the second contact of the second contact pair, and the first portion of the second contact of the third contact pair.

23. The communication connector of claim 22, wherein the dielectric comb further comprises a third dielectric member that extends between the first portion of the first contact of a fourth one of the plurality of contact pairs, and the first portion of the second contact of the fourth contact pair.

24. The communication connector of claim 23, wherein the first portions of a second of the plurality of contact pairs are spaced at least 3 millimeters away from the first portions of a third of the plurality of contact pairs, the first portions of a fourth of the plurality of contact pairs are spaced at least 3 millimeters away from the first portions of the third contact pair, and the third contact pair is positioned between the second contact pair and the fourth contact pair.

25. The communication connector of claim 24, wherein the first portions of a first of the plurality of contact pairs are spaced vertically from the first portions of the third contact pair.

26. A communication connector comprising:

a plurality of elongated contacts each having a first portion and at least one second portion, the first portion having a first height, each of the at least one second portion having a second height, the first height being greater than the second height, each of the plurality of elongated contacts having a first end portion opposite a second end portion, each of the plurality of elongated contacts having an intermediate portion positioned between the first and second end portions that is configured to contact an electrical contact of a different communication connector, the plurality of elongated contacts comprising a plurality of contact pairs, each pair being configured to transmit a differential signal and comprising a first contact and a second contact, the first portion of the first contact being positioned alongside the first portion of the second contact to capacitively couple the first and second contacts together;

a first compensation circuit connected to each of a first connected portion of the plurality of elongated contacts at a position located between the intermediate portion and the first end portion; and a second compensation circuit connected to the second end portion of each of a second connected portion of the plurality of elongated contacts;

a plurality of wire contacts comprising a different wire contact corresponding to each of the plurality of elongated contacts; and a substrate comprising a plurality of electrical conductors that comprise a different electrical conductor corresponding to each of the plurality of elongated contacts that connects the elongated contact to the corresponding wire contact, the first end portion of each of the plurality of elongated contacts being connected to the electrical conductor corresponding to the elongated contact.

27. The communication connector of claim 26, wherein the each of the plurality of elongated contacts is formed from a conductive sheet material, and the first portion with the first height is formed by bending a portion of the conductive sheet material.

28. The communication connector of claim 26, wherein the first portion of each of the plurality of elongated contacts has an L-shaped cross-sectional shape.

29. The communication connector of claim 26, further comprising:

a dielectric comb comprising a dielectric member that extends between the first portion of the first contact of a first one of the plurality of contact pairs, and the first portion of the second contact of the first contact pair.

30. The communication connector of claim 29, wherein the dielectric member also extends between the first portion of the first contact of a second one of the plurality of contact pairs, and the first portion of the second contact of the second contact pair.

31. The communication connector of claim 30, wherein the dielectric member is a first dielectric member, and the dielectric comb further comprises:

a second dielectric member that extends between the first portion of the first contact of a third one of the plurality of contact pairs, and the first portion of the second contact of the third contact pair, and a third dielectric member that extends between the first portion of the first contact of a fourth one of the plurality of contact pairs, and the first portion of the second contact of the fourth contact pair.

32. The communication connector of claim 29, wherein the dielectric member is a first dielectric member, the dielectric comb further comprises a second dielectric member that extends between the first portion of the first contact of a second one of the plurality of contact pairs, and the first portion of the first contact of a third one of the plurality of contact pairs, and the second dielectric member also extends between the first portion of the second contact of the second contact pair, and the first portion of the second contact of the third contact pair.

33. The communication connector of claim 32, wherein the dielectric comb further comprises a third dielectric member that extends between the first portion of the first contact of a fourth one of the plurality of contact pairs, and the first portion of the second contact of the fourth contact pair.

34. The communication connector of claim 33, wherein the first portions of a second of the plurality of contact pairs are spaced at least 3 millimeters away from the first portions of a third of the plurality of contact pairs, the first portions of a fourth of the plurality of contact pairs are spaced at least 3 millimeters away from the first portions of the third contact pair, and the third contact pair is positioned between the second contact pair and the fourth contact pair.

35. The communication connector of claim 34, wherein the first portions of a first of the plurality of contact pairs are spaced vertically from the first portions of the third contact pair.

36. A communication connector comprising:

a plurality of elongated contacts each having a first portion and and at least one second portion, the first portion having a first height and an L-shaped cross-sectional shape, each of the at least one second portion having a second height, the first height being greater than the second height, the plurality of elongated contacts comprising a plurality of contact pairs, each pair being configured to transmit a differential signal and comprising a first contact and a second contact, the first portion of the first contact being positioned alongside the first portion of the second contact to capacitively couple the first and second contacts together;

a plurality of wire contacts comprising a different wire contact corresponding to each of the plurality of elongated contacts; and a substrate comprising a plurality of electrical conductors that comprise a different electrical conductor corresponding to each of the plurality of elongated contacts that connects the elongated contact to the corresponding wire contact.

37. The communication connector of claim 36, wherein each of the plurality of elongated contacts has a third portion configured to contact an electrical contact of a different communication connector, and the first portion of the each of the plurality of elongated contacts is positioned between the substrate and the third portion.

38. The communication connector of claim 36, wherein each of the plurality of elongated contacts has a first end portion connected to the electrical conductor corresponding to the elongated contact, each of the plurality of elongated contacts has a second end portion opposite the first end portion, each of the plurality of elongated contacts has an intermediate portion positioned between the first and second end portions that is configured to contact an electrical contact of a different communication connector, and the communication connector further comprises a compensation circuit connected to each of a portion of the plurality of elongated contacts at a position located between the intermediate portion and the second end portion.

39. The communication connector of claim 36, further comprising:

a dielectric comb comprising a dielectric member that extends between the first portion of the first contact of a first one of the plurality of contact pairs, and the first portion of the second contact of the first contact pair.

40. The communication connector of claim 39, wherein the dielectric member also extends between the first portion of the first contact of a second one of the plurality of contact pairs, and the first portion of the second contact of the second contact pair.

41. The communication connector of claim 40, wherein the dielectric member is a first dielectric member, and the dielectric comb further comprises:

a second dielectric member that extends between the first portion of the first contact of a third one of the plurality of contact pairs, and the first portion of the second contact of the third contact pair, and a third dielectric member that extends between the first portion of the first contact of a fourth one of the plurality of contact pairs, and the first portion of the second contact of the fourth contact pair.

42. The communication connector of claim 39, wherein the dielectric member is a first dielectric member, the dielectric comb further comprises a second dielectric member that extends between the first portion of the first contact of a second one of the plurality of contact pairs, and the first portion of the first contact of a third one of the plurality of contact pairs, and the second dielectric member also extends between the first portion of the second contact of the second contact pair, and the first portion of the second contact of the third contact pair.

43. The communication connector of claim 42, wherein the dielectric comb further comprises a third dielectric member that extends between the first portion of the first contact of a fourth one of the plurality of contact pairs, and the first portion of the second contact of the fourth contact pair.

44. The communication connector of claim 43, wherein the first portions of a second of the plurality of contact pairs are spaced at least 3 millimeters away from the first portions of a third of the plurality of contact pairs, the first portions of a fourth of the plurality of contact pairs are spaced at least 3 millimeters away from the first portions of the third contact pair, and the third contact pair is positioned between the second contact pair and the fourth contact pair.

45. The communication connector of claim 44, wherein the first portions of a first of the plurality of contact pairs are spaced vertically from the first portions of the third contact pair.

46. A communication connector comprising:

a plurality of elongated contacts each having a first portion with a first height, and at least one second portion with a second height, the first height being greater than the second height, the plurality of elongated contacts comprising a plurality of contact pairs, each pair being configured to transmit a differential signal and comprising a first contact and a second contact, the first portion of the first contact being positioned alongside the first portion of the second contact to capacitively couple the first and second contacts together;

a dielectric comb comprising a dielectric member that extends between the first portion of the first contact of a first one of the plurality of contact pairs, and the first portion of the second contact of the first contact pair;

a plurality of wire contacts comprising a different wire contact corresponding to each of the plurality of elongated contacts; and a substrate comprising a plurality of electrical conductors that comprise a different electrical conductor corresponding to each of the plurality of elongated contacts that connects the elongated contact to the corresponding wire contact.

47. The communication connector of claim 46, wherein each of the plurality of elongated contacts has a third portion configured to contact an electrical contact of a different communication connector, and the first portion of the each of the plurality of elongated contacts is positioned between the substrate and the third portion.

48. The communication connector of claim 46, wherein each of the plurality of elongated contacts has a first end portion connected to the electrical conductor corresponding to the elongated contact, each of the plurality of elongated contacts has a second end portion opposite the first end portion, each of the plurality of elongated contacts has an intermediate portion positioned between the first and second end portions that is configured to contact an electrical contact of a different communication connector, and the communication connector further comprises a compensation circuit connected to each of a portion of the plurality of elongated contacts at a position located between the intermediate portion and the second end portion.

49. The communication connector of claim 46, wherein the dielectric member also extends between the first portion of the first contact of a second one of the plurality of contact pairs, and the first portion of the second contact of the second contact pair.

50. The communication connector of claim 49, wherein the dielectric member is a first dielectric member, and the dielectric comb further comprises:

a second dielectric member that extends between the first portion of the first contact of a third one of the plurality of contact pairs, and the first portion of the second contact of the third contact pair, and a third dielectric member that extends between the first portion of the first contact of a fourth one of the plurality of contact pairs, and the first portion of the second contact of the fourth contact pair.

51. The communication connector of claim 46, wherein the dielectric member is a first dielectric member, the dielectric comb further comprises a second dielectric member that extends between the first portion of the first contact of a second one of the plurality of contact pairs, and the first portion of the first contact of a third one of the plurality of contact pairs, and the second dielectric member also extends between the first portion of the second contact of the second contact pair, and the first portion of the second contact of the third contact pair.

52. The communication connector of claim 51, wherein the dielectric comb further comprises a third dielectric member that extends between the first portion of the first contact of a fourth one of the plurality of contact pairs, and the first portion of the second contact of the fourth contact pair.

53. The communication connector of claim 52, wherein the first portions of a second of the plurality of contact pairs are spaced at least 3 millimeters away from the first portions of a third of the plurality of contact pairs, the first portions of a fourth of the plurality of contact pairs are spaced at least 3 millimeters away from the first portions of the third contact pair, and the third contact pair is positioned between the second contact pair and the fourth contact pair.

54. The communication connector of claim 53, wherein the first portions of a first of the plurality of contact pairs are spaced vertically from the first portions of the third contact pair.

55. A communication connector comprising:

a plurality of contact pairs each comprising first and second contacts, each pair being configured to transmit a differential signal, the first and second contacts comprising first and second thicker portions, respectively, the first and second thicker portions being positioned alongside one another and coupling the first and second contacts together at least one of capacitively and inductively;

a dielectric comb comprising a dielectric member that extends between the first and second thicker portions of a first one of the plurality of contact pairs;

a plurality of wire contact pairs comprising a different wire contact pair corresponding to each of the plurality of contact pairs; and a substrate comprising a plurality of electrical conductor pairs that comprise a different electrical conductor pair corresponding to each of the plurality of contact pairs and connecting the contact pair to the corresponding wire contact pair.

56. The communication connector of claim 55, wherein the first and second thicker portions are each formed by bending a portion of a conductive sheet material.

57. The communication connector of claim 55, wherein the first and second thicker portions each has an L-shaped cross-sectional shape.

58. The communication connector of claim 55, wherein the first and second thicker portions each has an L-shaped cross-sectional shape, a square cross-sectional shape, a rectangular cross-sectional shape, a U-shaped cross-sectional shape, or a V-shaped cross-sectional shape.

59. The communication connector of claim 55, wherein the dielectric member is a first dielectric member, the plurality of contact pairs comprise second, third, and fourth contact pairs, the dielectric comb comprises second and third dielectric members, the second dielectric member extends between the first and second thicker portions of the second contact pair, and the third dielectric member extends between the first and second thicker portions of the third contact pair and between the first and second thicker portions of the fourth contact pair.

* * * * *